US006688729B1

(12) United States Patent
Imanaka et al.

(10) Patent No.: US 6,688,729 B1
(45) Date of Patent: Feb. 10, 2004

(54) LIQUID DISCHARGE HEAD SUBSTRATE, LIQUID DISCHARGE HEAD, LIQUID DISCHARGE APPARATUS HAVING THESE ELEMENTS, MANUFACTURING METHOD OF LIQUID DISCHARGE HEAD, AND DRIVING METHOD OF THE SAME

(75) Inventors: Yoshiyuki Imanaka, Kawasaki (JP); Sadayuki Sugama, Tsukuba (JP); Ichiro Saito, Yokohama (JP); Hiroyuki Ishinaga, Tokyo (JP); Akihiro Yamanaka, Kawasaki (JP); Masahiko Kubota, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/584,485

(22) Filed: Jun. 1, 2000

(30) Foreign Application Priority Data

Jun. 4, 1999 (JP) ..... 11-158361
Jun. 14, 1999 (JP) ..... 11-167374

(51) Int. Cl.[7] ..... B41J 2/05; B41J 29/393

(52) U.S. Cl. ..... 347/48; 347/19; 347/58; 347/65

(58) Field of Search ..... 347/5, 9, 14, 19, 347/20, 48, 54, 56, 58, 63, 65, 68, 94, 71, 72; 29/890.1; 216/27; 438/21

(56) References Cited

U.S. PATENT DOCUMENTS

| | | | | | |
|---|---|---|---|---|---|
| 4,429,321 | A | * | 1/1984 | Matsumoto | 347/59 |
| 4,498,088 | A | | 2/1985 | Kanayama | 347/92 |
| 4,695,852 | A | * | 9/1987 | Scardovi | 347/14 |
| 4,723,129 | A | | 2/1988 | Endo et al. | 347/56 |
| 4,725,859 | A | * | 2/1988 | Shibata et al. | 347/58 |
| 5,023,625 | A | * | 6/1991 | Bares et al. | 347/48 |
| 5,046,043 | A | | 9/1991 | Miller et al. | 365/145 |
| 5,500,988 | A | | 3/1996 | Moynihan et al. | 29/25.35 |
| 5,508,953 | A | | 4/1996 | Fukuda et al. | 365/145 |

(List continued on next page.)

FOREIGN PATENT DOCUMENTS

| | | | | |
|---|---|---|---|---|
| EP | 0 521 634 | | 1/1993 | |
| EP | 0 538 147 | | 4/1993 | |
| EP | 0 574 911 | | 12/1993 | |
| EP | 674 995 | A2 * | 10/1995 | B41J/2/16 |
| EP | 0 764 992 | | 3/1997 | |
| EP | 819531 | A2 * | 1/1998 | B41J/2/05 |
| EP | 0 819 537 | | 1/1998 | |
| EP | 819537 | A2 * | 1/1998 | B41J/2/14 |
| EP | 920 999 | A2 * | 6/1999 | B41J/2/05 |
| JP | 5-208495 | | 8/1993 | |
| JP | 6-112543 | | 4/1994 | |
| JP | 7-52387 | | 2/1995 | |

OTHER PUBLICATIONS

K.F. Etzold, The Electrical Engineering Handbook, 1997, CRC Press, Chapter 49. pp. 1179–1191.*

Patent Abstracts of Japan, vol. 012, No. 371 (M–748), Oct. 5, 1988 (JP 63 122549, May 26, 1988).

Patent Abstracts of Japan, vol. 1999, No. 09, Jul. 30, 1999 (JP 11 099646, Apr. 13, 1999).

Patent Abstracts of Japan, vol. 1997, No. 07, Jul. 31, 1997 (JP 09 076496, Mar. 25, 1997).

Patent Abstracts of Japan, vol. 010, No. 189 (M–494), Jul. 3, 1986 (JP 61 032762, Feb. 15, 1986).

*Primary Examiner*—Stephen D. Meier
*Assistant Examiner*—Blaise Mouttet
(74) *Attorney, Agent, or Firm*—Fitzpatrick, Cella, Harper & Scinto

(57) ABSTRACT

A liquid discharge head substrate used for a liquid discharge head adapted to discharge liquid by applying discharge energy to the liquid includes a semiconductor substrate provided with an energy conversion element for converting electric energy into discharge energy. The semiconductor substrate is further provided with a function element made of a ferroelectric material.

13 Claims, 27 Drawing Sheets

U.S. PATENT DOCUMENTS 5,580,468 A * 12/1996 Fujikawa et al. ..... 216/27
5,610,635 A * 3/1997 Murray et al. ..... 347/7
5,666,141 A * 9/1997 Matoba et al. ..... 347/54
5,691,752 A * 11/1997 Moynihan et al. ..... 347/68
5,777,356 A 7/1998 Dhote et al. ..... 257/295
5,838,035 A 11/1998 Ramesh ..... 257/295
5,877,977 A 3/1999 Essaian ..... 365/145
5,940,097 A * 8/1999 Imai ..... 347/49
6,074,048 A * 6/2000 Hotomi et al. ..... 347/71
6,087,638 A * 7/2000 Silverbrook ..... 219/540

* cited by examiner

LIQUID DISCHARGE HEAD SUBSTRATE, LIQUID DISCHARGE HEAD, LIQUID DISCHARGE APPARATUS HAVING THESE ELEMENTS, MANUFACTURING METHOD OF LIQUID DISCHARGE HEAD, AND DRIVING METHOD OF THE SAME

BACKGROUND OF THE INVENTION

1. Field of the Invention

The present invention relates to a liquid discharge head adapted to discharge desired liquid based on the generation of bubbles, which occurs by applying thermal energy to the liquid, a liquid discharge head substrate used therefor, a manufacturing method of the liquid discharge head, a driving method of the same, and a liquid discharge apparatus equipped with the liquid discharge head. More specifically, the invention relates to a liquid discharge head having a function element made of a ferroelectric material, a liquid discharge head substrate used therefor, a manufacturing method of the liquid discharge head, a driving method of the same, and a liquid discharge apparatus equipped with the liquid discharge head.

The invention can be applied to an apparatus such as a printer, a copying machine, a facsimile having a communication system, a word processor having a printer section or the like, which is provided to perform recording on a recording medium made of paper, a string, a fiber, cloth, metal, plastic, glass, wood, ceramic or the like, and also to an industrial liquid discharge apparatus compositely combined with various processors.

In the invention, "recording" means not only the impartation of a significant image such as a character, a graph or the like to the recording medium but also the impartation of an insignificant image such as a pattern or the like thereto.

2. Related Background Art

An ink-jet recording method has conventionally been known, which performs image formation by applying energy of heat or the like to ink to cause a state change accompanied by a steep volume change of ink (generation of bubbles), discharging the ink from a discharge port by an operation force generated because of the state change, and then depositing the ink on the recording medium. As disclosed in publications such as U.S. Pat. No. 4,723,129, a recording apparatus using such a recording method typically comprises a discharge port for discharging ink, an ink flow passage communicated with the discharge port, and an electric thermal converter arranged in the ink flow passage as energy generating means to discharge ink. The recording apparatus of this kind is advantageous in that it is possible to record a high-quality image at a high speed and with low noise, in that it is possible to provide a compact and high-resolution recording apparatus, and in many other respects. Therefore, the use of such recording apparatus has become widespread in recent years, e.g., in office equipment such as a printer, a copying machine, a facsimile or the like, and even in an industrial system such as a textile printing machine or the like.

FIG. 1 shows a constitutional example of a recording head. As illustrated in FIG. 1, the liquid discharge head includes an element substrate 1 having a plurality of heaters 2 (only one is shown in FIG. 1) provided in parallel to apply thermal energy to liquid for generating bubbles, a top board 3 joined above the element substrate 1, and an orifice plate 4 joined to the front end surfaces of the element substrate 1 and the top board 3. The top board 3 has grooves, each of which is formed in a position corresponding to each heater 2. By joining the element substrate 1 and the top board 3, a liquid flow passage 7 is formed corresponding to each heater 2.

The element substrate 1 is prepared by forming a silicon oxide film or a silicon nitride film on a substrate of silicon or the like for the purpose of insulation or heat accumulation, and patterning an electric resistance layer and a wiring constituting the heater 2 thereon. The heater 2 is caused to generate heat by applying a voltage from the wiring to the electric resistance layer, and supplying a current to the electric resistance layer. On the wiring and the electric resistance layer, a protective film is formed to protect these portions from ink. Further on the protective film, a cavitation resistance film is formed to provide protection from cavitation caused by the disappearance of ink bubbles.

The top board 3 constitutes a plurality of liquid flow passages 7 and a common liquid chamber 8 provided to supply liquid to each liquid flow passage 7, and a flow passage side wall 9 is integrally provided to extend from the top portion between the heaters 2. The top board 3 is made of a silicon-based material, and can be formed by forming the patterns of the liquid flow passage 7 and the common liquid chamber 8 by means of etching, depositing a material selected from silicon nitride, silicon oxide, and so on, for the flow passage side wall 9 on the silicon substrate by a widely known film-forming method such as a CVD method or the like, and then subjecting the portion of the liquid flow passage 7 to etching.

The orifice plate 4 has a plurality of discharge ports 5 formed corresponding to the respective liquid flow passages 7 and respectively communicated with the common liquid chamber 8 via the liquid flow passages 7. The orifice plate 4 is also made of a silicon-based material, and formed by, for example shaving the silicon substrate having the discharge ports 5 to have a thickness set in the range of 10 to 150 $\mu$m. The orifice plate 4 is not always a necessary element for the invention. Thus, in place of the orifice plate 4, it is possible to provide a top board equipped with discharge ports by leaving a wall equivalent to the thickness of the orifice plate 4 in the tip surface of the top board 3 when the liquid flow passage 7 is formed in the top board 3, and forming the discharge ports in this portion.

When the heater 2 is caused to generate heat based on the foregoing arrangement, heat is applied to the liquid of a bubble generation region 10, which faces the heater 2 located in the liquid flow passage 7, and thereby bubbles are generated and grown on the heater 2 based on a film boiling phenomenon. The propagation of a pressure and the growth of the bubbles themselves based on the generation of bubbles are guided to the discharge port 5 side, and discharge from the discharge ports 5.

On the other hand, when the bubbles enter the process of disappearance, in order to compensate for the reduced volume of the bubbles in the bubble generation region 10 and for the volume of the discharged liquid, liquid is caused to flow in from an upstream side, i.e., the common liquid chamber 8 side, filling the liquid flow passage 7 again (refilling).

In addition, the described liquid discharge head includes a circuit and an element provided to drive the heater 2 and control such driving. The circuit and the element are arranged on the element substrate 1 and the top board 3 in a divided manner. The circuit and the element can be easily and finely formed by using a semiconductor wafer processing technology, as the element substrate 1 and the top board 3 are made of silicon materials.

In the recording apparatus using the foregoing head, as shown in FIG. 2, a head carriage 1001 loading the liquid discharge head and a printer body 1002 are connected to each other via a cable 1003, and recording is performed by moving the head carriage 1001 in a subscanning direction on the recording surface of the recording medium. In the case of such a structure, a wiring for supplying a current to the electric thermal converter (heater) of the liquid discharge head inevitably becomes longer. Consequently, as described above, in the case of the liquid discharge head employing ink-jet recording of the type for driving the heater by supplying a steep current thereto, a problem of easy generation of current noises occurs because of interaction of wiring inductance. In addition, when all the nozzles of the liquid discharge head are driven, a current of several amperes flows instantaneously between the head and the body, i.e., to the cable 1003, resulting in the parallel passage of a logic signal in the cable 1003. Thus, a problem of current noises being carried on a signal conductor occurs because of inductive coupling. Such current noise problems have conventionally been dealt with by loading a capacitor as a current noise countermeasure on the carriage or a relay substrate.

On the other hand, with the progress in high-density recording in recent years, the quantity of ink discharged at one time has been reduced more and more, and studies have been conducted on various mechanisms to perform stable and highly accurate liquid discharging.

An exemplary apparatus may be one, which is adapted to provide a temperature sensor in a liquid discharge head and then maintain a head temperature in a specified range according to the detection result of the sensor.

Another exemplary apparatus may be one, which is adapted to load a nonvolatile memory on a liquid discharge head, store head information regarding a liquid discharge characteristic, a head state, and so on, in the memory, and then control the driving of the head according to such information. In this case, for the memory storing the head information, an EEPROM, a flash memory or the like is used.

The electric thermal converter provided to generate energy for discharging ink can be manufactured by using a semiconductor manufacturing process. Accordingly, the recording head of the foregoing type for discharging ink by using the electric thermal converter is constructed by forming the electric thermal converter on the element substrate 1 made of a silicon substrate, and joining the top board made of a resin of polysulfone or the like, or glass thereon, the top board having grooves for forming an ink flow passage.

Another available apparatus may be one, including, in addition to the electric thermal converter on the element substrate 1, a driver for driving the electric thermal converter, a temperature sensor used when controlling the electric thermal converter according to the temperature of the head, a driving control unit thereof, and so on, which are all arranged on the element substrate 1 based on the fact that the element substrate is made of the silicon substrate (Japanese Patent Application Laid-Open No. 7-52387 or the like). The head including the driver, the temperature sensor, the driving control unit thereof, and so on, has been put to practical use, contributing to the improvement of the reliability of the recording head and the miniaturization of the apparatus.

A current noise elimination effect by the capacitor is higher toward the portion (heater) for consuming current energy. However, a large capacitor has hitherto been required because of a large capacity needed by the capacitor provided as a current noise countermeasure. Consequently, in general, a space for installing the capacitor had to be set, and the capacitor as a current noise countermeasure was provided in the carriage or the relay substrate.

To effectively eliminate current noises, it is necessary to dispose the capacitor on a portion closer to the heater, e.g., on the element substrate for the liquid discharge head. In particular, with the higher speed of the liquid discharge head and the higher density recording in recent years, the quantity of current (current for heater driving) flowing instantaneously to the head substrate has been increased more and more. In such a situation, to counter current noises, it was necessary to set large the capacity of the capacitor and dispose it in a portion closer to the heater. But no specific solutions have been available.

On the other hand, following the lower costs of the liquid discharge device in recent years, efforts have been expended to reduce costs as well for the liquid discharge head. However, because of the arrangement of the foregoing EEPROM and the nonvolatile memory such as a flash memory as separate components on the head substrate, it has been difficult to lower costs.

Lately, an attempt has been made to control a driving condition for the liquid discharge heater by disposing various sensors in the head and feeding back the detection results thereof in real time. In this case, however, because of the frequent need to write/read information from the memory, it has been difficult to deal with the higher speed of the head in recent years by the nonvolatile memory.

Furthermore, the foregoing temperature sensor installed in the element substrate was provided primarily for the purpose of measuring the temperature of the element substrate. With the higher density of the liquid discharge head in recent years, however, the effect of the state of ink itself such as a temperature, concentration or the like, or its kind on recording has been larger than the temperature of the substrate. Thus, the sensor function must have high accuracy.

FIG. 3 shows another head having a structure different from that of the foregoing head. FIG. 3 specifically shows in section the head structure along a liquid flow passage. This head (referred to as a liquid discharge head or a recording head, hereinafter) includes an element substrate 1 having a plurality of heaters 2 (only one is shown in FIG. 3) provided in parallel as discharge energy generation elements for supplying thermal energy to generate bubbles in liquid, top board 3 joined above the element substrate 1, an orifice plate 4 joined to the front end surfaces of the element substrate 1 and the top board 3, and a movable member.

The arrangement of the element substrate 1, the top board 3, the orifice plate 4, and so on, is basically similar to that shown in FIG. 1, and thus description thereof will be omitted.

The liquid discharge head shown in FIG. 3 is provided with a cantilever-beam shaped movable member 6 disposed oppositely to the heater 2 in such a manner that the liquid flow passage 7 can be divided into a first liquid flow passage 7*a* communicated with the discharge port 5, and a second liquid flow passage 7*b* having the heater 2 as described above. The movable member 6 is a thin film made of a silicon-based material such as silicon nitride, silicon oxide or the like.

The movable member 6 is disposed away from the heater 2 by a specified distance in a position facing the heater 2 to cover the same such that a fulcrum 6*a* can be set in the upstream side of a large flow directed from the common liquid chamber 8 through the movable member 6 to the discharge port 5 by the discharge operation of liquid, and a free end 6*b* is set in a downstream side with respect to the fulcrum 6*a*. The bubble generation region 10 is formed between the heater 2 and the movable member 6.

With the foregoing arrangement, when the heater 2 generates heat, the heat is applied to the bubble generation region 10 between the movable member 6 and the heater 2. As a result, bubbles are generated and grown on the heater 2 because of a film boiling phenomenon. A pressure generated following the growth of the bubbles is preferentially applied to the movable member 6. Then, as indicated by a broken line in FIG. 3, the movable member 6 is displaced to open widely to the discharge port 5 side around the fulcrum 6*a*. Depending on the displacement of the movable member 6 or its displaced state, the propagation of the pressure or the growth of the bubbles themselves based on the generation of the bubbles is guided to the discharge port 5 side, and the liquid is discharged from the discharge port 5.

In other words, because of the arrangement of the movable member 6 having the fulcrum 6*a* set in the upstream side (common liquid chamber 8 side) of the flow of liquid in the liquid flow passage 7 and the free end 6*b* set in the downstream (discharge port 5 side), the pressure propagation direction of the bubbles is guided downstream, causing the pressure of the bubbles to make direct and efficient contribution to a discharging operation. In addition, the growth direction itself of the bubbles is guided downstream as in the case of the pressure propagation direction, and grown more greatly in the downstream side than in the upstream side. In this way, by using the movable member to control the growth direction itself of the bubbles and the pressure propagation direction thereof, it is possible to improve basic discharge characteristics including discharge efficiency, a discharge velocity, and so on.

On the other hand, when the bubbles enter the process of disappearance, the bubbles quickly disappear by interaction with the elastic force of the movable member 6, and the movable member 6 also returns to its initial position indicated by a solid line in FIG. 3 at the end. In this case, to compensate for the reduced volume of the bubbles in the bubble generation region 10 and for the volume of the discharged liquid, liquid is supplied from the upstream side, i.e., from the common liquid chamber 8, to fill the liquid flow passage 7 (refilling). This liquid refilling is carried out in an efficient, rational and stable manner following the returning movement of the movable member 6.

However, with the liquid discharge head of the described structure, it was impossible to actively displace the movable member, although the displacement thereof occurred following the growth and disappearance of the bubbles. Consequently, the displacement velocity of the movable member depended on the growth and disappearance velocities of the bubbles, resulting in the impossibility of displacing the movable member at a speed exceeding such velocities. Therefore, it was impossible to improve the responsiveness of the movable member, and accordingly impossible to achieve a high recording speed with the liquid discharge head.

SUMMARY OF THE INVENTION

An object of the invention is to provide a liquid discharge head capable of sufficiently eliminating current noises and reducing costs, a liquid discharge head substrate used therefor, and a liquid discharge apparatus equipped with the liquid discharge head.

Another object of the invention is to a liquid discharge head having a memory structure, which is capable of achieving a high head speed and low costs, a liquid discharge head used therefor, and a liquid discharge apparatus equipped with the liquid discharge head.

A further object of the invention is to provide a liquid discharge head enabling stable discharging to be performed by accurately detecting the state of liquid to be discharged, a liquid discharge head substrate used therefor, and a liquid discharge apparatus equipped with the liquid discharge head.

A further yet another object of the invention is to provide a liquid discharge head capable of improving the responsiveness of a movable member arranged in a recording head and achieving a high recording speed, and a driving method of the liquid discharge head.

In order to achieve the foregoing object, a liquid discharge head substrate of the invention, which is used for a liquid discharge head adapted to discharge liquid by applying discharge energy to the liquid and which is equipped with a semiconductor substrate including an energy conversion element for converting electric energy into the discharge energy, comprises a function element made of a ferroelectric material formed in the semiconductor substrate.

A liquid discharge head of the invention comprises first and second substrates for constituting a plurality of liquid flow passages (paths) respectively communicated with a plurality of discharge ports for discharging liquid by being joined to one another, and a function element made of a ferroelectric material, which is formed in one, alternatively both of the first and second substrates.

In the liquid discharge head substrate and in the liquid discharge head, preferably, the function element should be formed by laminating at least a first barrier layer, a ferroelectric material film, and a second barrier on the semiconductor substrate.

If the ferroelectric material film is placed in a reduction environment, there is a possibility that the film will be easily reduced to lose its durability in terms of life, making it impossible to provide its function with high reliability for a long time. By way of example, in the case of a CVD method as a film forming method used for manufacturing a recording head, a reduction environment is set by atmosphere of hydrogen ions or the like generated when a protective film (e.g., SiN) for the recording head is formed. Alternatively, a reduction environment is set in a contact boundary surface between electrodes and the ferroelectric material film if the ferroelectric material film is held between usually used Pt electrodes. Consequently, the ferroelectric material film is easily subjected to reduction. Therefore, the foregoing holding between the barrier layers is a preferably arrangement for preventing such a reduction environment.

In this case, preferably, the first and second barrier layers should be made of oxide and nitride films including a heat generation resistance layer and a cavitation resistance film, which constitute the liquid discharge head.

Especially, a head structure using a heater contributing to liquid discharging comprises the step of forming the heat generation resistance layer by sputtering a heater material of TaSiN or TaN. The sputtering film forming step enables the barrier layers of the ferroelectric material film to be formed during the formation of the heat generation resistance layer or the cavitation resistance layer without any reduction environments set because of no hydrogen ions generated unlike the case of the CVD film forming step, and without exposing the ferroelectric material film to reduction atmosphere. Moreover, the heat generation resistance layer and the cavitation resistance film are provided with sufficient durability as recording head characteristics. Thus, the use of such films for the barrier layers of the ferroelectric material film is preferably in terms of durability because of stable composition.

If the barrier layers of the ferroelectric material film are formed at the same time when the heat generation resistance layer or the cavitation resistance film is formed, the number of manufacturing steps can be reduced compared with the case of forming these films in a separate manner, and the same manufacturing device can also be used. Accordingly, manufacturing costs can be reduced by the shared use of the device. In other words, it is possible to form the barrier layers of the ferroelectric material film by using the same method as that for the heat generation resistance layer or the cavitation resistance film, and it is also possible to use the heat generation resistance layer and the cavitation resistance film material directly as the barrier layers.

Consideration is now given to the shared use of the manufacturing device, for example, if a heat resistor is formed by sputtering TaSiN, a TaSiN target is subjected to sputtering in N atmosphere, but a highly stable Si target may be prepared and subjected to sputtering in N atmosphere by using the same device, and an Si film (film containing no hydrogen generated in the film forming step) thereby formed can be used for the barrier layer of the ferroelectric material film. In addition, by using the sputtering device for heater layer formation, a target made of metal such as Ti may be prepared and subjected to sputtering in N atmosphere, and a TiN film thereby formed can be used as the barrier layer of the ferroelectric material film. A stable film can be formed by reacting various metals with nitrogen and oxygen. In this way, it is possible to form an effective barrier layer by using the film forming device of the ink-jet recording head and replacing only the target. It is also possible to form a stable film without any exposure to a reduction environment of hydrogen ions or the like.

In addition to the formation of the heater layer, the barrier layer may also be formed by using, for example, a material of Ta or the like used for the cavitation resistance layer directly, using the film forming device of the cavitation resistance film and then performing sputtering in an N atmosphere. The film forming method is sputtering, which has no hydrogen ions generated unlike the case of the CVD, and forms a barrier layer by reacting the same stable material as that for the cavitation resistance material film with nitrogen and oxygen without any exposure to the environment of reducing the ferroelectric material film. Thus, a stable barrier can be formed. Since the target of the sputtering device is the same as that for the cavitation resistance layer and the barrier layer can be formed by using the same device and in the same step, it is possible to provide high mass productivity, and simplify the manufacturing process.

Sputtering is also performed for a film formed to prevent a hillock phenomenon caused by heat generated in an aluminum wiring layer of TiW or TaN used for the upper layer of the wiring layer disposed in the lower part of the heater layer. Alternatively, sputtering may be performed in nitrogen and oxygen atmosphere to form a barrier layer for the ferroelectric material film. The film forming method is sputtering, which has no hydrogen ions generated unlike the case of the CVD, and forms a barrier layer by reacting the same stable material as that of the hillock prevention film with nitrogen or oxygen without any exposure to the environment of reducing the ferrorlectric material film. Thus, a stable barrier layer can be formed. Since the target of the sputtering device is the same as that for the hillock prevention layer and the barrier layer can be formed by using the same device and in the same step, it is possible to provide high mass productivity and simplify the manufacturing process.

In the case of a recording head constructed in a manner that a metal film of Ti or the like is formed as an adhesive layer, which is provided if a heater layer is made of $HfB_2$ or the like, and adhesion between the heater layer and its protective film of SiN or SiO is not relatively good, a barrier layer can be formed by sputtering the metal film of Ti or the like constituting the adhesive layer in oxygen atmosphere for the ferroelectric material film. The film forming method is sputtering, which has no hydrogen ions generated unlike the case of the CVD, and forms a barrier layer by reacting the same stable material as that for the adhesive layer with nitrogen or oxygen without any exposure to the environment of reducing the ferroelectric material film. Thus, a stable barrier film can be formed. Since the target of the sputtering device is the same as that for the adhesive layer and the barrier layer can be formed by using the same device and in the same step, it is possible to provide high mass productivity, and simplify the manufacturing process.

For the first and second barrier layers, preferably, the rates of oxygen and nitrogen should be set high in portions closer to the ferroelectric material film in the film thickness directions of the oxide and nitride films including the heat resistance layer and the cavitation resistance film. Moreover, the rates of oxygen and nitrogen may be changed continuously or intermittently in the film thickness directions of the barrier layers.

The function element may take a form of one selected from a capacitor, a nonvolatile memory, a piezoelectric element and a movable member.

A liquid discharge apparatus of the invention performs recording by using the foregoing liquid discharge head to discharge liquid to a recording medium.

In accordance with the invention, a driving method of a liquid discharge head is provided. In this case, the liquid discharge head includes a discharge port for discharging liquid drops, a liquid flow passage communicated with the discharge port to supply liquid to the discharge port, a substrate having a bubble generation element to generate bubbles in the liquid filling the liquid flow passage, and a movable member located in a position facing the bubble generation element of the substrate, provided with a gap formed with the substrate, and supported and fixed on the substrate with the discharge port side set as a free end. The free end of the movable member is displaced in a direction opposite the substrate by a pressure generated by the generation of the bubbles, and the drops of the liquid are discharged from the discharge port by guiding the pressure to the discharge port. The movable member includes a thin film made of a ferroelectric material and electrodes provided in both surfaces of the thin film, and the free end is displaced to the element substrate, alternatively in a direction opposite the element substrate when a voltage is applied between the electrodes. The driving method of this liquid discharge head comprises the step of performing driving of a heater and driving of the movable member independently of each other.

Since the ferroelectric material constituting the foregoing function element has a large relative dielectric constant, a capacitor having a large capacity can be formed, and an installation space for its formation in the substrate can be reduced. According to the invention, since the function element is directly formed as a capacitor for a current noise countermeasure in the substrate of the head, a current noise countermeasure can be taken for a portion closer to the heater. In addition, its installation space can be reduced. Also, because of the large capacity, the problem of current noises following the increase of current like that described above in the related art can be dealt with.

It is known that the nonvolatile memory constructed by using the ferroelectric material can provide a higher speed, lower power consumption and higher integration compared with the conventional nonvolatile memory represented by an EEPROM or a flash memory. According to the invention, because of the use of the nonvolatile memory constructed by using the ferroelectric material having the above characteristics, a high processing speed can be achieved for control of head driving, for example, control of a heater driving condition for liquid discharging by disposing various sensors in the head and feeding back the detection results of the sensors in real time. Accordingly, it is possible to deal with the recent higher speed of the head like that described above in the related art.

The ferroelectric material can be used as a piezoelectric element because of its piezoelectric characteristic. The invention provides an arrangement where the change of a pressure transmitted in the liquid is detected by using the function element made of the ferroelectric material as a piezoelectric element. Accordingly, it is possible to perform finer head driving control by using the result of such detection.

On the other hand, the occurrence of displacement by applying a voltage to the ferroelectric material may be utilized. Specifically, the displacement can be used to discharge ink, control the meniscus of the orifice, and so on. To facilitate displacement, a movable member may be provided, and the ferroelectric material may be provided therein. Since this arrangement is substantially similar to that of performing printing control by detecting the pressure of ink, a combined arrangement may be made. Also, a laminated structure may be employed to enlarge displacement.

With the liquid discharge head of the invention comprising the movable member made of the ferroelectric material, the movable member can be actively displaced independently of displacement caused by the pressure of bubbles. Therefore, since the responsiveness of the movable member can be improved by displacing the movable member in a specified direction before the generation of bubbles or the disappearance thereof, it is possible to achieve a high recording speed by the liquid discharge head.

The thin film should preferably be made of one selected from Pb—$Zr_x$—$Ti_{1-x}O_3$, (Pb, La)—(Zr, Ti)$O_3$, Sr—$Bi_2$–$Ta_2O_9$, $SrTiO_3$, $BaTiO_3$, and (Ba—Sr)$TiO_3$.

Furthermore, it is possible to increase the displacing quantity of the movable member by providing a displacement auxiliary layer on a surface of one of two electrodes, the layer being made of a material which generates no distortion even in an electric field.

Since the function element can be simultaneously formed in the process of manufacturing the substrate (element substrate, top board) of the head, no special film forming devices are necessary for the formation of the same.

Among the foregoing arrangements of the invention, in the case of one having the first and second barrier layers constituting the function element are made of oxide and nitride including the cavitation resistance layer and the heat resistance layer, the use of the films is also allowed in the process of manufacturing the substrate (element substrate, top board) of the head. Accordingly, it is possible to reduce the number of manufacturing steps and costs.

It should be noted that "upstream side" and "downstream side" used in this specification are used in relation to the direction of a liquid flow from the liquid supply source through the bubble generation region (or movable member) to the discharge port. Alternatively, these terms represent directions in such a constitutional arrangement.

In addition, according to the driving method of the invention, the heater and the movable member are driven independently of each other.

Therefore, it is possible to improve the responsiveness of the movable member and achieve a high recording speed for the liquid discharge head by actively driving the movable member independently to be displaced in a specified direction before the generation of bubbles or the disappearance thereof.

Preferably, before the heater is driven, the movable member should be driven to displace the free end thereof in a direction opposite the element substrate. In this way, since the liquid surface of the liquid protruded from the discharge port is retreated by a certain distance in the liquid flow passage, a liquid discharge quantity can be stabilized for each liquid discharging operation. Moreover, since the flow of liquid to the upstream side is cut off to cause efficient flowing of the liquid to the discharge port in the downstream side, liquid discharge efficiency from the discharge port can be enhanced.

Furthermore, before the heater is driven to cause disappearance of the bubbles generated in the liquid, the movable member is driven to displace the free end thereof to the element substrate side. In this way, since the same quantity of liquid is returned from the discharge port side into the liquid flow passage for each discharging operation, it is possible to prevent a tailing phenomenon, which may occur following a flight of liquid bodies (drops) in the vicinity of discharge port, or a phenomenon of a flight of small liquid drops as satellite drops, which may occur after main liquid drops. Moreover, liquid refilling from the upstream side can be performed at a high speed.

In accordance with the object of the invention, there is provided a driving method of an ink-jet recording head. In this case, the ink-jet recording head includes a liquid discharge energy generation element and a function element made of a ferroelectric material. The driving method comprises the step of forming barrier layers to be laminated for the ferroelectric material when the liquid discharge energy generation element is formed.

DETAILED DESCRIPTION OF THE PREFERRED EMBODIMENTS

Next, description will be made of the preferred embodiments of the invention with reference to the accompanying drawings.

Figure 4:
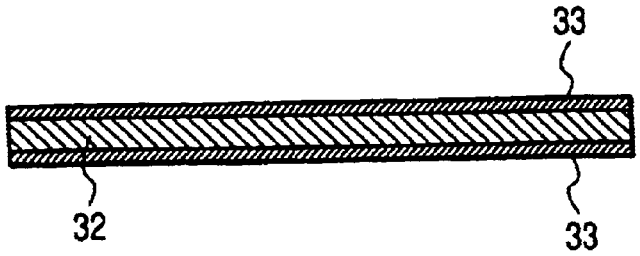
FIG. 4 is a structural view schematically showing in section a function element made of a ferroelectric material, which is formed on the liquid discharge head substrate of the invention.

FIG. 4 is a structural view schematically showing in section a function element made of a ferroelectric material, which is formed on the liquid discharge head substrate of the invention. This function element includes barrier layers 33 formed as protective layers in the upper and lower surfaces of a ferroelectric material film 32 made of $Pb(Zr, Ti)O_3$ [PZT: lead zirconate titanic] or the like, electrodes (not shown) formed thereon in the upper and lower surfaces, constituting a capacitor, an FeRAM, a piezoelectric element and a movable member.

The use of the above function element as a capacitor designed to prevent noises is particularly effective to counter heater driving current noises, because the ferroelectric material has a large relative dielectric constant. In this case, a capacitor of several $\mu$F can be formed. Also, the use of the function element as an FeRAM enables a memory to be formed, which can deal with a high head speed described above in the related art, because its recording speed is much faster compared with a conventional nonvolatile memory represented by an EEPROM or a flash memory. Further, the use of the function element as a piezoelectric element enables more stable discharge control to be performed, because the change of a pressure transmitted in liquid can be detected. In addition, the use of the function element as a movable member enables a higher recording speed to be achieved, because the responsiveness of the movable member to an ink discharging operation can be improved.

Now, description will be made of a specific constitution of a liquid discharge head equipped with the foregoing liquid discharge head substrate.

Described first as a structure of a liquid discharge head applicable to the invention is a liquid discharge head, which comprises a plurality of discharge ports provided to discharge liquid, first and second substrates for constituting a plurality of liquid flow passages respectively communicated with the plurality of discharge ports by being joined to one another, a plurality of energy conversion elements disposed in the respective liquid flow passages to convert electric energy into discharge energy of liquid therein, and a plurality of elements or electric circuits having different functions provided to control a driving condition for the energy conversion elements. The elements or the electric circuits are distributed to the first and second substrates in accordance with functions thereof.

Figure 1:
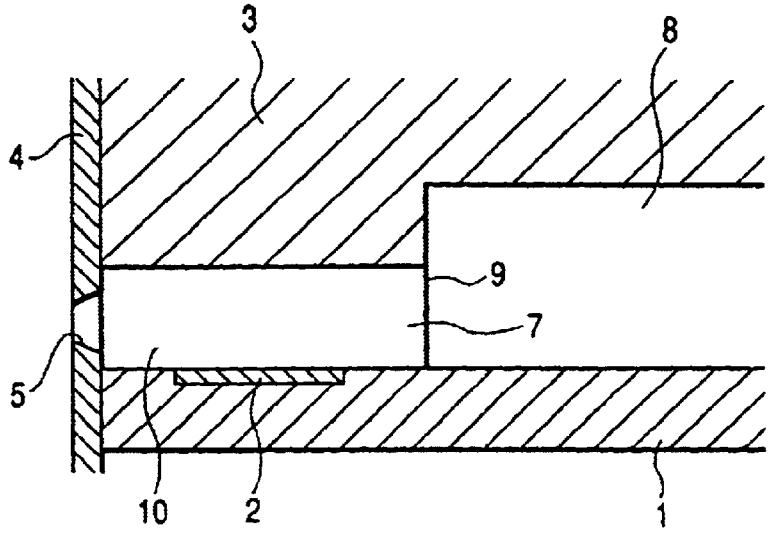
FIG. 1 PRIOR ART
FIG. 1 is a sectional view showing a liquid discharge head of one type.
Figure 2:
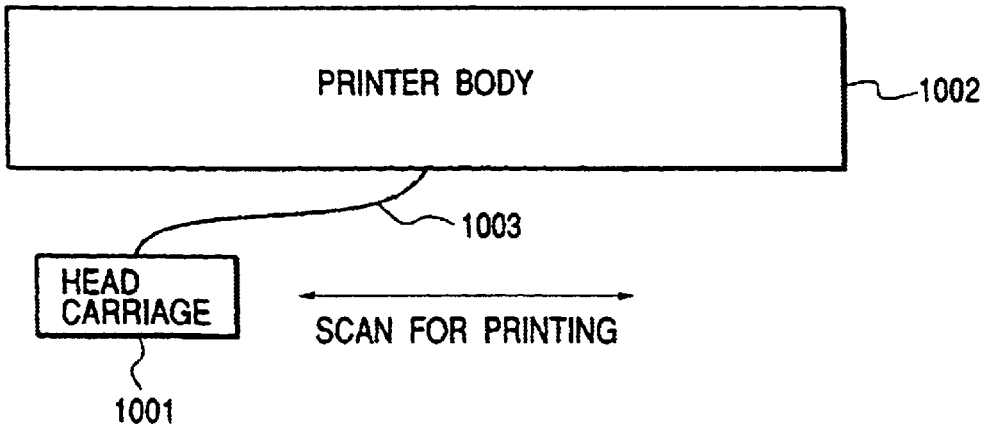
FIG. 2 PRIOR ART
FIG. 2 is a constitutional view schematically showing a bubble jet recording apparatus.

The basic structure of one type of the liquid discharge head applicable to the invention is as shown in FIG. 1. As the description related to FIG. 1 has been made, any explanation in this regard will be omitted.

Now, description will be made of the formation of a head element substrate 1, which is carried out by using a semiconductor wafer processing technology.

Figure 5:
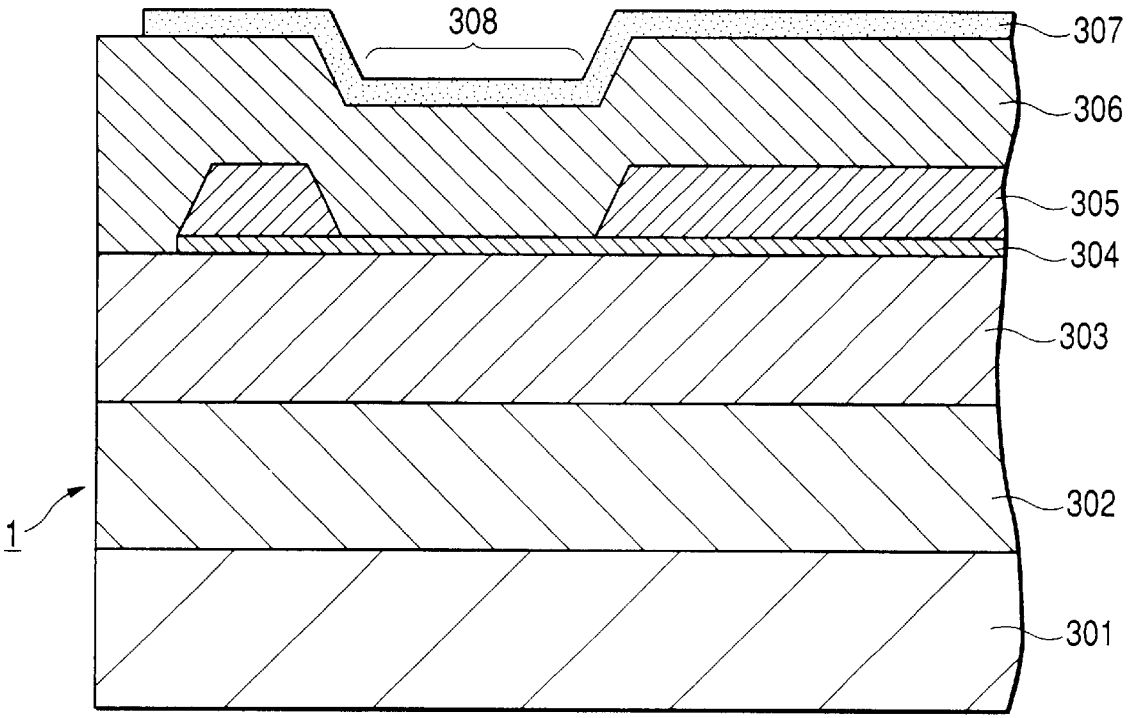
FIG. 5 is a sectional view showing main portions of an element substrate used for a liquid discharge head.

FIG. 5 is a sectional view showing main portions of an element substrate used for the liquid discharge head shown in FIG. 1. As shown in FIG. 5, in the substrate element 1 of the liquid discharge head of this type, there are laminated on the surface of a silicon substrate 301 a thermal oxide film 302 and an interlayer film 303 also serving as a heat storage layer in this order. For the interlayer film 303, an $SiO_2$ film or an $Si_3N_4$ is used. A resistance layer 304 is formed partially on the surface of the interlayer film 303, and a wiring 305 is formed partially on the surface of the resistance layer 304. For the wiring 305, an Al alloy wiring such as Al, Al—Si, or Al—Cu, is used. On the surfaces of the wiring 305, the resistance layer 304 and the interlayer film 303, a protective film 306 made of an $SiO_2$ film or an $Si_3N_4$ film is formed. In a portion of the surface of the protective film 306 corresponding to the resistance layer 304 and around the same, a cavitation resistance film 307 is formed to protect the protective film 306 from chemical and physical shocks following the heat generation of the resistance layer 304. The region of the surface of the resistance layer 304 where the wiring layer 305 is not formed is a heat applied portion 308, to which the heat of the resistance layer 304 is applied.

The films of the element substrate 1 are formed in order on the surface of the silicon substrate 301 by a semiconductor manufacturing technology, and the silicon substrate 301 is provided with the heat applied portion 308.

Figure 6:
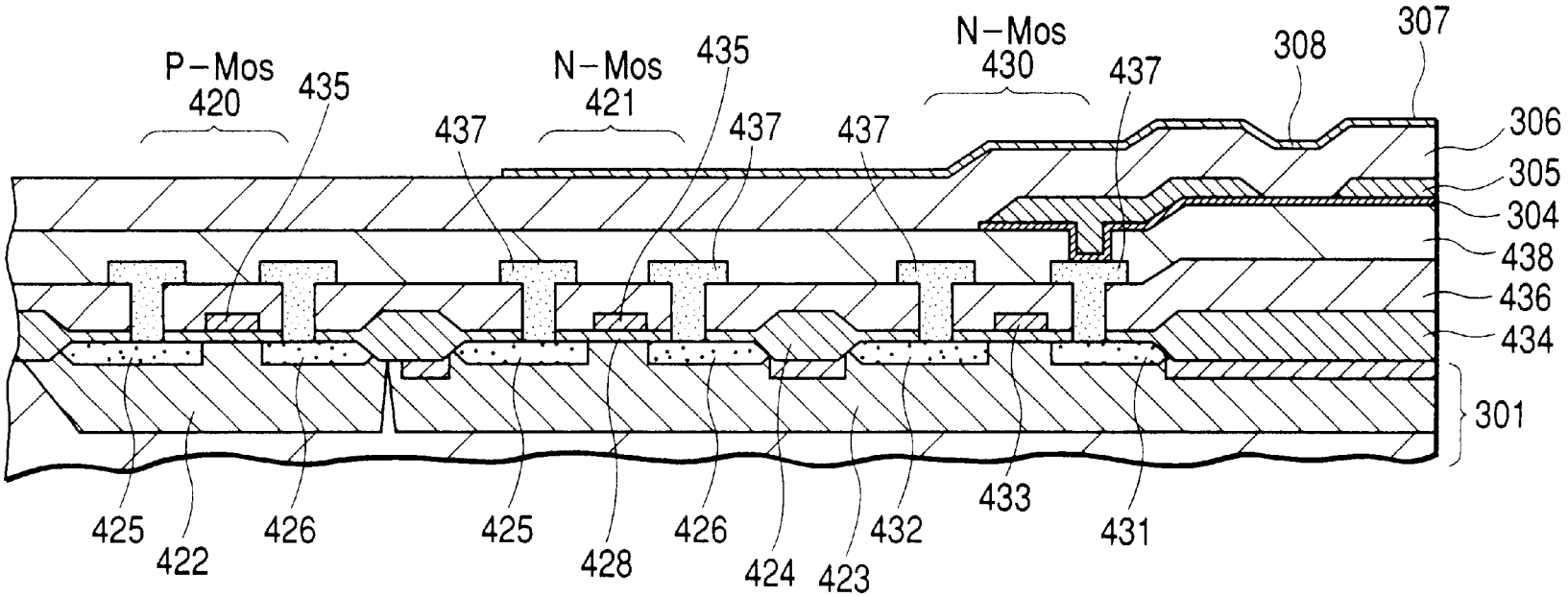
FIG. 6 is a cutout view schematically showing in section an element substrate 1, vertically cutting main elements of the element substrate 1.

FIG. 6 is a cutout view schematically showing in section the element substrate 1, vertically cutting main elements of the element substrate 1 shown in FIG. 5.

As shown in FIG. 6, on the surface layer of the silicon substrate 301 as a p-type conductor, there are partially provided an n-type well region 422 and a p-type well region 423. Then, by using a general MOS process to introduce or diffuse impurities such as ion implantation, a p-MOS 420 is provided in the n-type well region, and an n-MOS 421 is provided in the p-type well region 423. The p-MOS 420 includes source and drain regions 425 and 426 formed by partially introducing n-type or p-type impurities to the surface layer of the n-type well region 422, and a gate wiring 435 deposited on the surface of the n-type well region 422 excluding the portions of the source and drain regions 425 and 426 via a gate insulating film 428 having a thickness of several hundred Å. The n-MOS 421 includes source and drain regions 425 and 426 formed by partially introducing n-type or p-type impurities to the surface layer of the p-type well region 423, and a gate wiring 435 deposited on the surface of the p-type well region 423 excluding the portions of the source and drain regions 425 and 426 via a gate insulating film 428 having a thickness of several hundred Å. The gate wiring 435 is made of polysilicon having a thickness of 4000 to 5000 Å deposited by a CVD method. A c-MOS logic is formed from the p-MOS 420 and the n-MOS 421.

In the portion of the p-type well region 423 different from the n-MOS 421, there is provided an n-MOS transistor 430 used for driving an electric thermal conversion element. The n-MOS transistor 430 also includes source and drain regions 432 and 431 partially provided on the surface layer of the p-type well region 423 by introduction and diffusion of impurities, and a gate wiring 433 deposited on the surface of the p-type well region 423 excluding the portions of the source and drain regions 432 and 431 via a gate insulating film 428.

In the described embodiment, the n-MOS transistor 430 is used as a transistor for driving the electric thermal conversion element. Any one of transistors other than this transistor 430 can be used, as long as it is capable of individually driving a plurality of electric thermal conversion elements and providing a fine structure like that described above.

Between the respective elements, e.g., between the p-MOS 420 and the n-MOS 421, or between the n-MOS 421 and n-MOS transistor 430, there is formed an oxidation film isolating region 424 by field oxidation of a thickness of 5000 to 10000 Å. Each element is separated by the oxidation film isolating region 424. The portion of the oxidation film isolating region 424 corresponding to the heat applied portion 308 serves as a heat storage layer 434, which is a first layer when seen from the surface side of the silicon substrate 301.

On the surfaces of the elements including the p-MOS 420, the n-MOS 421 and the n-MOS transistor 430, there is formed an interlayer insulating film 436 by a CVD method, which is made of a PSG film or a BPS film having a thickness of approximately 7000 Å. After the interlayer insulating film 436 is flattened by a heat treatment, a wiring is laid by an Al electrode 437 to be used as a first wiring layer via a contact hole penetrating the interlayer insulting film 436 and the gate insulating film 428. On the surfaces of the interlayer insulating film 436 and the AL electrode 437, an interlayer insulating film 438 is formed by a CVD method, which is made of an $SiO_2$ film having a thickness of 10000 to 15000 Å. On the portions of the surface of the interlayer insulating film 438 corresponding to the heat applied portion 308 and the n-MOS transistor 430, a resistance layer 304 made of $TaN_{0.8[hex]}$ film having a thickness of approximately 1000 Å is formed by a DC sputtering method. This resistance layer 304 is electrically coupled to the Al electrode 437 in the vicinity of the drain region 431 via a through-hole formed in the interlayer insulating film 438. On the surface of the resistance layer 304, there is formed an Al wiring 305, which serves as a second wiring layer for wiring to each electric thermal conversion element.

The protective film 306 on the surfaces of the wiring 305, the resistance layer 304 and the interlayer insulating film 438 is made of an Si3N4 film having a thickness of 10000 Å formed by a plasma CVD method. The cavitation resistance film 307 formed on the surface of the protective film 306 is made of a film of Ta or the like having a thickness of approximately 2500 Å, which is formed by a sputtering method targeting Ta.

Next, description will be made of a distribution arrangement of circuits or elements to the element substrate 1 and the top board 3.

Figure 7A:
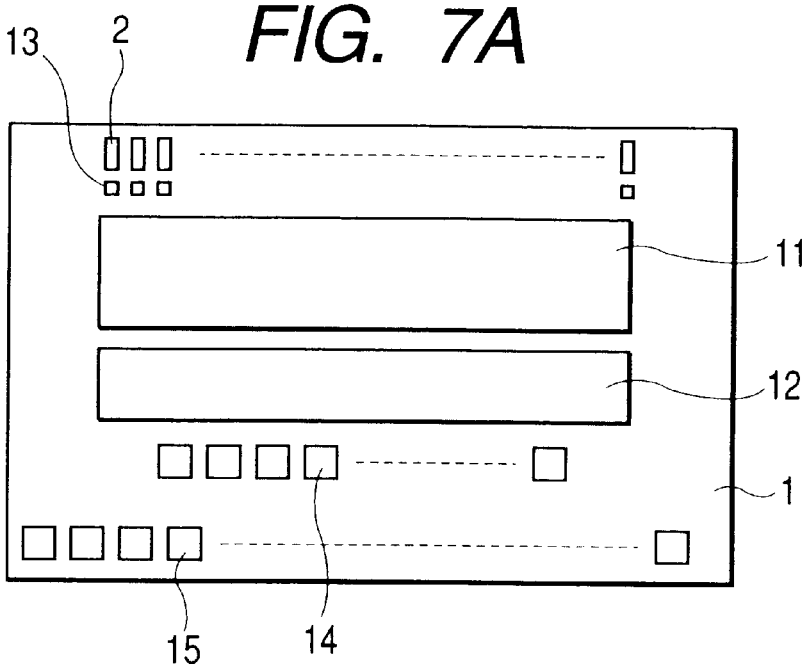
FIGS. 7A and 7B are views illustrating a circuit configuration of the liquid discharge head, respectively 7A being a plan view of the element substrate and 7B being a plan view of a top board.
Figure 7B:
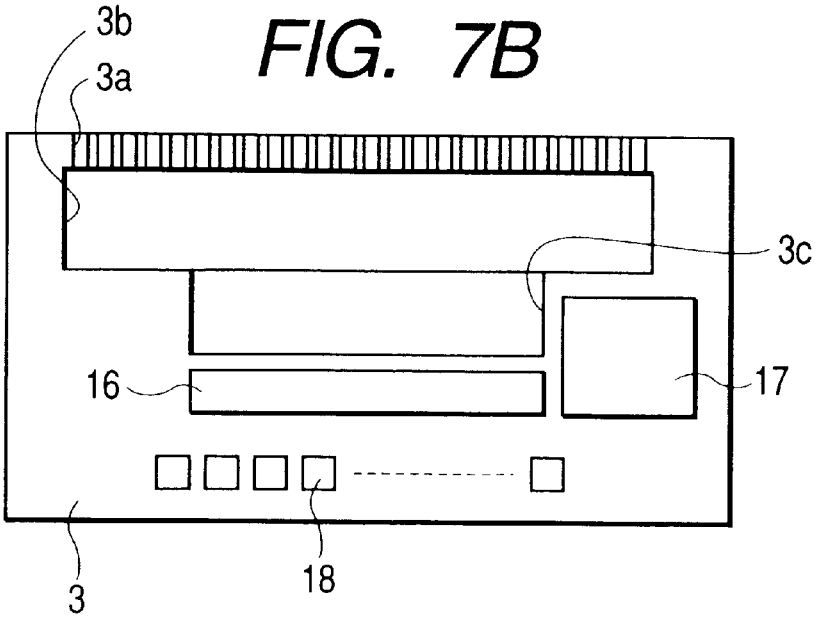

FIGS. 7A and 7B are views illustrating a circuit configuration of the liquid discharge head, specifically 7A being a plan view of the element substrate and 7B being a plan view of the top board, showing opposing surfaces respectively.

As shown in FIG. 7A, the element substrate 1 includes a plurality of heaters 2 arrayed in parallel, a driver 11 for driving the heaters 2 according to image data, an image data transfer section 12 for outputting the entered image data to the driver 11, and a sensor 13 for detecting a state of a characteristic liquid, which is necessary for controlling the driving condition of the heaters 2. In the head of the embodiment, the sensor 13 is provided for each liquid flow passage 7 corresponding to each heater 2 to detect a state or a characteristic of liquid for each liquid flow passage 7.

The image data transfer section 12 includes a shift register for outputting image data entered in series to the respective drivers 11, and a latch circuit for temporarily storing data outputted from the shift register. The image data transfer section 12 may be adapted to output image data corresponding to the individual heaters 2, or output image data corresponding to block units by dividing the array of the heaters 2 into a plurality of blocks. In particular, a higher printing speed can be easily dealt with by providing a plurality of shift registers for one head, and distributing and entering data transferred from the recording apparatus to the plurality of shift registers.

On the other hand, as shown in FIG. 7B, the top board 3 includes, in addition to grooves 3*a* and 3*b* for constituting the liquid flow passages and the common liquid chamber as described above, a sensor driving section 17 for driving the sensor 13 provided in the element substrate 1, and a heater control unit 16 for controlling the driving condition of the heaters 2 based on a detection result from the sensor driven by the sensor driving section 17. In the top board 3, a supply port 3*c* communicated with the common liquid chamber is opened to supply liquid to the common liquid chamber from the outside.

In the opposing portions of the joined surfaces of the element substrate 1 and the top board 3, there are provided connection contact pads 14 and 18 for electrically interconnecting the circuits or the like formed in the element substrate 1 and the circuits or the like formed in the top board 3. The element substrate 1 also includes an external contact pad 15 provided as an input terminal for an electric signal from the outside. The size of the element substrate 1 is larger than that of the top board 3, and the external contact pad 15 is provided in a position for exposure from the top board 3 when the element substrate 1 and the top board 3 are joined together.

When the element substrate 1 and the top board 3 respectively constructed in the foregoing manners are aligned for position and joined, the heater 2 is disposed corresponding to each liquid flow passage, and the circuits or the like formed in the element substrate 1 and the top board 3 are electrically interconnected via the connection pads 14 and 18. For this electric connection, a method of loading gold bumps on the connection pads 14 and 18 is available, but any other methods can also be used. In this way, by electrically coupling the element substrate 1 and the top board 3 with each other via the connection pads 14 and 18, the electric interconnection of the circuits can be made at the same time when the element substrate 1 and the top board 3 are coupled together. After the coupling of the element substrate 1 and the top board 3, the orifice plate 4 is secured to the tip of the liquid flow passage 7, and then the liquid discharge head is completed.

Next, description will be made of features of the invention, specifically the examples of making the capacitor as a current noise countermeasure, the nonvolatile memory, the piezoelectric element and the movable member respectively of ferroelectric materials such as PZT.

Example of Capacitor Made of Ferroelectric Material

Figure 8A:
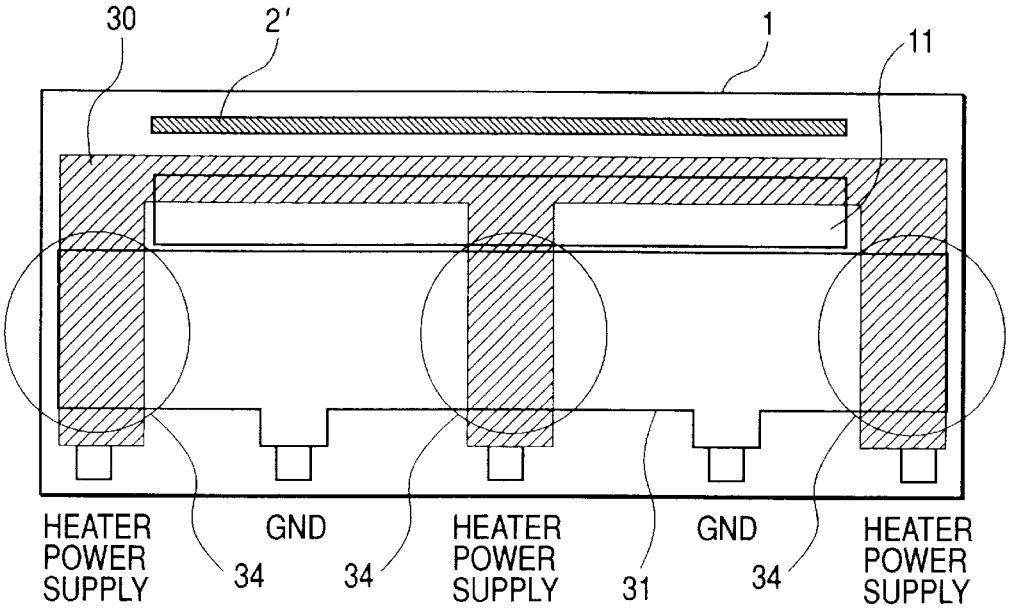
FIGS. 8A and 8B are views showing a configuration of a circuit element formed on the element substrate of a liquid discharge head according to an embodiment of the invention, respectively 8A being a layout view of each circuit element when the element substrate is seen from an upper plane, and 8B being structural views showing in section the overlapped portion of a power supply layer and a ground layer.
Figure 8B:
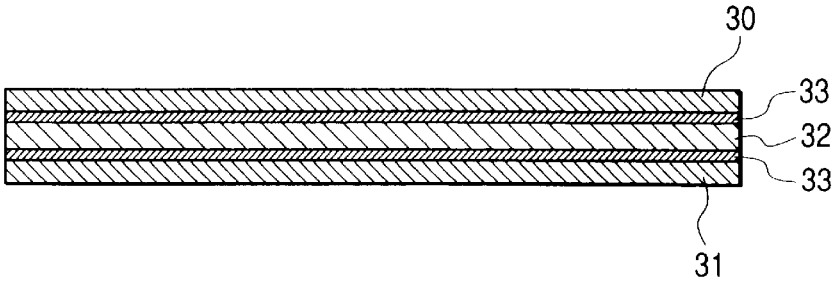

FIGS. 8A and 8B are views showing a configuration of a circuit element formed on the element substrate of a liquid discharge head according to an embodiment of the invention, respectively 8A being a layout view of each circuit element when the element substrate is seen from an upper plane, and 8B being a structural view showing in section the overlapped portion of a power supply layer and a ground layer.

As shown in FIG. 8A, the element substrate 1 includes a row of heaters 2' arraying a plurality of heater 2 (not shown), a driver 11 for driving these heaters, and a power supply layer 30 and a ground (GND) layer 31 connected to the above circuit elements.

In the overlapped portion (overlap portion 34) of the power supply layer 30 and the GND layer 31, as shown in FIG. 8B, a ferroelectric material film 32 is formed therebetween, constituting the capacitor. Barrier layers 33 are formed respectively in the boundary surfaces of the ferroelectric material film 32 with the power supply layer 30 and the GND layer 31. A reason for providing the barrier layers 33 is as follows.

The ferroelectric material is reduced when reacted with hydrogen, resulting in the conspicuous degradation of its ferroelectric characteristic. Such reduction atmosphere is easily generated during the formation of an interlayer insulating film or a protective film after the ferroelectric material film is formed. In the formation of the liquid discharge head substrate, from the standpoint of mass productivity and protection performance from ink, an SiN film is generally used for the interlayer insulating film or the protective film by using a plasma CVD method, the formation thereof is carried out in reduction atmosphere containing $SiH_4$ (silane) or $NH_3$ (ammonium). In this case, hydrogen plasma is generated and, simultaneously, hydrogen is easily contained in the film, which affect the degradation of the ferroelectric characteristic. To prevent such a situation, the barrier layers 33 are formed.

Figure 9:
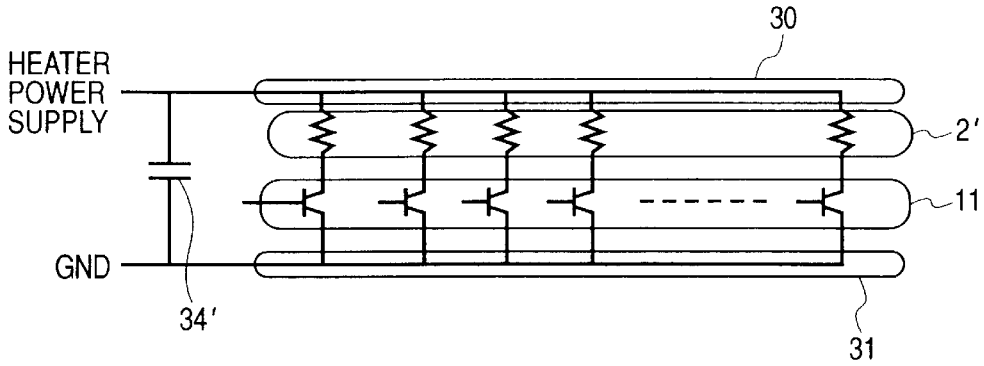
FIG. 9 is a view schematically showing an equivalent circuit of the element substrate shown in FIGS. 8A and 8B.

FIG. 9 schematically showing an equivalent circuit of the element substrate constructed in the foregoing manner. As can be understood from FIG. 9, a capacitor 34' formed in the above overlap portion 34 is inserted between a heater power supply line and a GND line. This capacitor 34 can have a large capacity in a limited space because of the use of the ferroelectric material film. With this arrangement, the capacitor 34' can be formed in a portion closer to the heater, and heater driving current noises can be eliminated satisfactorily by the capacitor 34'.

As described above, the element substrate 1 has a structure shown in FIGS. 5 and 6, and each circuit element is formed by using the semiconductor process. In this manufacturing process, the capacitor 34' can be simultaneously formed in the element substrate 1, thereby reducing costs greatly. Further, in this case, the barrier layer 33 as a protective film of the ferroelectric material film 32 for the capacitor 34' may be made of an oxide film or a nitride film including the cavitation resistance film 307 and the resistance layer 304 provided to protect the protective film 306 from chemical and physical shocks following the heat generation of the resistance layer 304 shown in FIG. 6. Accordingly, costs can be reduced more. In other words, in order to prevent the degradation of the ferroelectric characteristic, the manufacturing process of the liquid discharge head substrate can be used, thereby preventing an increase in the number of manufacturing steps and reduce costs.

Figure 30:
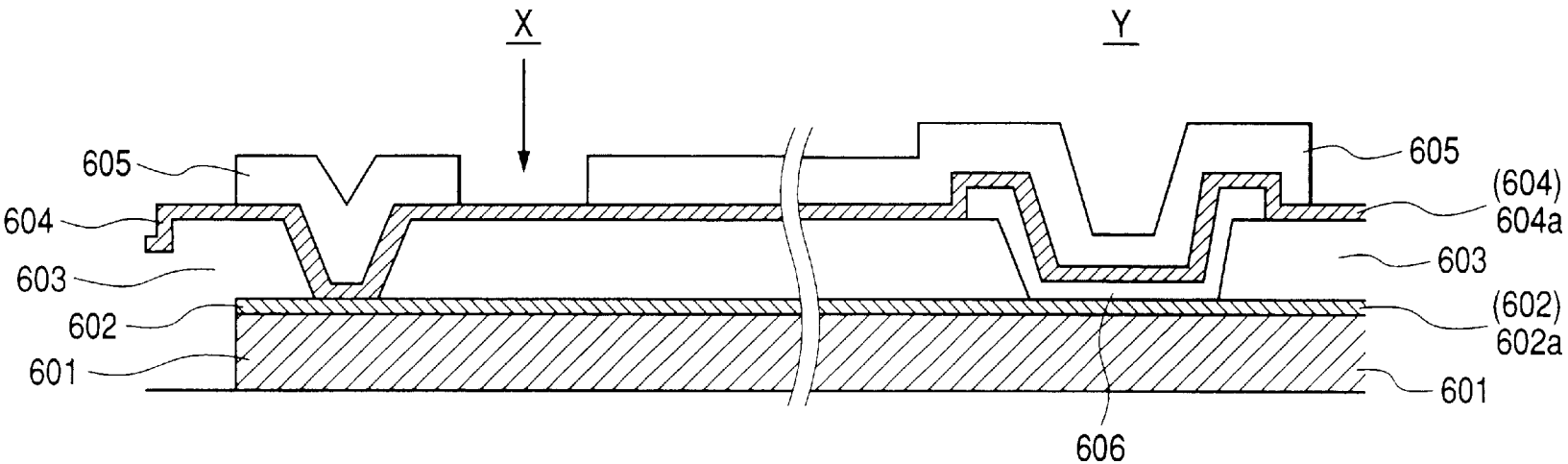
FIG. 30 is a sectional view schematically showing the layer structures of a heat applied portion X and a capacitor portion Y of the liquid discharge head of the invention.

The foregoing point is described more with reference to the drawing. FIG. 30 is a sectional view schematically showing the layer structures of a heat applied portion X and a capacitor portion Y. As shown in FIG. 30, the heat applied portion X includes, in order from the lower side, a lower wiring layer 601, a hillock prevention layer 602 for preventing the hillock of the wiring layer, an interlayer film 603, a heat resistance layer 604, and an upper wiring layer 605, which are laminated on the substrate. On the other hand, the capacitor portion Y includes, in order from the lower side, a lower wiring layer 601, a hillock prevention layer 602 formed thereon to prevent the hillock of the wiring layer in the heat applied portion, the layer 602 being formed also as a barrier layer 602*a* for providing protection to the wiring layer of the ferroelectric layer formed on the upper layer, a ferroelecric layer 606 disposed on the upper layer thereof, a heat resistance layer 604 formed thereof in the heat applied portion, the layer 604 being formed also as a barrier layer 604*a* for protecting the lower ferroelectric layer 606, and an upper wiring layer 605 formed thereof, which are laminated on the substrate. Actually, a protective film, a cavitation resistance film and other films are formed further thereon. In FIG. 30, however, these portions are omitted, because the main purpose here is to explain the simultaneous formation of the heat applied portion and the capacitor portion in the same step.

The layers corresponding to one another in the heat applied portion and the capacitor portion are simultaneously formed in the same step. Specifically, the lower wiring layer is formed for the purpose of forming the head applied portion on the substrate. The hillock prevention layer is formed thereon for the purpose of preventing the hillock of the wiring layer. Then, the interlayer film is formed, and the ferroelectric material layer is formed in a part for forming the capacitor portion. Subsequently, the heat resistance layer is formed, and the upper wiring layer is formed. At this time, for the ferroelecric material layer, the hillock prevention layer of the heat applied portion functions as a barrier layer for the lower part of the ferroelectric material layer, and the heat resistance layer functions as a barrier layer for the upper part thereof. Accordingly, the layer for constituting the heat applied portion of the recording head, especially the hillock prevention layer and the heat resistance layer can be used directly as the barrier layers for the wiring layers of the ferroelectric material layer. In this way, the barrier layers of the capacitor portion can be formed by directly using the manufacturing step of the heat applied portion.

Because of high-temperature treatment necessary for the formation of the ferroelectric film, preferably, for the material of the wiring layer, a high melting point material such as metal of Cu, Cu—Si, Pt, Ir, Ni or Au or an oxide of $IrO_2$ or $RuO_2$ should be used. In particular, in the case of film formation carried out simultaneously with the formation of a film for the heat applied portion after the semiconductor element is formed, preferably, a high melting point material should be used for the purpose of preventing the damage of the wiring layer caused by a high temperature. In addition, the existence of the barrier layers provided to prevent the reduction and thus degradation of the ferroelecric layer caused by its direct contact with the wiring layers becomes more effective, and the arrangement of the invention, i.e., the formation thereof simultaneously with the manufacturing of the heat applied portion is more preferable.

In the head structure using the heater as a driving element contributing to liquid discharging, the heat resistance layer is formed by subjecting a heater material such as TaSiN or TaN to sputtering film formation. The step of this sputtering film formation enables a barrier layer of the ferroelectric material film to be formed without any generation of hydrogen ions to bring about a reduction environment and without exposing the ferroelectric material film to a reduction atmosphere during the formation of the heat resistance layer and the cavitation resistance film. Moreover, the heat resistance layer and the cavitation resistance layer have sufficient durability as recording head characteristics. Thus, the use of such films for the barrier layer of the ferroelectric material film is preferable because of stable composition and durability.

The formation of the barrier layer carried out simultaneously with the formation of the heat resistance layer and the cavitation resistance film enables the number of manufacturing steps to be reduced more than the separate formation of the individual films, and the same manufacturing device to be used. Accordingly, it is possible to lower costs of the manufacturing device by sharing the same device. In other words, it is possible to form the barrier layer of the ferroelectric material film by the same method as that for the formation of the heat resistance layer and the cavitation resistance film, and utilize the heat resistance layer and the cavitation resistance film directly as the barrier layers.

Consideration is now given to the shared use of the manufacturing device, for example, if a heat resistor is formed by sputtering TaSiN, a TaSi target is subjected to sputtering in N atmosphere, but a highly stable Si target may be prepared and subjected to sputtering in N atmosphere by using the same device, and an Si film (film containing no hydrogen generated in the film forming step) thereby formed can be used for the barrier layer of the ferroelectric material film. In addition, by using the sputtering device for heater layer formation, a target made of metal such as Ti may be prepared and subjected to sputtering in N atmosphere, and a TiN film thereby formed can be used as the barrier layer of the ferroelectric material film. A stable film can be formed by reacting various metals with nitrogen and oxygen. In this way, it is possible to form an effective barrier layer by using the film forming device of the ink-jet recording head and replacing only the target. It is also possible to form a stable film without any exposure to a reduction environment of hydrogen ions or the like.

In addition to the formation of the heater layer, the barrier layer may also be formed by using, for example, a material of Ta or the like used for the cavitation resistance layer directly, using the film forming device of the cavitation resistance film and then performing sputtering in N atmosphere. The film forming method is sputtering, which has no hydrogen ions generated unlike the case of the CDV, and forms a barrier layer by reacting the same stable material as that for the cavitation resistance material film with nitrogen and oxygen without any exposure to the environment of reducing the ferroelectric material film. Thus, a stable barrier can be formed. Since the target of the sputtering device is the same as that for the cavitation resistance layer and the barrier layer can be formed by using the same device and in the same step, it is possible to provide high mass productivity, and simplify the manufacturing process.

Sputtering is also performed for a film formed to prevent a hillock phenomenon caused by heat generated in an aluminum wiring layer of TiW or TaN used for the upper layer of the wiring layer disposed in the lower part of the heater layer. Alternatively, sputtering may be performed in nitrogen and oxygen atmosphere to form a barrier layer for the ferroelectric material film. The film forming method is sputtering, which has no hydrogen ions generated unlike the case of the CVD, and forms a barrier layer by reacting the same stable material as that of the hillock prevention film with nitrogen or oxygen without any exposure to the environment of reducing the ferrorlectric material film. Thus, a stable barrier layer can be formed. Since the target of the sputtering device is the same as that for the hillock prevention layer and the barrier layer can be formed by using the same device and in the same step, it is possible to provide high mass productivity and simplify the manufacturing process.

In the case of a recording head constructed in a manner that a metal film of Ti or the like is formed as an adhesive layer, which is provided if a heater layer is made of $HfB_2$ or the like, and adhesion between the heater layer and its protective film of SiN or SiO is not relatively good, a barrier layer can be formed by sputtering the metal film of Ti or the like constituting the adhesive layer in oxygen atmosphere for the ferroelectric material film. The film forming method is sputtering, which has no hydrogen ions generated unlike the case of the CVD, and forms a barrier layer by reacting the same stable material as that for the adhesive layer with nitrogen or oxygen without any exposure to the environment of reducing the ferroelectric material film. Thus, a stable barrier film can be formed. Since the target of the sputtering device is the same as that for the adhesive layer and the barrier layer can be formed by using the same device and in the same step, it is possible to provide high mass productivity, and simplify the manufacturing process.

For the first and second barrier layers, preferably, the rates of oxygen and nitrogen should be set high in portions closer to the ferroelectric material film in the film thickness directions of the oxide and nitride films including the heat resistance layer and the cavitation resistance film. Moreover, the rates of oxygen and nitrogen may be changed continuously or intermittently in the film thickness directions of the barrier layers.

If the power source layer for heater connection and the power supply layer for logic circuit connection are separated formed, preferably, a capacitor having the same structure as that of the capacitor 34' should also be provided between the power source line and the GND line of the logic circuit.

In the embodiment, the capacitor 34' is directly formed in the element substrate 1. However, if the capacitor 34' is formed in the top board 3 side having more installation space, then the degree of freedom for designing can be increased. In this case, because of the connection structure via the contact pads, the capacitor formed in the top board 3 side must be connected between the power source line and the GND line of the heater or the logic circuit formed in the element substrate 1 side.

Example of Nonvolatile Memory Made of Ferroelectric Material

Figure 10:
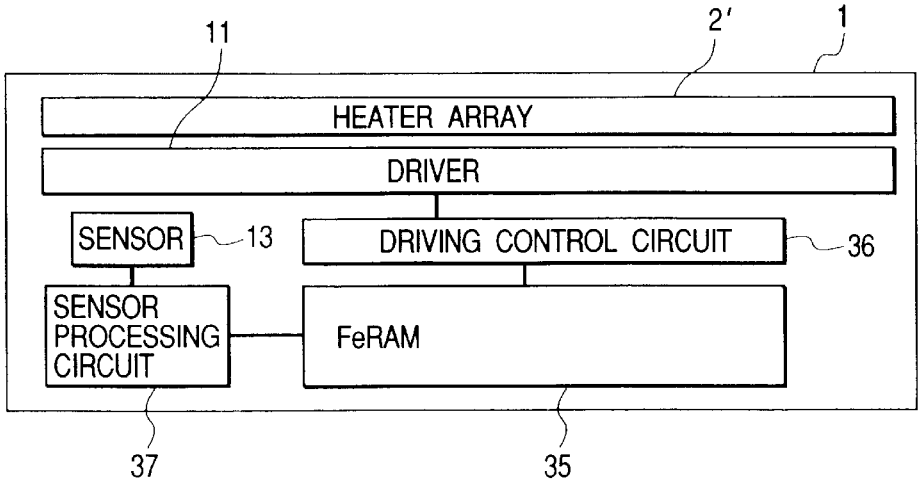
FIG. 10 is a view showing a configuration of a circuit element formed on the element substrate of a liquid discharge head according to another embodiment of the invention.

FIG. 10 is a view showing a configuration of a circuit element formed on the element substrate of a liquid discharge head according to another embodiment of the invention.

The element substrate 1 includes a heater row 2'arraying heaters 2, a driver 11 for driving the heaters 2, a sensor 13 for detecting a state or a characteristic of liquid necessary for controlling the driving condition of the heaters 2, a driving control circuit 36 for monitoring the output of the sensor 13 and controlling energy applied to each heater according to a detection result, an FeRAM 35 for storing a code value ranked according the detection result of the sensor 13 and a pre-measured liquid discharge quantity characteristic of each heater 2 (liquid discharge quantity at a fixed temperature and by the application of a specified pulse) as head information and then outputting the head information to the driving control circuit 36, and a sensor processing section 37 for driving the sensor 13 and storing a detection result as an output thereof in the FeRAM 35.

The driving control circuit 36 includes a pulse generator, a buffer, and so on. For the sensor 13, a sensor for detecting, a state or a characteristic of liquid, a change in the temperature of the liquid, a pressure thereof, a component contained therein or an index of hydrogen ion concentration (PH) therein is used.

Figure 11A:
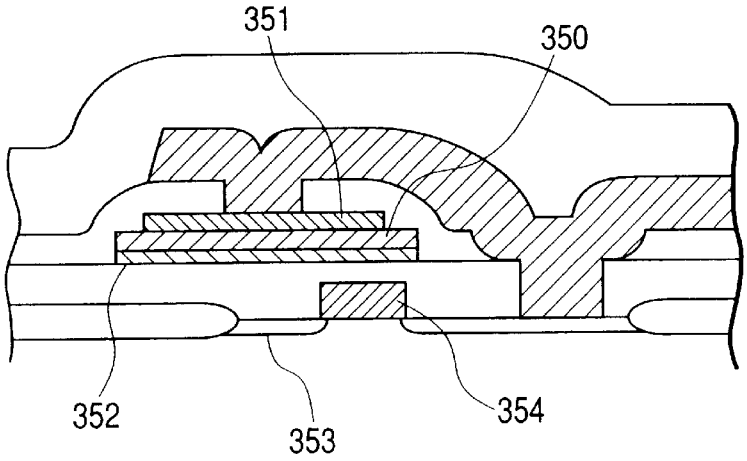
FIGS. 11A, 11B and 11C are views, each showing a cell structure of a ferroelectric memory.
Figure 11B:
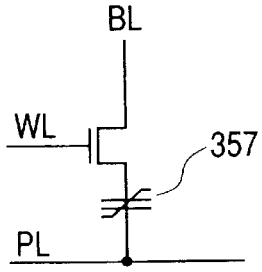
Figure 11C:
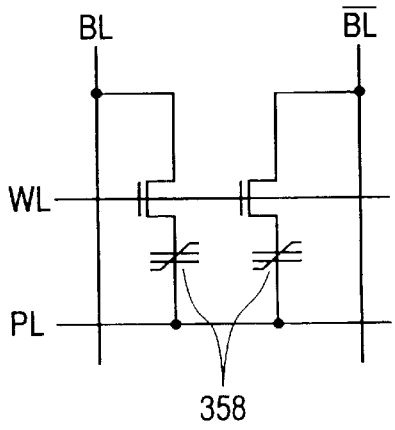

The FeRAM 35 is a ferroelectric memory composed of a function element having a structure shown in FIG. 4. Each of FIGS. 11A to 11C shows, as an example of the ferroelectric memory, the cell structure of a ferroelectric memory disclosed in "Development of ferroelectric memory made of $Pb(Zr, Ti)O_3$ film" Vol. 67, No. 11, by T. Nakamura, 1998.

As shown in FIG. 11A, the cell structure of this ferroelectric memory is made in a manner that a ferroelectric capacitor including a plate line (lower electrode) 352, a ferroelectric 350 and an upper electrode 351 laminated in sequence is formed on the semiconductor substrate together with a bit line 353 and word line 354. By using this cell structure, an 1T1C type cell shown in FIG. 11B and a 2T2C type cell shown in FIG. 11C can be formed. Each of reference numerals 357 and 358 denotes an ferroelecric.

In the joined surfaces of the element substrate 1 and the top board 3 formed in the foregoing manner, circuits or the like formed in the respective substrates are interconnected via a connection contact pad. A liquid discharge head is completed by aligning the element substrate 1 and the top board in position and then coupling these elements.

In the liquid discharge head thus constructed, first, a state of liquid is detected by the sensor 13 for each liquid flow passage, and its result is stored in the FeRAM 35. The driving control circuit 36 then decides a preheating pulse width of each heater 2 according to data stored in the FeRAM 35, and also a driving pulse of each heater 2 according to an entered image data signal. When the preheating pulse decided by the driving control circuit 36 and a predetermined heating pulse are applied to the heater 2, the heater 2 is subjected to preheating, and then receives energy applied to form bubbles in the liquid. In this way, by controlling the preheating width according to the detection result of the sensor, it is possible to keep the discharge quantity of liquid constant at each discharge port irrespective of the state of liquid.

The head information stored in the FeRAM 35 may include the kind of liquid to be discharged (in the case of ink liquid, ink color or the like may be included), in addition to the above liquid state. This is because a physical characteristic varies, and a discharge characteristic is different depending on the kind of liquid). If a plurality of sensors 13 are provided (e.g., provided by each nozzle unit), to compensate for a solid difference among the characteristics of the respective sensors, the characteristic of each sensor may be prestored as head information in the FeRAM 35, and then a driving condition may be controlled by using the information at the time of driving. The storage of such head information in the FeRAM 35 may be performed in a nonvolatile manner after the liquid discharge head is assembled, or by the transfer of the information from the apparatus side after the liquid discharge apparatus having the liquid discharge head loaded thereon is started.

Figure 12A:
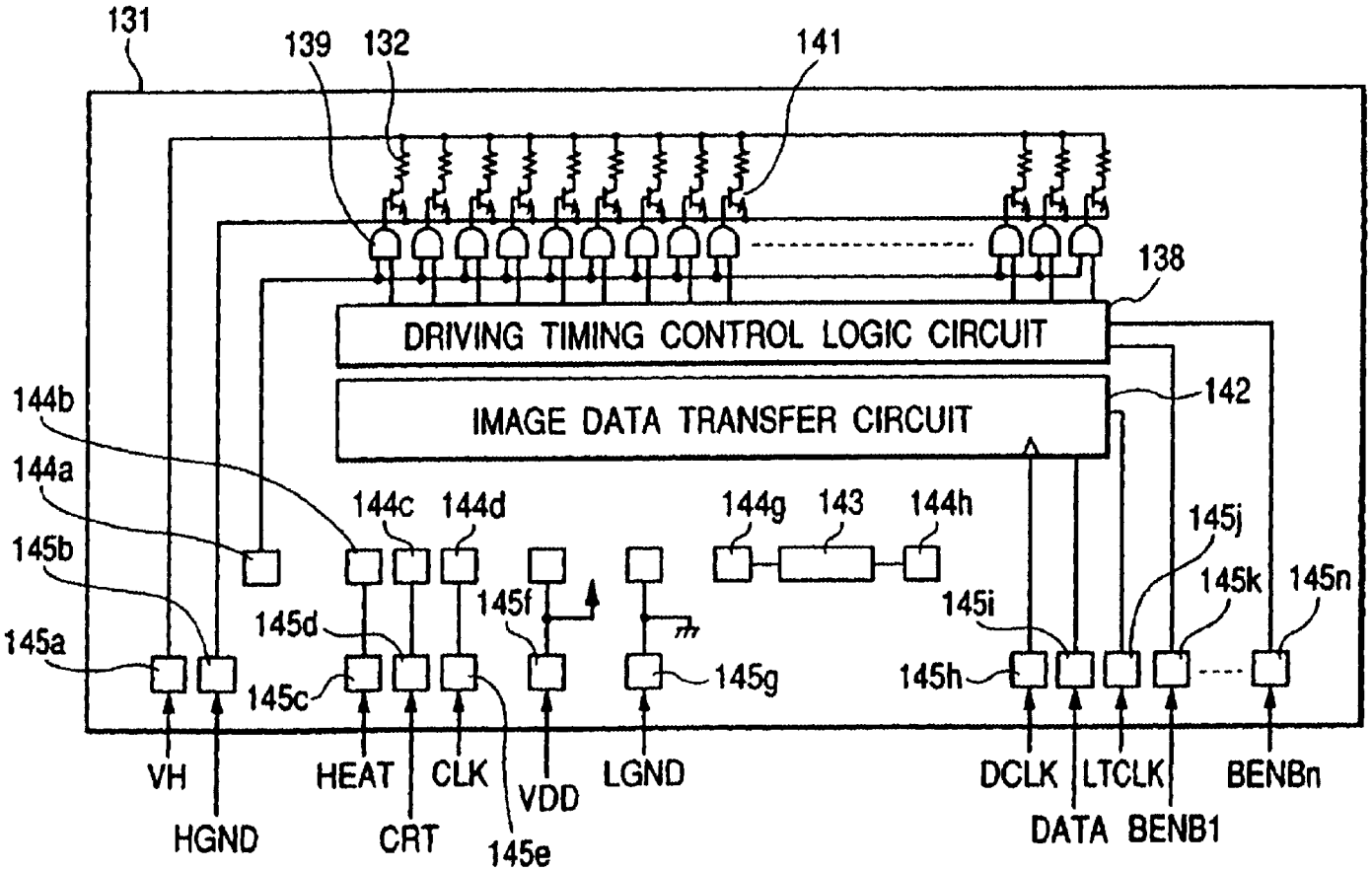
FIGS. 12A and 12B are views, each showing a structural example of a liquid discharge head having an FeRAM formed in its top board side.
Figure 12B:
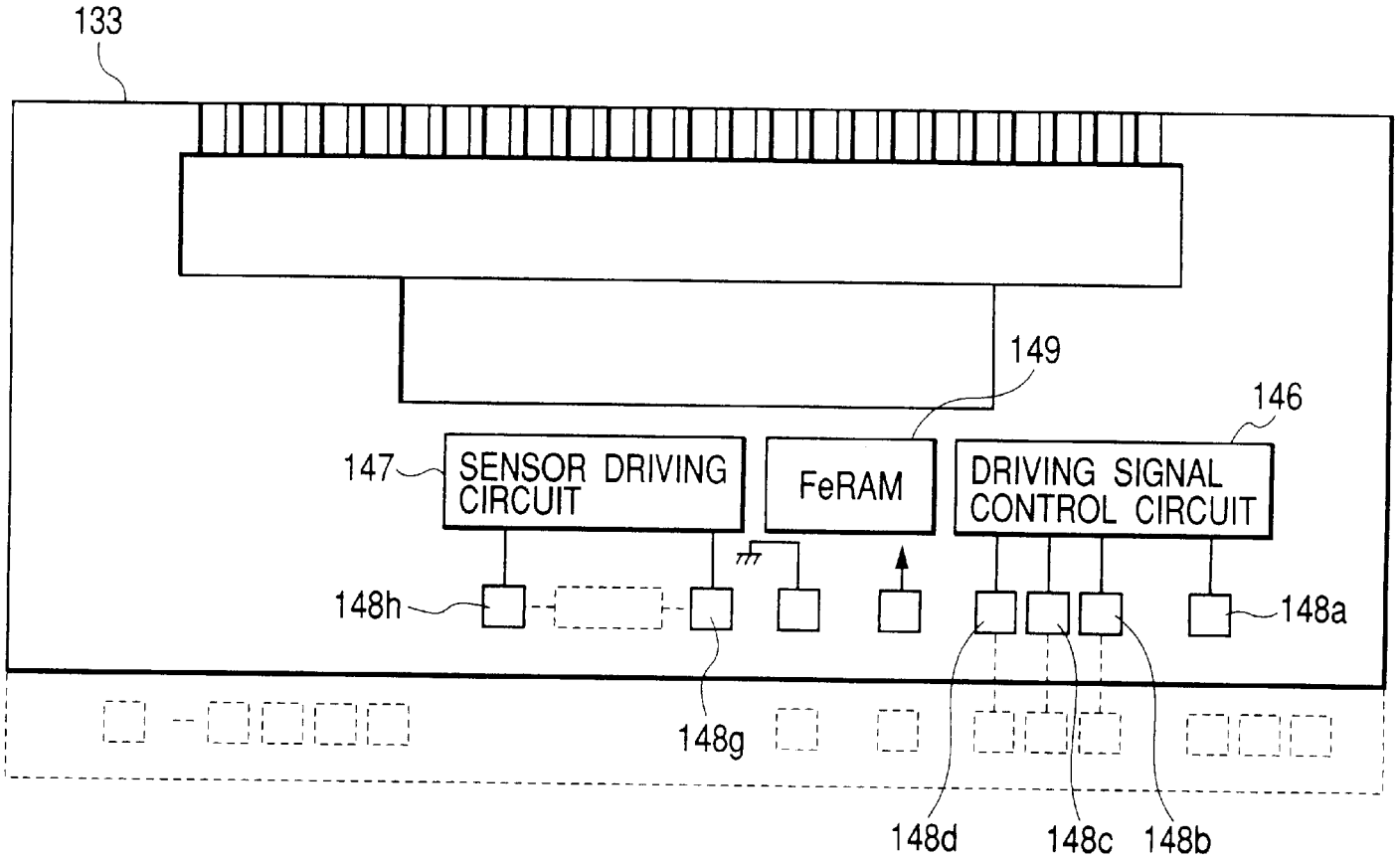

In the described embodiment, the FeRAM 35 is formed in the element substrate 1. But it may be formed in the top board side having more space. FIGS. 12A and 12B are views, each showing a structural example of a liquid discharge head having an FeRAM formed in its top board side.

In the example shown in each of FIGS. 12A and 12B, a heater 132 is preheated (preparatory heating not forming bubbles in liquid) before bubble forming energy is applied to the heater 132. The preheating pulse width for the heater 132 is controlled according to the detection result of a sensor (not shown in FIGS. 12A and 12B) for detecting the temperature of the liquid.

As can be understood from a sectional structure shown in FIG. 12A, an element substrate 131 includes heaters 132 arrayed in a row, a power transistor 141 serving as a driver, an AND circuit 139 for controlling the driving of the power transistor 141, a driving timing control logic circuit 138 for controlling the driving timing of the power transistor 141, an image data transfer circuit 142 composed of a shift register and a latch circuit, and a sensor for detecting the temperature of liquid, which are all formed by using the semiconductor process. The sensor is provided for each liquid flow passage, in other words for each heater 132.

The driving timing control logic circuit 138 is designed, for the purpose of reducing a power supply capacity of an apparatus, not to energize all the heaters 132 simultaneously but to energize the heaters 132 by shifting these in time based on divided driving. An enable signal for driving the driving timing control logic circuit 138 is entered from each of enable signal input terminals 145k to 145n as external contact pads.

As the external contact pads provided in the element substrate 131, in addition to the enable signal input terminals 145*k* to 145*n*, there are available an input terminal 145*a* as a driving power supply for the heater 132, a grounding terminal 145*b* for the power transistor 141, input terminals 145*c* to 145*e* for signals necessary for controlling energy used to drive the heaters 132, a driving power supply terminal 145*f* for the logic circuit, a grounding terminal 145*g*, an input terminal 145*i* for serial data entered to the shift register of the image data transfer circuit 142, an input terminal 145*h* for a serial clock signal synchronized therewith, and an input terminal for a latch clock signal entered to the latch circuit.

On the other hand, as shown in FIG. 12B, the top board 133 includes a driving signal control circuit 146 for deciding a driving timing of the heater 132, monitoring an output from the sensor 143 and deciding a preheating width of the heater 132 according to the result thereof, and an FeRAM 149 for storing selection data for selecting a preheating width corresponding to each heater as head information and outputting the information to the driving signal control circuit 146. The FeRAM 149 has a structure similar to that of the FeRAM described above with reference to FIG. 10.

As connection contact pads, in the element substrate 131 and the top board 132, there are provided an input terminal 145*c* for a signal necessary for controlling energy used to driving the heater 132 from the outside, terminals 144*b* to 144*d* and 148*b* to 148*d* for connecting the input terminal 145e with the driving signal control circuit 146, a terminal 148*a* for entering the output of the driving signal control circuit 146 to one input terminal of the AND circuit 139.

With foregoing arrangement, first, the temperature of liquid is detected by the sensor for each liquid flow passage, and the detection result is stored in the FeRAM 149. In the driving signal control circuit 146, a preheating pulse width of each heater 132 is decided according to temperature data and selection data stored in the FeRAM 149, and this is then outputted through the terminals 148*a* and 144*a* to the AND circuit 139. On the other hand, image data signals entered in series are stored in the shift register of the image data transfer circuit 142, latched in the latch circuit by a latch signal, and then outputted through the driving timing control circuit 138 to the AND circuit.

Upon the entry of the image data signals to the AND circuit 139, a preheating pulse decided by the driving signal control circuit 146 and a predetermined heating pulse are applied to the heater 132. Then, the heater 132 is subjected to preheating, and then energy for forming bubbles in the liquid is applied thereto. In this way, by controlling the preheating width according to the detection result of the sensor, it is possible to keep the discharge quantity of liquid constant at each discharge port.

The liquid discharge head described above with reference to FIGS. 12A and 12B further includes rank heaters 143 formed as resistance value sensors on the element substrate 131 as in the case of the heaters 132, and a sensor driving circuit 147 formed in the top board 133 for driving the rank heaters 143. Terminals 144*g*, 144*h*, 148*g* and 148*h* are formed in the element substrate 131 and the top board 133 to connect the sensor driving circuit 147 with the rank heaters 143. These are provided for deciding a width of a pulse applied to the heater 132 based on a resistance value detected by each rank heater 143, and the driving signal control circuit 146 monitors an output from the rank heater 143, and controls energy applied to the heater 132 according to the result thereof. The FeRAM 149 stores resistance value data detected by the rank heater 143, or a code value ranked from the resistance value and a pre-measured liquid discharge quantity characteristic of each heater 132 (liquid discharge quantity when specified pulse is applied at a fixed temperature) as head information, and then outputs the information to the driving signal control circuit 146.

Description will now be made of control of energy applied to the heater 132 using the rank heater 143. First, a resistance value of the rank heater 143 is detected, and its result is stored in the FeRAM 149. Since the rank heater 143 is formed in the same manner as that for the heater 132, its resistance value is substantially similar to that of the heater 132. Thus, the resistance value of the rank heater 143 is assumed as a resistance value of the heater 132. In the driving signal control circuit 146, rising data and falling data of a driving pulse for the heater 132 are decided according to resistance value data and the liquid discharge quantity characteristic stored in the FeRAM 149, and outputted through the terminals 148*a* and 144*a* to the AND circuit 139. In this way, a width of a heating pulse is decided, and image data is outputted from the image data transfer circuit 142 through the driving timing control circuit 138 to the AND circuit 139. Accordingly, electricity is conducted to the heater 132 based on the pulse width decided by the driving signal control circuit 146. As a result, substantially constant energy is applied to the heater 132.

Example of Pressure Sensor Made of Ferroelectric Material

Figure 3:
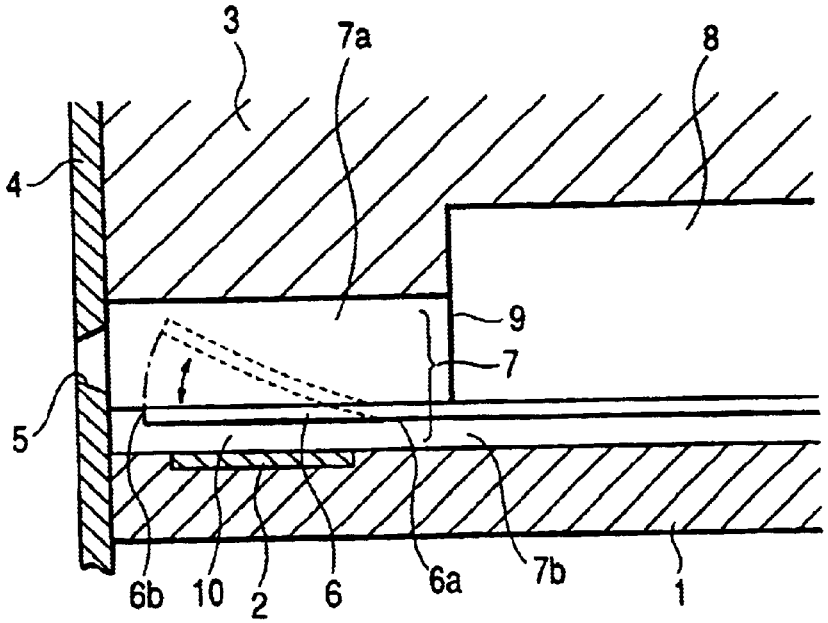
FIG. 3 PRIOR ART
FIG. 3 is a sectional view showing a liquid discharge head of another type.

The inventors present the liquid discharge head having a movable member provided in the liquid flow passage to guide the pressure propagation direction of bubbles to the downstream side as shown in FIG. 3. In this section, an example of a liquid discharge head having a pressure sensor made of a ferroelectric material in the movable member is described.

Figure 13:
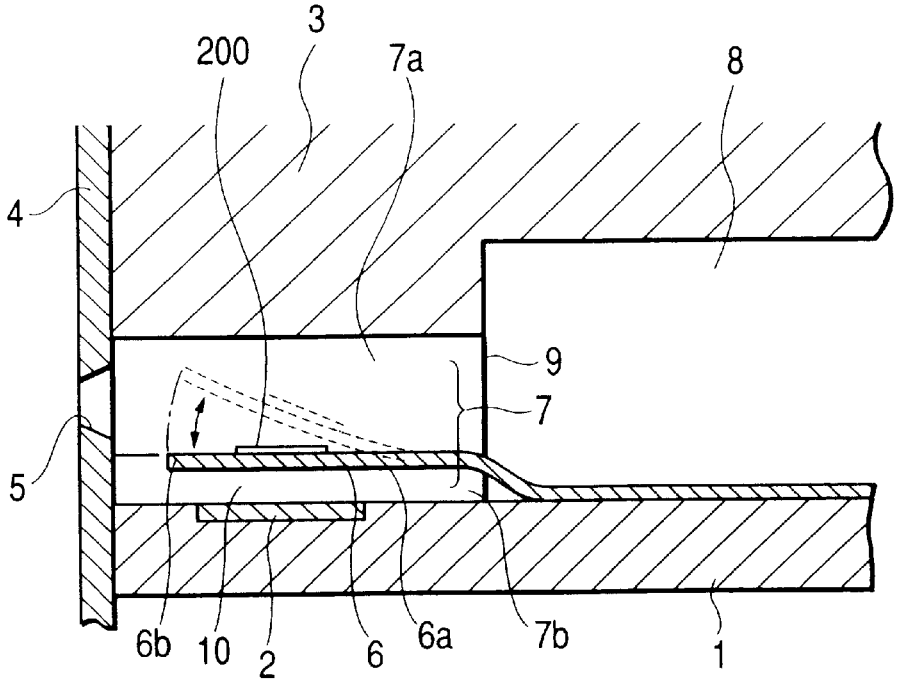
FIG. 13 is a sectional view of a liquid discharge head along a liquid flow passage direction according to yet another embodiment of the invention.

FIG. 13 is a cross-sectional view of the liquid discharge head as an embodiment of the present invention taken along the liquid flow passage direction. In the diagram, the same constituting elements as those mentioned above in FIG. 1 (FIG. 3) are designated by the same reference numerals.

The liquid discharge head according to the present embodiment has a structure in which the movable member 6 for introducing the pressure propagating direction of the bubble generated by the heater 2 to the downstream side is provided for the foregoing liquid discharge head shown in FIG. 1. The movable member 6 (having the fundamental construction that is equivalent to that in FIG. 3) comprises a cantilever-shaped thin film which is arranged so as to face the heater 2 so that the liquid flow passage 7 is divided into the first liquid flow passage 7*a* communicating with the discharge port 5 and the second liquid flow passage 7*b* having the heater 3. The movable member 6 is made by a silicon-based material such as silicon nitride or silicon oxide. The movable member 6 has the supporting point 6*a* on the upstream side of the large stream of the liquid which flows from the common liquid chamber 8 to the discharge port 5 via the movable member 6 by the liquid discharging operation. The member 6 is arranged on a position on which it faces the heater 2 at a predetermined distance from the heater 2 so as to have the free end 6*b* on the downstream side for the supporting point 6*a* and so as to cover the heater 2. The space between the heater 2 and the movable member 6 becomes the bubble generation region 10.

On the basis of the above construction, when the heater 2 is allowed to generate heat, the heat acts on the liquid in the bubble generation region 10 between the movable member 6 and the heater 2, so that a bubble based on the film boiling phenomenon on the heater 2 is generated and grown. A pressure accompanied with the growth of the bubble preferentially acts on the movable member 6. Consequently, the movable member 6 displaces so as to be largely opened to the discharge port 5 side by setting the supporting point 6*a* as a center as shown by a broken line in FIG. 13. Due to the displacement of the movable member 6 or the displacing state, the pressure propagation based on the generation of the bubble or growth of the bubble itself is introduced to the discharge port 5 side, so that the liquid is discharged from the discharge port 5.

In other words, the movable member 6 having the supporting point 6*a* on the upstream side (common liquid chamber 8 side) of the stream of the liquid in the liquid flow passage 7 and the free end 6*b* on the downstream side (discharge port 5 side) is provided on the bubble generation region 10 to introduce the pressure propagating direction of the bubble to the downstream side, so that the pressure of the bubble directly and efficiently contributes to the discharge. The growing direction of the bubble itself is introduced to the downstream direction in a manner similar to the pressure propagating direction, so that the bubble is grown larger in the downstream side as compared with in the upstream side. As mentioned above, the bubble growing direction itself of the bubble is controlled by the movable member to control the pressure propagating direction of the bubble, so that fundamental discharge characteristics such as discharge efficiency, discharging force, and discharging speed can be improved.

On the other hand, when the bubble is set to a defoaming process, the bubble is rapidly defoamed due to the synergy effect with the elastic properties of the movable member 6 and the movable member 6 is finally returned to the initial position shown by a solid line in FIG. 13. At that time, in order to supplement the shrunk volume of the bubble in the bubble generation region 10 and to supplement as much as the volume of the discharged liquid, the liquid flows from the upstream side, namely, the common liquid chamber 8 side to fill (refill) the liquid flow passage 7 with the liquid. The refill of the liquid is efficiently, rationally, and stably performed in association with the returning operation of the movable member 6.

A pressure sensor element 200 for detecting the pressure of the bubble when the liquid is bubbled by the displacement of the movable member 6 is provided for the movable member 6. The pressure sensor element 200 is a pressure sensor comprising a ferroelectric material similar to the construction shown in FIG. 4 mentioned above. Polarized charges are changed in response to the distortion of the movable member 6 and the change amount is detected as a change in pressure to be applied to the liquid by the pressure sensor element 200. The detection result by the pressure sensor element 200 is fed back to the above-mentioned heater control unit shown in FIGS. 7A and 7B and driving control circuit shown in FIGS. 12A and 12B to control the heater, so that the discharge control can be stably performed.

The movable member 6 having the pressure sensor, which is provided so as to face the bubble generation region 10, will now be described with reference to FIGS. 14A and 14B and 15.

Figure 14A:
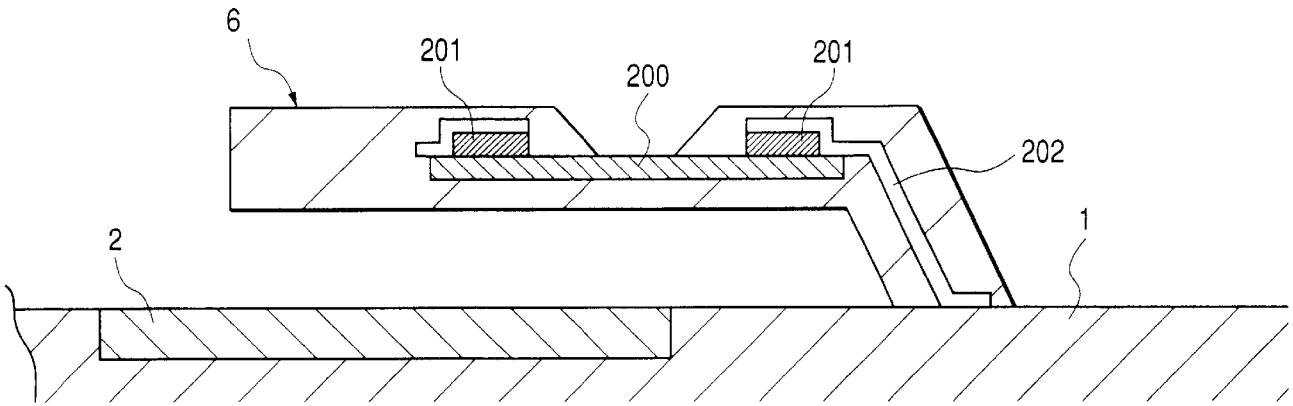
FIGS. 14A and 14B are representative sectional views showing a nozzle equipped with a movable member having a pressure sensor according to the embodiment of the invention, respectively 14A showing a state of the movable member before displacement, and 14B showing a displacement state of the movable member following bubbles.

FIG. 14A is a cross-sectional view of a nozzle having the movable member 6 including the pressure sensor, which is sectioned so as to be perpendicular to the element substrate 1 taken along the flow passage direction. FIG. 14B shows the situation of the movable member 6 which displaces in association with the bubble generated in the liquid by the heater 2 in FIG. 14A. FIG. 15 is a cross-sectional view of electric wires for the pressure sensor of the movable member 6, which are arranged in each liquid flow passage, taken along the direction parallel with the element substrate 1.

Figure 14B:
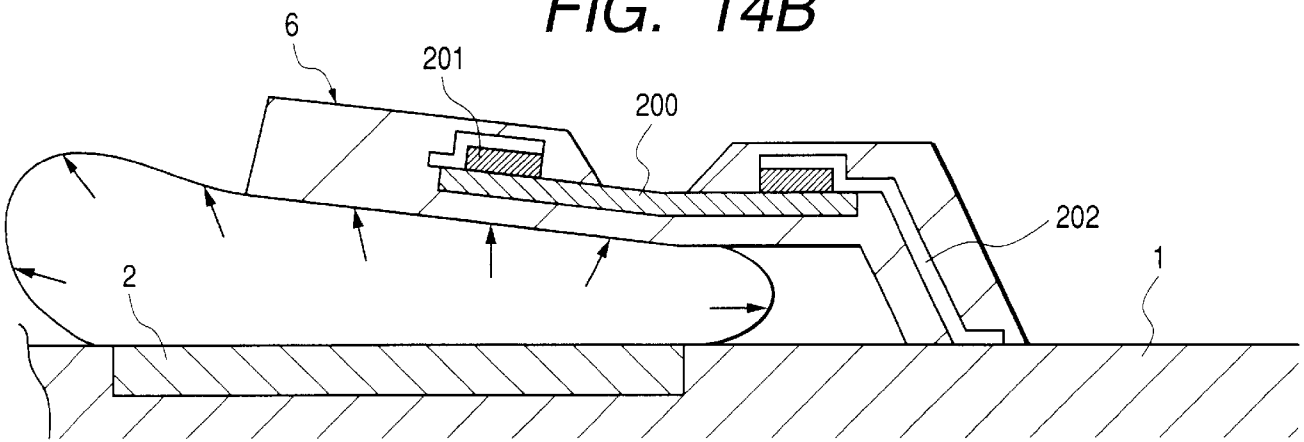
Figure 15:
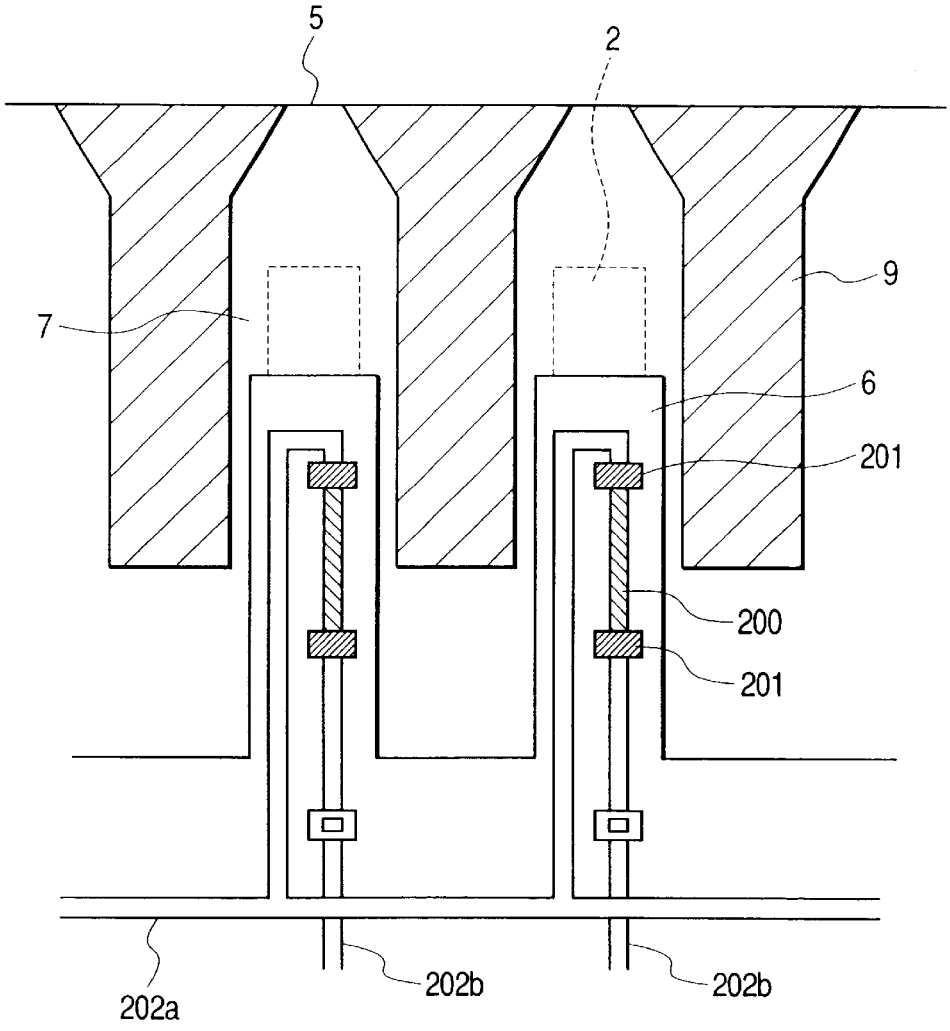
FIG. 15 is a sectional view showing an electric wiring for a pressure sensor of the movable member disposed in each liquid flow passage, which is cut out in a direction parallel to the element substrate.

As shown in FIGS. 14A and 14B, the pressure sensor element 200 in which electrodes 201 each coupling to each lead wire 202 are formed on both the ends is formed in the movable member 6. According to the present embodiment, one part of the movable member, which is located above the pressure sensor element 200, is eliminated as shown in FIG. 4 so that the sensor element is efficiently bent. As shown in FIG. 15, one of the electrodes 201 formed on both the ends of the pressure sensor element 200 in the movable member 6 in each liquid flow passage is connected to a common wire 202*a* together with one of the electrodes of another pressure sensor elements and the other electrode is coupled to a segment wire 202*b* which is individually provided for each movable member.

The method of manufacturing the movable member 6 having the pressure sensor with the photolithography process will now be described.

FIGS. 16A to 16D and FIGS. 17A to 17D are diagrams for explaining one example of the method of manufacturing the liquid discharge head including the movable member shown in FIGS. 13 and 14A and 14B. FIGS. 16A to 16D and 17A to 17D show cross-sections taken along the flow passage direction of the liquid flow passage 7 shown in FIGS. 13 and 14A and 14B. In the manufacturing method described on the basis of FIGS. 16A to 16D and 17A to 17D, the element substrate 1 in which the movable member 6 is formed is joined to the top board in which the flow passage side wall is formed, thereby forming the liquid discharge head with the construction shown in FIG. 13. According to the manufacturing method, therefore, prior to the join of the top board to the element substrate 1 in which the movable member 6 is formed, the liquid flow passage side wall is formed in the top board.

Figure 16A:
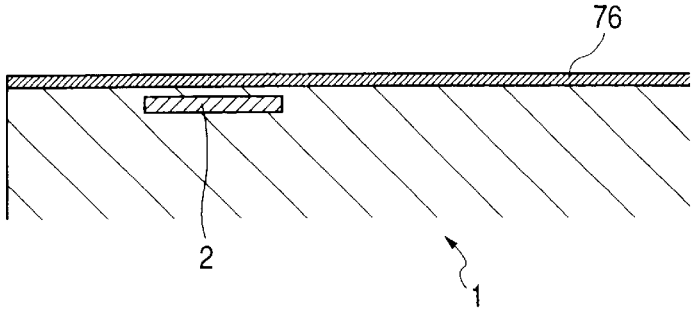
FIGS. 16A, 16B, 16C and 16D are process views illustrating a method of forming a movable member having a pressure sensor element on the element substrate.

First, referring to FIG. 16A, on the whole surface to the heater 2 side of the element substrate 1, a TiW film 76 as a first protective film to protect the connection pad portion for electrically connecting to the heater 2 is formed at a thickness of about 5000 Å by the sputtering method.

Figure 16B:
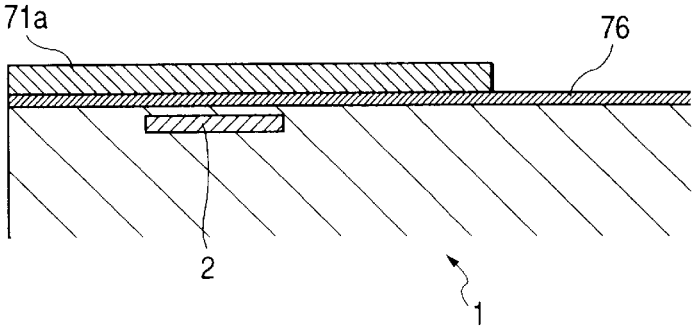

Subsequently, referring to FIG. 16B, on the surface of the TiW film 76, an Al film to form a space forming member 71*a* is formed at a thickness of about 4 μm by the sputtering method. The space forming member 71*a* is extended up to a region where an SiN film 72*a* is etched in a process of FIG. 17C, which will be described later.

The formed Al film is patterned by using the well-known photolithography process, thereby eliminating only a portion of the Al film, which corresponds to the supporting and fixing section of the movable member 6. In this manner, the space forming member 71*a* is formed on the surface of the TiW film 76. Accordingly, the portion in the surface of the TiW film 76, which corresponds to the supporting and fixing section of the movable member 6, is exposed. The space forming member 71*a* comprises the Al film to form a space between the element substrate 1 and the movable member 6. The space forming member 71*a* is formed in the whole portion on the surface of the TiW film 76, which includes the position corresponding to the bubble generation region 10 between the heater 2 and the movable member 6 shown in FIG. 13 and which excludes the portion corresponding to the supporting and fixing section of the movable member 6. In the forming method, therefore, the space forming member 71*a* is formed even in the portion which corresponds to the flow passage side wall on the surface of the TiW film 76.

As will be described later, the space forming member 71*a* functions as an etching stop layer when the movable member 6 is formed by dry-etching. The reason is that the TiW film 76, a Ta film as a cavitation resistance film in the element substrate 1, and an SiN film as a protective film on the resistor are etched by an etching gas which is used to form the liquid flow passage 7. In order to prevent those layers and films from being etched, such a space forming member 71*a* is formed on the element substrate 1. Consequently, when the SiN film is dry-etched to form the movable member 6, the surface of the TiW film 76 is not exposed, so that the space forming member 71*a* prevents the damage of the TiW film 76 and functional elements in the element substrate 1, which may be caused by the dryetching.

Figure 16C:
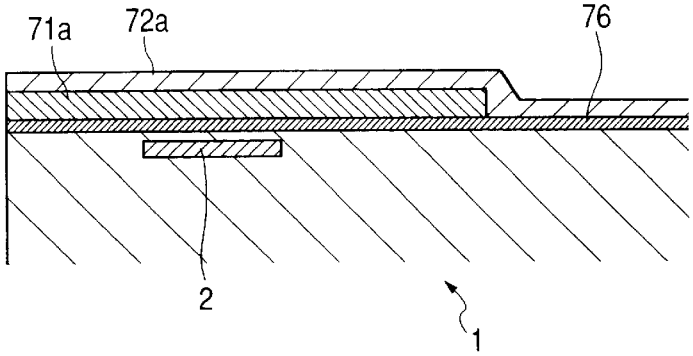
Figure 16D:
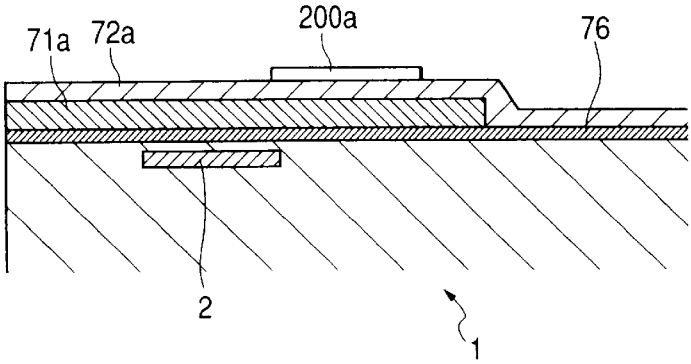

Referring to FIG. 16C, on the whole surface of the space forming member 71*a* and the whole surface of the exposed TiW film 76, an SiN film 72*a* as a material film to form the movable member 6 is formed at a thickness of about 2.5 μm so as to cover the space forming member 71*a* by using the plasma CVD method.

Subsequently, on a portion on the SiN film 72*a*, where the pressure sensor element 200 is formed, first and second barrier layers comprising Ta and Ti are formed by using the well-known semiconductor process, namely, sputtering method and a dielectric material film comprising Pb(Zr, Ti)$O_3$ is formed by the sputtering method or CVD method. Consequently, the piezoelectric element film 200*a* laminated as shown in FIG. 4 as described above is formed.

Figure 17A:
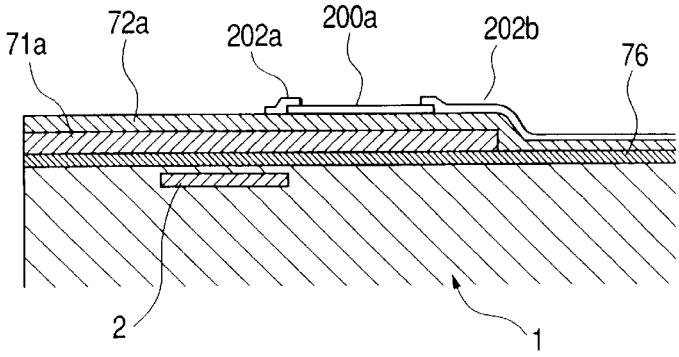
FIGS. 17A, 17B, 17C and 17D are process views illustrating a method of forming a movable member having a pressure sensor element on the element substrate.
Figure 17B:
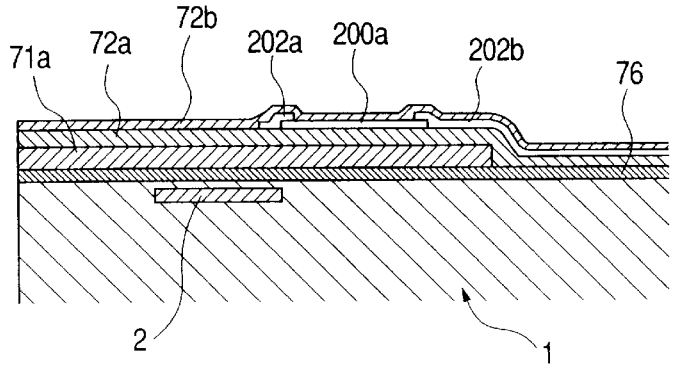

As shown in FIG. 17A, Al or Cu/W is patterned to form the lead wires 202*a* and 202*b* on both the ends of the piezoelectric element film 200*a*. Subsequently, referring to FIG. 17B, on the whole surface of the SiN film 72*a*, an SiN film 72*b* as a material film to form the movable member 6 is formed at a thickness of about 2.0 μm so as to cover the polysilicon film 200*a* and the lead wires 202*a* and 202*b* by using the plasma CVD method.

Subsequently, on the surface of the SiN film 72*b*, an Al film is formed at a thickness of about 6100 Å by the sputtering method. After that, the formed Al film is patterned by using the well-known photolithography process, thereby leaving the Al film (not shown) as a second protective layer on the portion corresponding to the movable member 6 on the surface of the SiN film 72*b*. The Al film (not shown) as a second protective layer is not left on one portion of the surface of the SiN film 72*b* on the piezoelectric element film 200*a* so as to expose one portion of the piezoelectric element film 200*a* upon dry-etching which will be described later. The Al film as a second protective layer functions the protective layer (etching stop layer), namely, a mask when the SiN films 72*a* and 72*b* are dryetched to form the movable member 6.

Figure 17C:
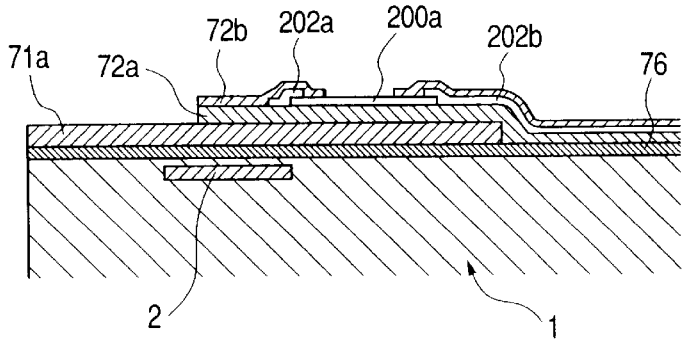

Referring to FIG. 17C., the SiN films 72*a* and 72*b* are patterned by using the etching device utilizing the inductively coupled plasma and using the second protective layer as a mask, so that the movable member 6 constituted of the remained portions of the SiN films 72*a* and 72*b* is formed. The etching device uses a mixture gas of $CF_4$ and $O_2$. In the process of patterning the SiN films 72*a* and 72*b*, the unnecessary portion of the SiN film 72*a* is eliminated so that the supporting and fixing section of the movable member 6 is directly fixed to the element substrate 1 as shown in FIG. 15. The constituting material of the adhered portion between the supporting and fixing section of the movable member 6 and the element substrate 1 contains Tiw as a constituting material of the pad protective layer and Ta as a constituting material of the cavitation resistance film of the element substrate 1.

Figure 17D:
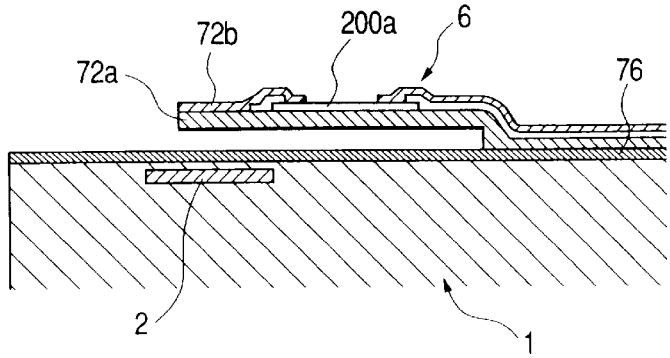

Referring to FIG. 17D, the second protective layer comprising the Al film formed in the movable member 6 and the space forming member 71*a* comprising the Al film are dissolved and eliminated by using a mixed acid of acetic acid, phosphoric acid, and nitric acid, thereby forming the movable member 6 on the element substrate 1. After that, the portion of the TiW film 76 formed on the element substrate 1, which corresponds to the bubble generation region 10 and pad is removed by using hydrogen peroxide.

As mentioned above, the element substrate 1 on which the movable member 6 having the pressure sensor element is formed is manufactured. The explanation regarding the manufacture of the element substrate 1 has been made with respect to the case where the supporting and fixing section of the movable material 6 was directly fixed to the element substrate 1 as shown in FIG. 13. The liquid discharge head in which the movable member is fixed to the element substrate through a pedestal portion can be also made by applying such a manufacturing method. In this case, prior to the process of forming the space forming member 71*a* shown in FIG. 16B, the pedestal portion to fix the free end and the other end on the opposite side of the movable member to the element substrate is formed on the surface to the heater side of the element substrate. Also in the case, Tiw as a constituting material for the pad protective layer and Ta as a constituting material for the cavitation resistance film of the element substrate are contained in the constituting material of the adhered portion between the pedestal portion and the element substrate.

After that, on the top board side as the other element substrate 3, a gold bump or the like is formed on the surface on which the electric connection pad is formed, thereby forming a convex electrode section. Although it is not shown, a connection utilizing metallic eutectic crystal is made between the convex electrode on the top board side and a concave electrode on the element substrate 1 side. At that time, when the same kind of metal is used as a kind of the metal on both the electrodes, a temperature and a pressure upon connection can be reduced and the joining strength can be increased.

Finally, an excimer laser is used to form the orifice 5 through a contact mask set on the whole surface of the face, thereby completing the liquid discharge head.

In the above-mentioned example of the manufacturing method, the case where the flow passage side wall 9 was formed on the top board 3 side has been described. The flow passage side wall 9 can be also formed on the element substrate 1 side simultaneously with the formation of the movable member 6 on the element substrate 1.

Figure 18:
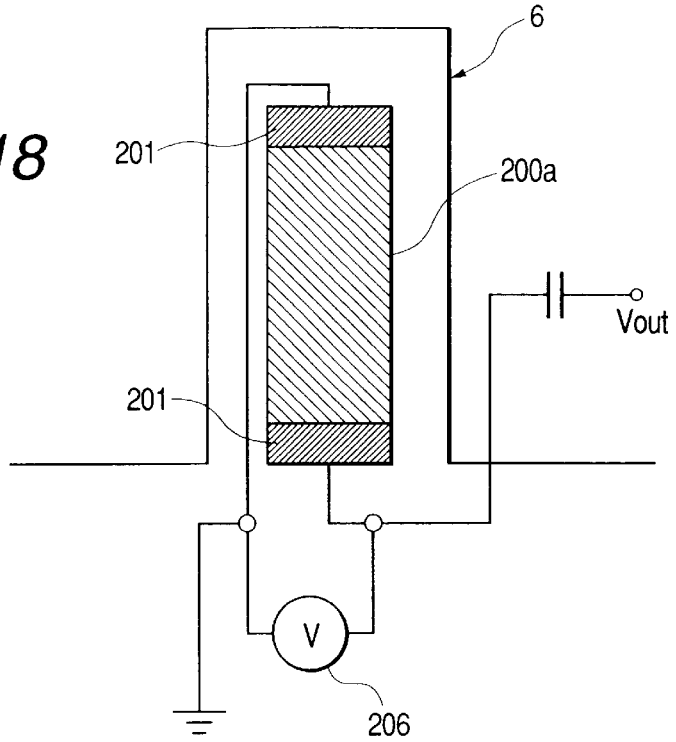
FIG. 18 is a view showing an example of a circuit for monitoring an output from the pressure sensor element.

FIG. 18 shows an example of a circuit for monitoring an output from the pressure sensor element. In the circuit shown in FIG. 18, an electromotive force accompanied with the displacement of the piezoelectric element film 200*a* due to the pressure caused when the recording liquid is bubbled is measured by a voltmeter 206, so that the amount of displacement of the movable member 6 and the pressure of the bubbling can be measured. In the circuit, the voltage of a Vout terminal indicates the electromotive force of the piezoelectric element film 200*a*. Accordingly, the Vout output is fed back to the FeRAM formed on the above-mentioned element substrate 1. Also in this case, the driving signal control circuit switches or selects the driving pulse on the basis of the fed-back signal, so that a constant bubbling pressure can be always obtained.

As mentioned above, even if the driving of the heater 2 is controlled in order to obtain a fine image quality as mentioned above, in the case where bubbles are generated in the common liquid chamber and the bubbles are moved into the liquid flow passage together with the refill of the liquid, such an inconvenience that the liquid exists in the common chamber but it is not discharged occurs in some cases.

In order to prevent the above inconvenience, a processing circuit for operating in such a manner that when the abnormal state of the bubbling is detected by the pressure sensor provided for the movable member 6 in the liquid flow passage, the circuit generates the result to a circuit for controlling a sucking recovery operation which will be described later, can be provided for the element substrate 1 or top board 3. On the basis of the output from the processing circuit, the liquid in the liquid discharge head is forcedly sucked from the discharge port by ink sucking means on a liquid discharge recording apparatus which will be described later, so that the bubbles in the liquid flow passage can be eliminated.

Figure 19:
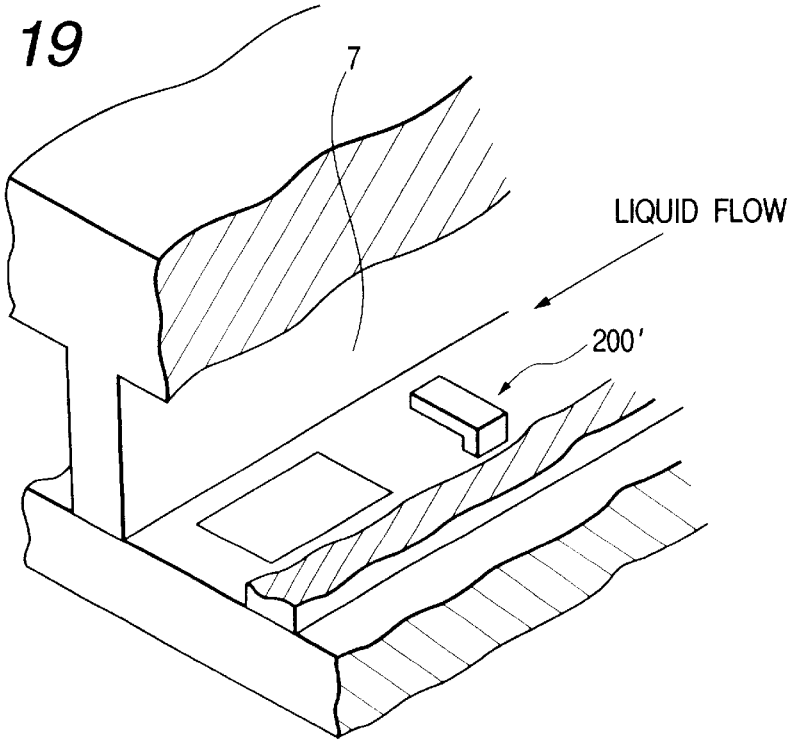
FIG. 19 is a perspective view showing another example of an arrangement of a three-dimensional structure in the liquid flow passage.

According to the present embodiment, the pressure sensor element 200 is built in the movable member. It is preferable to provide the element in the optimum location of the top board or element substrate in accordance with the detecting target such as change in pressure which acts on the liquid due to the bubbles generated in association with the film boiling in the heater 2 or stagnation of the ink flow. For example, as shown in FIG. 19, a pressure sensor element 200 comprising a ferroelectric material can be provided in the liquid flow passage 7. In this case, it is preferable to construct the pressure sensor element 200' so as not to obstruct the flow of the liquid.

The liquid discharge head of the above-mentioned embodiment solves the following conventional problems caused in association with the realization of high-density arrangement of the liquid discharge head in recent years.

A discharge amount of liquid is reduced due to the realization of the high-density arrangement of the liquid discharge head. In association with such a fact, a difference in discharge amount that is caused by the state of ink, which has not become a large issue so far, is being highlighted as a variation in discharge amount. Accordingly, in the arrangement of the temperature sensor of the conventional liquid discharge head, it is difficult to more accurately detect the state of ink. The reason is as follows. The temperature sensor of the conventional liquid discharge head is formed so as to be even on the surface of the element substrate together with an electrothermal transducer and a driving control unit by the semiconductor wafer processing technique. The flow of ink easily stagnates in the vicinity of the surface of the element substrate. It seems that the above fact is caused because the substrate has large temperature gradient due to the influence of heat from the electrothermal transducer. According to the present embodiment, the liquid discharge control can be more precisely performed without the stagnation of the ink flow and the influence of heat from the electrothermal transducer.

Although the pressure sensor has been described, it is also possible to use such a phenomenon that applying a voltage to the ferroelectric material as a piezoelectric element cause the displacement. Specifically speaking, the ink can be discharged or the meniscus in the orifice can be controlled by using the displacement. In order to easily obtain the displacement, a valve structure is formed and a ferroelectric material can be provided for such a portion having the valve structure. Since the structure can be realized in substantially the same manner as that of the structure in which the pressure of ink is detected to control the printing, these structures can be constructed so as to be combined. In order to increase the displacement, a laminate structure can be also used.

Example of Constituting Movable Member by Using Ferroelectric Material

An embodiment in which a movable wall is formed by using the ferroelectric material will now be explained with reference to the drawings.

FIG. 5 shows a cross-sectional view of a portion corresponding to a ink passage of the element substrate in the liquid discharge head of the present invention. Referring to FIG. 5, reference numeral 301 denotes a silicon substrate; 302 a thermal oxidation film as a heat storage layer; 303 an $SiO_2$ film or an $Si_3N_4$ film as an interlayer film which functions as a heat storage layer; 304 a resistance layer; 305 an Al alloy wire made of Al, Al—Si, or Al—Cu; 306 an $SiO_2$ film or an $Si_3N_4$ film as a protective film; 307 a cavitation resistance film to protect the protective film 306 from chemical or physical impact accompanied with heat generation in the resistance layer 304; and 308 a heat applied portion to the resistance layer 304 in a region where the electrode wire 305 is not formed.

Those driving elements are formed in an Si substrate by the semiconductor technique and the heat applied portion is further formed on the same substrate.

FIG. 6 is a schematic cross-sectional view when the element substrate is cut so as to longitudinally section the main elements in the element substrate in the liquid discharge head.

In the Si substrate 301 comprising a P conductor, the general MOS process is used and impurity introduction and diffusion such as ion implantation is performed to form a P-MOS 420 in an N-type well region 422 and an N-MOS 421 in a P-type well region 423. Each of the P-MOS 420 and the N-MOS 421 comprises a gate wire 435, and a source region 425 and a drain region 426 in each of which N-type or P-type impurities are introduced, made of poly-Si deposited at a thickness of 4000 Å or more to 5000 Å or less by the CVD method through a gate insulating film 428 having a thickness of hundreds of Å. C-MOS logic is constituted of the P-MOS and the N-MOS.

An N-MOS transistor for element driving comprises a drain region 431 and a source region 432 and a gate wire 433 in the P-well substrate by the process of impurity introduction and diffusion.

In the present embodiment, the explanation with respect to the constitution using the N-MOS transistor is made. When it is a transistor having an ability to individually drive a plurality of heaters and a function whereby the fine structure as mentioned above can be accomplished, it is not limited to the N-MOS transistor.

The oxidation film isolating region 423 is formed due to field oxidation with a thickness of 500 Å or more to 10000 Å or less between the devices, so that isolation is realized. The field oxidation film operates as a heat storage layer 434 of the first layer under the heat applied portion 308.

After the devices are formed, as an interlayer insulating film 436, a PSG (Phospho Silicate Glass) film or a BPSG (Boron-doped Phospho Silicate Glass) film is deposited at a thickness of about 7000 Å by the CVD method. The film is leveled by the heat treatment and, after that, wiring is formed by an Al electrode 437 serving as a first wiring layer through each contact hole. After that, an interlayer insulating film 438 comprising an $SiO_2$ film is deposited at a thickness of 10000 Å or more to 15000 Å or less by the plasma CVD method. Further, a $TaN_{0.8\ hex}$ film as a resistance layer 304 having a thickness of about 1000 Å is formed through a through hole. After that, the Al electrode is formed as a second wiring layer serving as a wire for each heater.

Subsequently, as a protective film 306, the $Si_3N_4$ film is formed at a thickness of about 10000 Å by the plasma CVD method. As a top layer, the cavitation resistance film 307 made of amorphous tantalum is deposited at a thickness of about 2500 Å. As a material for the cavitation resistance film 307, amorphous metal whose conductivity is weaker than that of a metallic film is selected. As a material for the cavitation resistance film 307, nitride (BN, TiN) or carbide (WC, TiC, BC) as an insulating material whose conductivity is weak and whose dielectric constant is relatively high can also be used.

Figure 20:
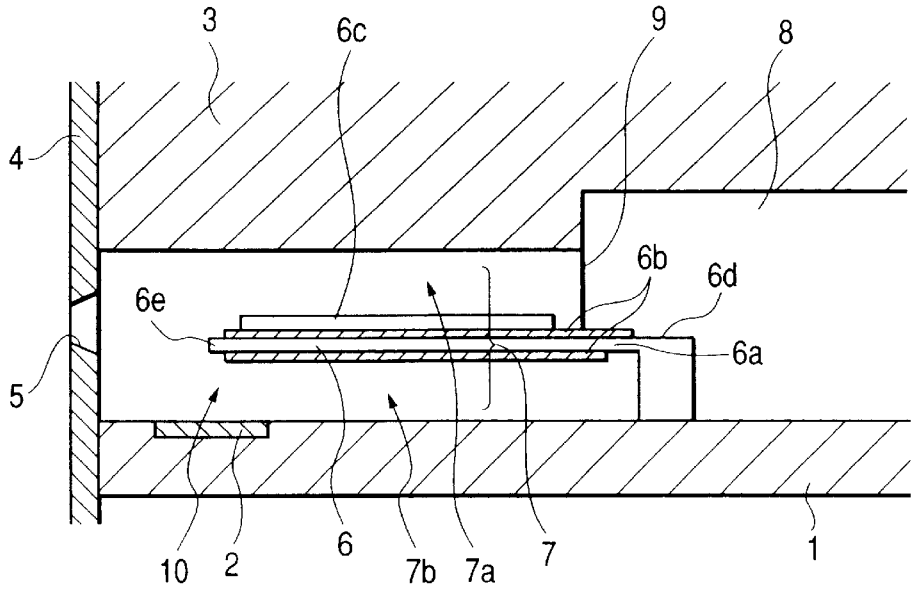
FIG. 20 is sectional view taken along a liquid flow passage direction, illustrating a basic structure of a liquid discharge head according to yet another embodiment of the invention.
Figure 21:
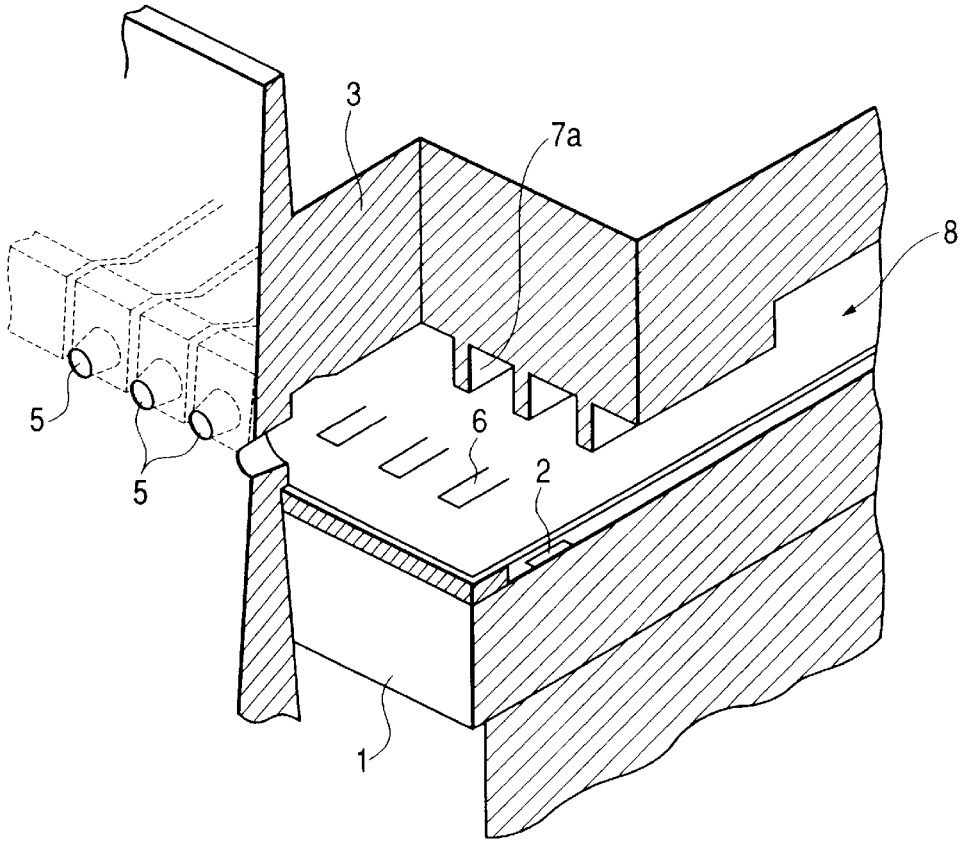
FIG. 21 is a perspective cutout view showing a portion of the liquid discharge head shown in FIG. 20.

FIG. 20 is a cross-sectional view taken along the liquid flow passage direction for explaining the fundamental structure of an embodiment of the liquid discharge head according to the present invention. FIG. 21 is a perspective view showing the liquid discharge head shown in FIG. 20 with a part of the head cut away.

The liquid discharge head according to the present embodiment comprises: the element substrate 1 in which the plurality of heaters 2 (only one heater is shown in FIG. 20) as bubble generating elements to apply heat energy for allowing the liquid to generate bubbles are arranged in parallel; and the top board 3 which is connected to the element substrate 1.

The element substrate 1 is formed in such a manner that a silicon oxide film or a silicon nitride film for isolation or heat storage is formed on a substrate made of silicon, and an electric resistance layer and a wiring electrode constituting the heater 2 are patterned on the above film. A voltage is applied from the wiring electrode to the electric resistance layer to supply a current to the electric resistance layer, so that the heater 2 generates heat.

The top board 3 is used to form the common liquid chamber 8 to supply the liquid to the plurality of liquid flow passages 7 corresponding to the heaters 2 and each liquid flow passage 7. The board is constructed so that the flow passage side wall 9 extending from the ceiling portion to each portion between the heaters 2 is integrally provided. The top board 3 comprises a silicon-based material. The board can be formed in such a manner that the pattern of the liquid flow passage 7 and the common liquid chamber 8 are formed by etching and the material such as silicon nitride or silicon oxide serving as a flow passage side wall 9 is deposited on the silicon substrate by the well-known film forming method such as CVD and, after that, the portion corresponding to each liquid flow passage 7 is etched.

A wall portion is provided on the front end surface of the top board 3. In the wall portion, the plurality of discharge ports 5 each of which corresponds to each liquid flow passage 7 and communicates with the common liquid chamber 8 through the liquid flow passage 7 are formed.

Further, the cantilever-shaped movable member 6, which is arranged so as to divide the liquid flow passage 7 into the first liquid flow passage 7*a* and the second liquid flow passage 7*b*, is provided for the recording head. The movable member 6 has: the ferroelectric thin film 6*a*; electrodes 6*b* arranged on both the surfaces of the film; and top film 6*c* as a displacement auxiliary film which is formed on the surface of the upper electrode 6*b*. The top film 6*c* is made of SiN or $SiO_2$ as a material which is not distorted even when it is disposed in the electric field. The displacement auxiliary film can be also formed on the surface of the lower electrode 6*b*.

On the upstream side of a large stream which flows from the common liquid chamber 8 to the discharge port 5 side through the upper portion of the movable member 6 due to the liquid discharging operation, the movable member 6 has the supporting point 6*d* in the vicinity of the supporting and fixing section of the movable member 6 to the element substrate 1. The member is arranged 15 on the element substrate 1 so as to have the free end 6*e* on the downstream side for the supporting point 6*d*. The bubble generation region 10 is located above the heater 2.

In this instance, "upstream" and "downstream" are used as expressions regarding the liquid flowing directions from a supply source of liquid toward the discharge port 5 via the upper portion of the bubble generation region 10 (or movable member 6), or the directions in the construction.

Subsequently, the distribution structure of the circuits and elements to the element substrate 1 and top board 3 will now be described.

FIGS. 7A and 7B are diagrams for explaining the circuit construction of the liquid discharge head shown in FIG. 20. FIG. 7A is a plan view of the element substrate and FIG. 7B is a plan view of the top board. FIGS. 7A and 7B show the planes which are opposite to each other.

As shown in FIG. 7A, in the element substrate 1, there are formed the plurality of heaters 2 which are arranged in parallel, a driver 11 for driving the heaters 2 in response to image data, image data transfer section 12 for generating inputted image data to the driver 11, and sensor 13 for measuring parameters necessary to control the driving conditions of the heater 2.

The image data transfer section 12 comprises: a shift register for generating the serially inputted image data to each of the drivers 11 in parallel; and a latch circuit for temporarily the data outputted from the shift register. The image data transfer section 12 can output image data so as to individually correspond to the heaters 2. The arrangement of the heaters 2 is divided into a plurality of blocks and the transfer section can also generate image data to the heaters on a block unit basis. Particularly, when a plurality of shift registers are provided for one head and data transferred from the recording apparatus is inputted so as to be distributed to the plurality of shift registers, it is possible to easily cope with the realization of high-speed printing.

As a sensor 13, a temperature sensor for measuring a temperature in the vicinity of the heater 2 or a resistance sensor for monitoring the resistance value of the heater 2 is used.

With consideration of the discharge amount of droplets to be ejected, the discharge amount is mainly concerned with the volume of a bubble in the liquid. The bubble volume in the liquid changes in accordance with the temperature of the heater 2 and its ambient temperature. The temperature of the heater 2 and its ambient temperature are measured by the temperature sensor. Prior to the supply of heating pulses for liquid discharge in response to the result, pulses (preheating pulses) having such small energy that the liquid is not discharged are supplied, the pulse width of the preheating pulse and the output timing are changed to control the temperature of the heater 2 and its ambient temperature. In this manner, constant droplets are discharged to maintain the image quality.

With consideration of energy in the heater 2, which is necessary to bubble the liquid, even when radiating conditions are constant, the energy is expressed by the product of the introduction energy per unit area which is necessary for the heater 2 and the area of the heater 2. Accordingly, the voltage that is applied across the heater 2, current flowing through the heater 2, and pulse width can be set to values at which the necessary energy can be obtained. In this instance, the voltage to be applied to the heater 2 can be held substantially constant by supplying the voltage from a power supply of the liquid discharge apparatus main body. On the other hand, for the current flowing through the heater 2, the resistance value of the heater 2 is varied dependent on a variation in film thickness of the heater 2 in the manufacturing process of the element substrate 1, lot, or element substrate 1. Accordingly, when the width of the pulse to be supplied is set to a predetermined value and the resistance value of the heater 2 is larger than a set value, the value of the flowing current is decreased and the amount of energy to be introduced to the heater 2 is lacked, so that the liquid can not be properly bubbled. On the contrary, in the case where the resistance value of the heater 2 is reduced, even if the voltage equivalent to the above is applied, the current value is larger than the set value. In this case, the heater 2 generates excess energy, so that it may result in a damage or short life of the heater 2. Accordingly, there is also a method whereby the resistance sensor always monitors the resistance value of the heater 2 and the power supply voltage or heating pulse width is changed by the value to supply substantially the constant energy to the heater 2.

On the other hand, as shown in FIG. 7B, in the top board 3, in addition to the grooves 3*a* and 3*b* constituting the liquid flow passages and common liquid chamber as mentioned above, the sensor driving unit 17 for driving the sensor 13 provided for the element substrate 1 and the heater control unit 16 for controlling the driving conditions of the heater 2 on the basis of the output result from the sensor driven by the sensor driving unit 17 are provided. In the top board 3, the supply port 3*c* which communicates with the common liquid chamber is opened in order to supply the liquid from the outside to the common liquid chamber.

Further, on the joined surfaces of the element substrate 1 and the top board 3, the connection contact pads 14 and 18 for electrically coupling the circuits formed in the element substrate 1 to those formed in the top board 3 are formed in the portions which are opposite to each other, respectively. The external contact pads 15 as input terminals for the electric signal from the outside are formed in the element substrate 1. The size of the element substrate 1 is larger than that of the top board 3. The external contact pads 15 are disposed in positions which are not covered by the top board 3 but exposed when the element substrate 1 is joined to the top board 3.

In this instance, an example of the forming procedure of the circuits in the element substrate 1 and top board 3 will now be described.

As for the element substrate 1, on the silicon substrate, the circuits constituting the driver 11, image data transfer section 12, and sensor 13 are first formed by using the semiconductor wafer process technique. Subsequently, the heaters 2 are formed as mentioned above. Finally, the connection contact pads 14 and external contact pads 15 are formed.

For the top board 3, on the silicon substrate, the circuits constituting the heater control unit 16 and sensor driving unit 17 are first formed by using the semiconductor wafer process technique. As mentioned above, subsequently, the grooves 3*a* and 3*b* constituting the liquid flow passages and the common liquid chamber and the supply port 3*c* are formed by the film forming technique and the etching. The connection contact pads 18 are finally formed.

When the element substrate 1 and the top board 3 constituted as mentioned above are joined so as to be aligned, each of the heaters 2 is arranged so as to correspond to each liquid flow passage and the circuits and the like formed on the element substrate 1 are electrically coupled to those of the top board 3 through the connection pads 14 and 18. For the electric coupling, for example, there is a method of performing the electric connection by setting gold bumps onto the connection pads 14 and 18. A method other than the above one can be also used. As mentioned above, the element substrate 1 is electrically coupled to the top board 3 by the connection contact pads 14 and 18, so that the foregoing circuits can be electrically coupled to each other simultaneously with the connection of the element substrate 1 to the top board 3. After the element substrate 1 is joined with the top board 3, the orifice plate 4 is joined to the front ends of the liquid flow passages 7, so that the liquid discharge head is completed.

The liquid discharge head of the present embodiment has the movable member 6 as shown in FIG. 20. For the movable member 6, after the circuits and the like are formed on the element substrate as mentioned above, the movable member is formed on the element substrate 1 by using the photolithography process. The forming process of the movable member 6 will now be described hereinbelow.

Figure 22:
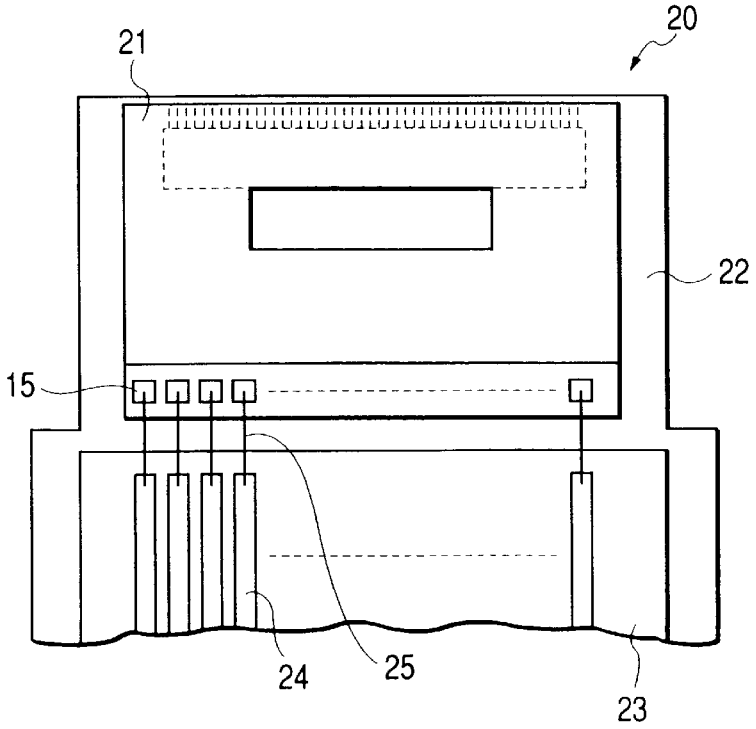
FIG. 22 is a plan view showing a liquid discharge head unit having the liquid discharge head of FIG. 20 loaded thereon.

When the liquid discharge head obtained as mentioned above is mounted on the head cartridge or liquid discharge apparatus, as shown in FIG. 22, the head is fixed to the base substrate 22 on which the printed wiring board 23 is mounted to form the liquid discharge head unit 20. Referring to FIG. 22, a plurality of wiring patterns 24 which are electrically coupled to the head control unit of the liquid discharge apparatus are formed on the printed wiring board 23. The wiring patterns 24 are electrically coupled to the external contact pads 14 via the bonding wires 25. Since the external contact pads 15 are formed on the element substrate 1 alone, the electric coupling of the liquid discharge head 21 to the outside can be realized in a manner similar to the conventional liquid discharge head. In this instance, although the description is made with respect to the example in which the external contact pads 15 are formed on the element substrate 1, they can also be formed not on the element substrate but on the top board 3 alone.

As described above, since the various circuits for driving and controlling the heaters 2 are distributed on the element substrate 1 and the top board 3 in consideration of the electric coupling of them, those circuits are not concentrated on one substrate, so that the liquid discharge head can be miniaturized. The circuits formed on the element substrate 1 are electrically coupled to those formed on the top board 3 by the connection contact pads 14 and 18, so that the number of portions for electrically coupling to the outside of the head is reduced. Consequently, the reliability can be improved, the number of parts can be reduced, and the miniaturization of the head can be further improved.

The above-mentioned circuits are distributed to the element substrate 1 and the top board 3, so that the yield of the element substrate 1 can be improved. Consequently, the manufacturing cost of the liquid discharge head can be reduced. Further, since the element substrate 1 and the top board 3 are made by the same silicon-based material, the coefficient of thermal expansion of the element substrate 1 is equivalent to that of the top board 3. Consequently, even if the element substrate 1 and the top board 3 are thermally expanded by driving the heaters 2, no deviation between them occurs, so that the alignment accuracy between each heater 2 and each liquid flow passage 7 is preferably held.

In the present embodiment, the above-described circuits are distributed in consideration of their functions. The ideas as references of the distribution will now be described hereinbelow.

The circuits corresponding to the heaters 2 individually or on the block unit basis in the electric wiring coupling are formed on the element substrate 1. In the example shown in FIGS. 7A and 7B, the driver 11 and the image data transfer section 12 correspond to the above circuits. Since the driving signals are supplied in parallel to the heaters 2, the number of wires to be led is needed as much as the number of signals. Accordingly, when such circuits are formed on the top board 3, the number of coupling portions between the element substrate 1 and the top board 3 increases, so that such a possibility that the coupling failure occurs is increased. When the circuits are formed on the element substrate 1, the coupling failure between the heaters 2 and the circuits can be prevented.

Since a section such as a control circuit, which operates in an analog manner easily, receives the influence of heat, those are disposed on the board on which the heaters 2 are not provided, namely, on the top board 3. In the example shown in FIGS. 23A to 23G, the heater control unit 16 corresponds to the above section.

The sensor 13 can be disposed on the element substrate 1 as necessary or can be arranged on the top board 3. For example, in the case of the resistance sensor, when it is not formed on the element substrate 1, it is meaningless or the measuring precision is deteriorated. Accordingly, it is provided on the element substrate 1. In the case of the temperature sensor, when the temperature rise due to the abnormal state of the heater driving circuit is detected, it is desirable to arrange the sensor on the element substrate 1. When it is desired to determine the state of the ink on the basis of the temperature rise through the ink, which will be described later, it is preferable to set the sensor on the top board 3 or both of the element substrate 1 and the top board 3.

The other circuits which do not correspond to the heaters 2 individually or on the block unit basis in the electric wiring coupling, circuit which can not always be formed on the element substrate 1, and sensor which does not exert on the measuring precision even when it is formed on the top board 3 are formed on the element substrate 1 or top board 3 as necessary so that they are not concentrated to either one of them. In the example shown in FIGS. 7A and 7B, the sensor driving unit 17 corresponds to the above one.

Since the circuits and sensors are provided on the element substrate 1 and the top board 3 on the basis of the above ideas, the circuits and sensors can be distributed so as to be well-balanced while the number of electric coupling portions between the element substrate 1 and the top board 3 is reduced as little as possible.

Subsequently, the method of manufacturing the movable member in the liquid discharge head according to the present embodiment will now be described with reference to FIGS. 23A to 23G. FIGS. 23A to 23G are cross-sectional views taken along the liquid flowing direction, each showing a process of manufacturing the movable member in the liquid discharge head shown in FIG. 20.

Figure 23A:
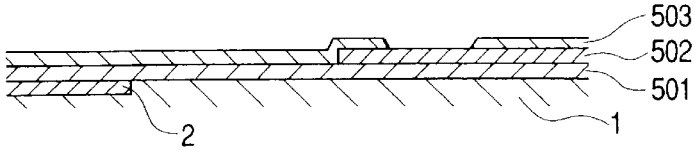
FIGS. 23A, 23B, 23C, 23D, 23E, 23F and 23G are sectional views taken along a liquid flow passage direction, each showing a manufacturing process of a movable member in the liquid discharge head shown in FIG. 20.

As shown in FIG. 23A, on a cavitation resistance layer 501 on the element substrate 1, a wiring layer 502 serving as one electrode wire for supplying a driving signal to allow the movable member 6 to be displaced and comprising Cu—Si is formed at a film thickness of 3000 Å. The wiring layer 502 is patterned and etched to form a desired electrode wire. Subsequently, an intermediate layer 503 comprising a SiN film is formed at a film thickness of 5000 Å on the wiring layer 502.

Figure 23B:
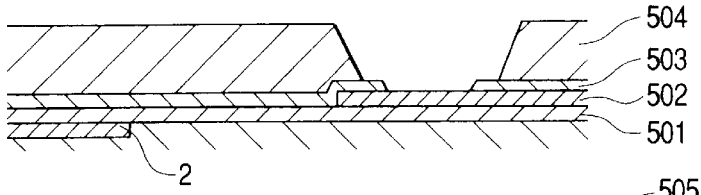

As shown in FIG. 23B, on the whole surface of the element substrate 1, a PSG film 504 is formed by the CVD method under conditions in which a temperature is set to 350° C. The film thickness of the PSG film 504 is set to 1 to 20 $\mu$m. The film thickness corresponds to the gap between the element substrate 1 and the movable member 6. Since the film thickness of the PSG film 504 is set within the above range, effects due to the improvement of liquid discharge efficiency by the movable member 6 are remarkably shown from the viewpoint of the balance of the whole of the liquid flow passages in the recording head.

Subsequently, in order to pattern the PSG film 504, resist is applied to the surface of the PSG film 504 by spin coating. After that, the exposure and the development are performed to remove the resist in a portion corresponding to the portion where the movable member 6 is fixed. The PSG film 504 in the portion, which is not covered by the resist, is eliminated by wet-etching with buffered hydrofluoric acid. After that, the resist remained on the surface of the PSG film 504 is eliminated by ashing with an oxygen plasma or by soaking the element substrate 1 into a resist removing agent. Consequently, one part of the PSG film 504 is left on the surface of the element substrate 1 and a mold member corresponding to a space between the movable member 6 and the element substrate 1 is formed in a process which will be executed later.

Figure 23C:
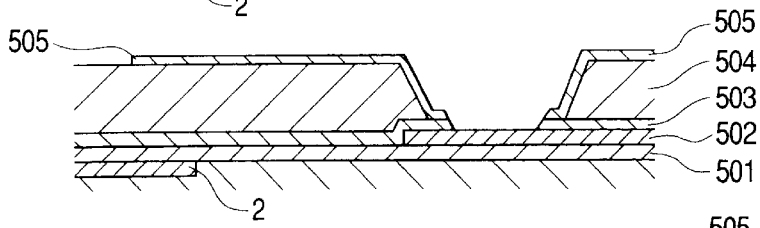

As shown in FIG. 23C, a protective layer 505 comprising SiN is formed at a film thickness of 5000 Å. The above-mentioned intermediate layer 503 and protective layer 505 are patterned and etched.

Figure 23D:
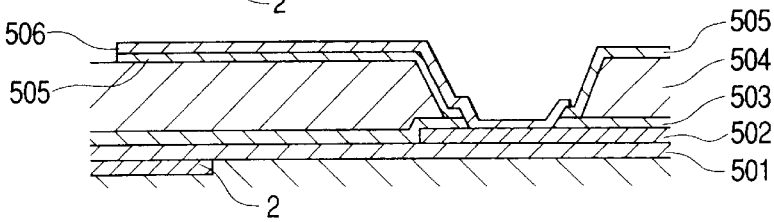

Subsequently, referring to FIG. 23D, an electrode layer 506 comprising Cu—Si to supply the driving signal of the movable member 6 is formed at a film thickness of 3000 Å by the sputtering method and similarly patterned and etched. Accordingly, the electrode layer 506 is connected to the wiring layer 502 to form the lower electrode **6*b* (refer to FIG. 20**).

Figure 23E:
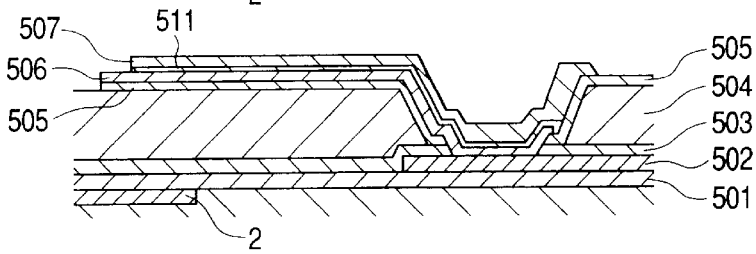

After a barrier layer 511 to protect a ferroelectric layer 507 which will be subsequently formed is formed by the sputtering, as shown in FIG. 23E, the ferroelectric layer 507 comprising Pb(Zr 0.5 Ti 0.5)$O_3$ is formed at a film thickness of 1 $\mu$m by the RF sputtering method. The formed ferroelectric layer 507 is patterned and etched, so that the layer 507 is formed into a shape corresponding to the movable member 6.

Figure 23F:
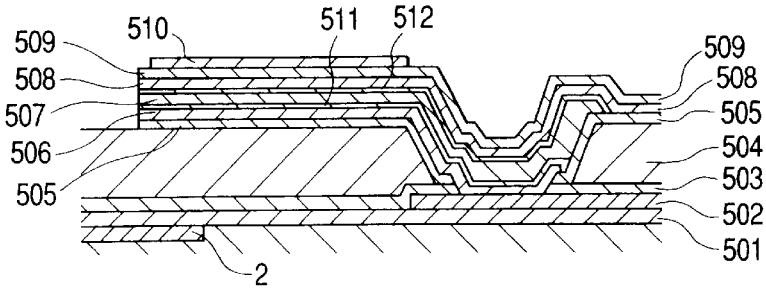

A barrier layer 512 as a protective layer for an electrode layer 508 is formed on the ferroelectric layer 507 by the sputtering. After that, as shown in FIG. 23F, the electrode layer 508 to supply the driving signal of the movable member 6, constituting the other electrode 6*b* on the upper side, is formed so that the film thickness is equal to 3000 Å by using Cu—Si. In order to protect the electrode layer 508, a protective layer 509 comprising SiN with a film thickness of 3000 Å is formed. Subsequently, in order to further increase the displacement of the movable member 6, a top film 510 made of SiN is formed at a film thickness of 6000 Å.

Figure 23G:
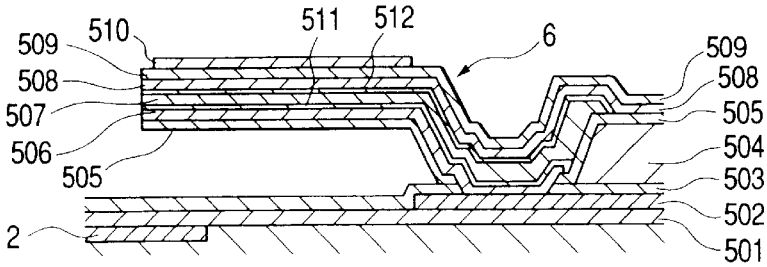

Finally, in order to form the portion corresponding to the bubble generation region 10 (refer to FIG. 20) between the element substrate 1 and the movable member 6, the PSG film 504 remaining as a mold member is removed by the wet-etching using buffered hydrofluoric acid. Consequently, as shown in FIG. 23G, a gap is formed between the element substrate 1 and the movable member 6.

The movable member 6 of the present embodiment is formed by the above processes.

Figure 24:
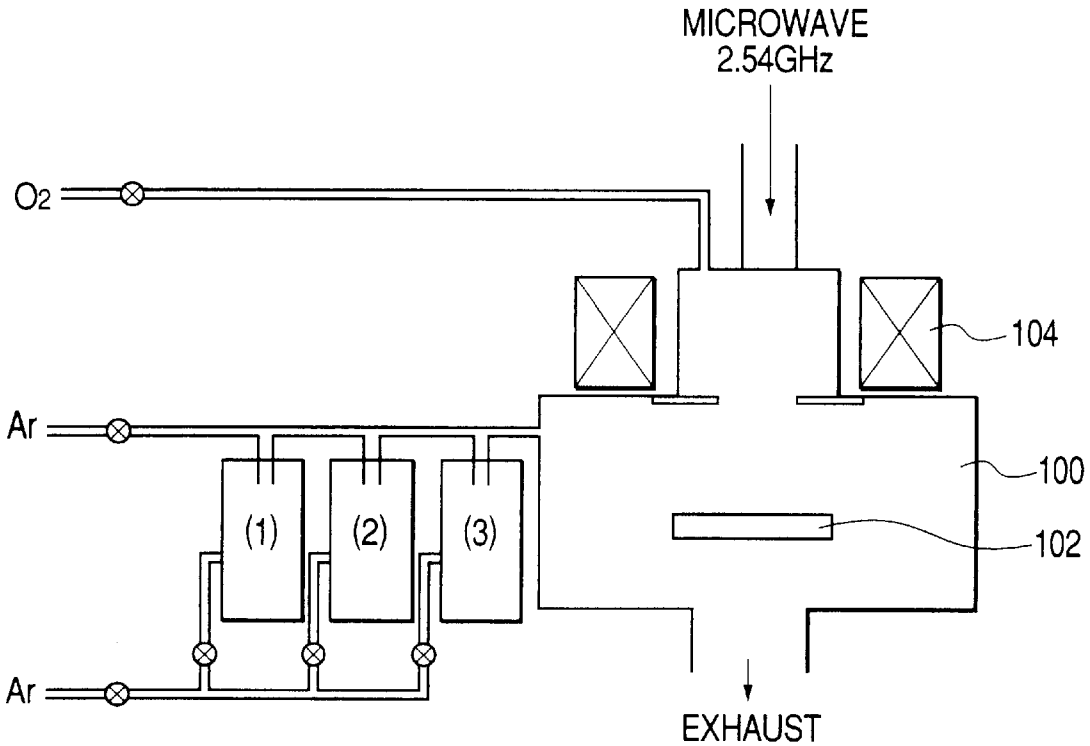
FIG. 24 is a view schematically showing an ECR plasma CVD device used for another manufacturing method of a movable member in the liquid discharge head of the invention.

In this instance, another method of manufacturing the movable member in the liquid discharge head according to the present embodiment will now be explained with reference to FIG. 24. FIG. 24 shows a schematic diagram of an ECR plasma CVD apparatus which is used in the present manufacturing method.

In the present manufacturing method, the ferroelectric thin film 6*a* of the movable member 6 is made of (Ba—Sr) $TiO_3$. The film is formed by the ECR plasma CVD method. Except for the above-mentioned conditions, the manufacturing method is performed in a manner similar to that described with reference to FIGS. 23A to 23G.

As materials for the ferroelectric thin film 6*a* formed by the ECR plasma CVD, $Ba(DPM)_2$ [bis-dipivaloylmethanate barium], $Sr(DPM)_2$, $Ti(O—i—C_3H_7)_4$, and $O_2$ are used. Each of $Ba(DPM)_2$ and $Sr(DPM)_2$ is supplied to a chamber 100 in the apparatus at a high temperature that is approximate to its melting point by using an Ar gas as a carrier as shown in FIG. 24. Hubbling with the Ar gas as a carrier gas is performed to supply $Ti(O—i—C_3H_7)_4$ into the chamber in the apparatus. On the other hand, an $O_2$ gas is also supplied into the chamber.

Reference numeral 104 denotes a magnetic coil.

Subsequently, microwaves of 2.54 GHz are introduced into the chamber to set those materials into a plasma state. Those materials reach the surface of a substrate 102 disposed in the chamber to form the ferroelectric thin film 6*a* comprising the ferroelectric materials.

The method of forming the ferroelectric thin film 6*a* of the movable member 6 by using the sputtering method or ECR plasma CVD method has been described above. However, the formation of the ferroelectric thin film 6*a* is not limited to those manufacturing methods. In addition to those methods, the film can also be formed by using the plasma CVD method, a thermal CVD method, an MOCVD (Molecular Organic CVD) method.

As materials for the ferroelectric thin film 6*a*, in addition to the above-mentioned materials, PZT: Pb—$Zr_x$—$Ti_{1-x}O_3$, SBT: Sr—$Bi_2Ta_2O_9$, $BaTiO_3$, PLZT: (Pb, La)—(Zr, Ti)$O_3$ can be used. The composition of the ferroelectric thin film 6*a* can be changed continuously or intermittently with respect to the direction of the film thickness.

Fundamental Principle of Liquid Discharge of Liquid Discharge Head of Present Embodiment The fundamental concept of the liquid discharge by the liquid discharge head as disclosed in the present invention will now be specifically explained with reference to FIGS. 25A to 25E.

FIGS. 25A to 25E are cross-sectional views for explaining the discharge method with the liquid discharge head of the present invention in the flow passage direction.

As shown in FIGS. 25A to 25E, the discharge port 5 is arranged in the end portion of the liquid flow passage 7 and the movable member 6 is disposed on the upstream side of the discharge port 5. The liquid flow passage 7 which directly communicates with the discharge port 5 is filled with the liquid to be supplied from the common liquid chamber 8. A voltage is applied between the upper and lower electrodes 6*b* formed in the movable member 6 to generate a distortion force in the ferroelectric thin film 6*a*, so that the movable member 6 can be displaced. Particularly, according to the present embodiment, when the voltage is applied between the-upper and lower electrodes 6*b* with respect to the flowing direction of the liquid, the length of the ferroelectric thin film 6*a* is expanded or shorten but the length of the top film 6*c* is held constant irrespective of applying the voltage to the portion between the electrodes 6*b*. Accordingly, a difference between the length of the thin film 6*a* and that of the top film 6*c* causes the distortion force in the movable member 6, so that the movable member 6 can be largely displaced.

When the voltage is applied between the electrodes 6*b*, the thin film 6*a* is contracted, so that the movable member 6 is displaced to the element substrate 1 side. When a voltage having a polarity opposite to that of the voltage in the above case is applied between both the electrodes 6*b*, the thin film 6*a* is expanded, so that the movable member 6 is displaced to the top board 3 side. The movable member 6 can be displaced to the top board 3 side or the element substrate 1 side in association with the growth and contraction of the bubble which is generated in the bubble generation region 10.

Figure 25A:
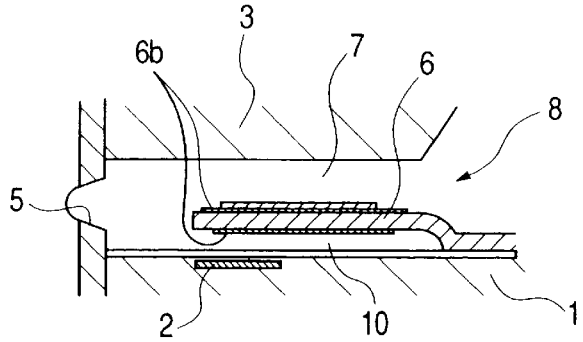
FIGS. 25A, 25B, 25C, 25D and 25E are sectional views taken along a flow passage direction, each illustrating a discharging method for the liquid discharge head of the invention.

First, in an initial state shown in FIG. 25A, the liquid slightly projects out of the discharge port 5 due to the surface tension, which the liquid itself has.

Figure 25B:
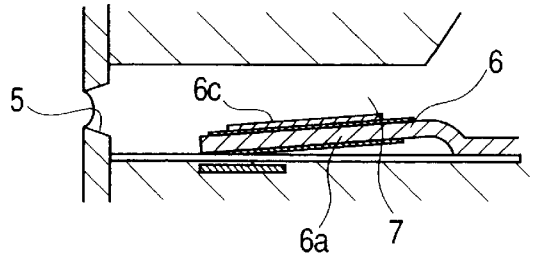

Subsequently, the ferroelectric thin film 6*a* is shrunk by applying the voltage between both the electrodes 6*b*. As shown in FIG. 25B, the movable member 6 is displaced to the element substrate 1 side. In association with the displacement, the surface of the liquid projecting out of the discharge port 5 is retracted as much as a predetermined distance into the liquid flow passage 7. Consequently, the discharge amount of the liquid of each liquid discharging operation can be stabilized.

Figure 25C:
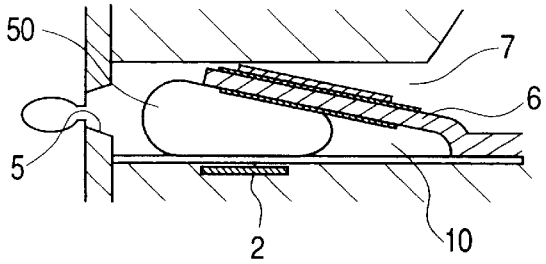

Referring to FIG. 25C, heat generation energy is supplied to the heater 2. Just before the bubble 50 is generated in the bubble generation region 10, a potential opposite to that in the case of FIG. 25B is applied between both the electrodes 6*b* of the movable member 6 to distort the ferroelectric thin film 6*a* in the opposite direction, so that the movable member 6 is displaced to the top board 3 side. After that, the grown bubble 50 is stopped in the movable member 6 which has been displaced just before and which serves as a barrier at the rear (on the upstream side). The liquid, which flows due to a generated pressure wave, does not flow to the rear of the movable member 6.

In other words, prior to the heating and bubbling of the liquid, it is preferable to apply the voltage having a potential opposite to that of the above case between both the electrodes 6*b* to previously displace the movable member 6 to the top board 3 side. Consequently, the flow of the liquid toward the upstream side is shunt and the liquid can be efficiently sent to the discharge port 5 on the downstream side, so that the liquid discharge efficiency from the discharge port 5 can be improved.

When the bubble generated on the whole surface of the heater 2 rapidly grows, the bubble comes to be in a filmy state. After that, the bubble is continuously expanded by a pressure that is extremely high at the beginning of the generation, the diameter of the bubble is grown up to the maximum bubble diameter like the bubble 50 shown in FIG. 25C.

Figure 25D:
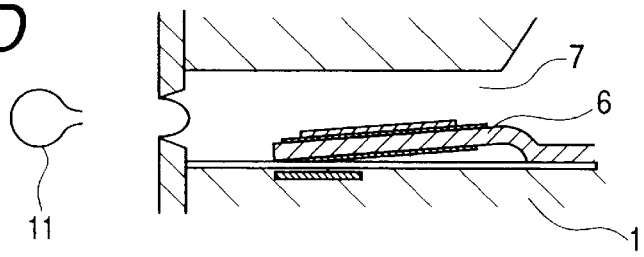
Figure 25E:
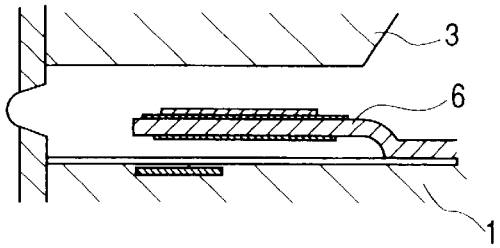

When a flying liquid (droplet) is separated from the surface of the liquid in the discharge port 5, the voltage having the same potential as that at the beginning is applied between both the electrodes 6*b* to displace the movable member 6 to the element substrate 1 side as shown in FIG. 25D. Owing to the operation, the same amount of the liquid is returned from the discharge port 5 side to the liquid flow passage 7 every discharge operation. Consequently, such a phenomenon that the liquid in the vicinity of the discharge port 5 leaves so as to follow the flying liquid (droplet) 11 or such a phenomenon that a small droplet as a satellite droplet flies subsequent to a main droplet can be eliminated. Further, the refill of the liquid from the upstream side is performed at a high speed.

For a period of time between the states shown in FIGS. 25C and 25D, the voltage having the same potential as that at the beginning is applied between both the electrodes 6*b*, so that a period of time during which the state shown in FIG. 25C is changed to the state shown in FIG. 25D, namely, the period of time until the movable member 6 is displaced to the element substrate 1 side after the movable member 6 was displaced to the top board 3 side as much as possible can be reduced. Consequently, the liquid discharge frequency can be improved.

Finally, when the movable member 6 is returned to the original position due to its own flexibility, the liquid discharge head is again returned to the initial state.

Figure 26:
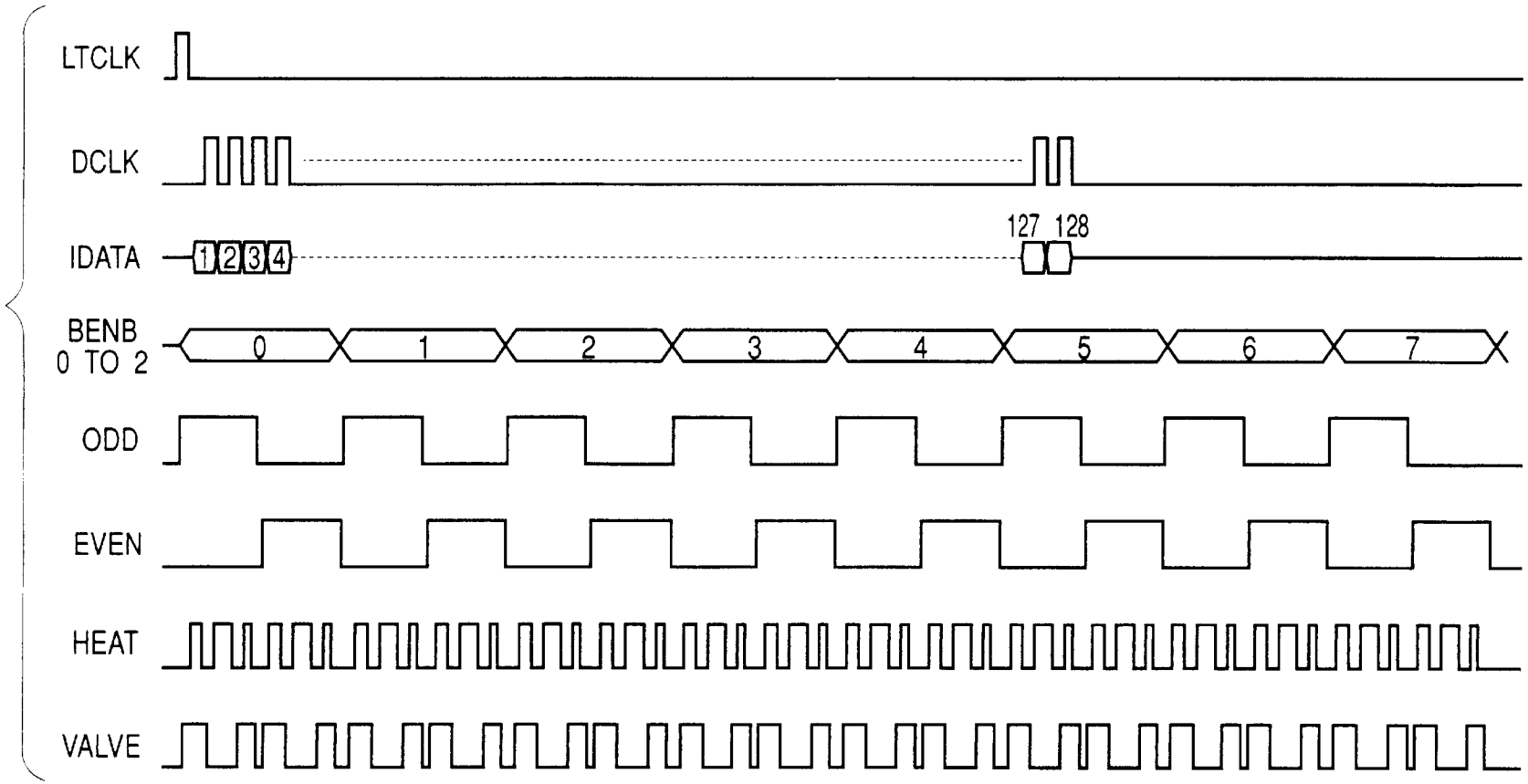
FIG. 26 is a timing chart of a signal entered to an electrode section or the like provided in the heater or the movable member to implement a discharge principle of the invention shown in FIGS. 25A to 25E.

FIG. 26 shows timing charts of signals to be inputted to the electrodes 6*b* provided in the heater 2 and the movable member 6 in order to embody the discharge principle of the present invention shown in FIGS. 25A to 25E.

In the present embodiment, a VALVE signal is first set to a high level (hereinbelow, referred to as a "H level") and the movable member 6 as a valve is set to the GND level. When a preheating signal is supplied, the valve is displaced to the heater 2 side to retract the meniscus in the discharge port. The supply of the preheating signal is then finished. After that, the VALVE signal is set to a low level (hereinbelow, referred to as an "L level") to discharge the charges of the dielectric film 6*a* of the valve. The valve is set to the GND level to return the valve to the original position.

Subsequently, a main-heating signal is supplied to discharge the droplet from the discharge port 5. At that time, the valve functions to stop the growth of the bubble to the rear.

The VALVE signal is set to the H level and the valve is set to the GND level. When the preheating signal is supplied, the valve is displaced to the heater side to accelerate the refilling speed of the liquid to the liquid flow passage. After that, the VALVE signal is set to the L, level to return the valve to the original position.

The embodiment regarding the fundamental construction of the present invention has been described. A specific example with respect to the above-mentioned circuits will now be explained hereinbelow.

Example of Controlling Supply Energy to Heater

Figure 27A:
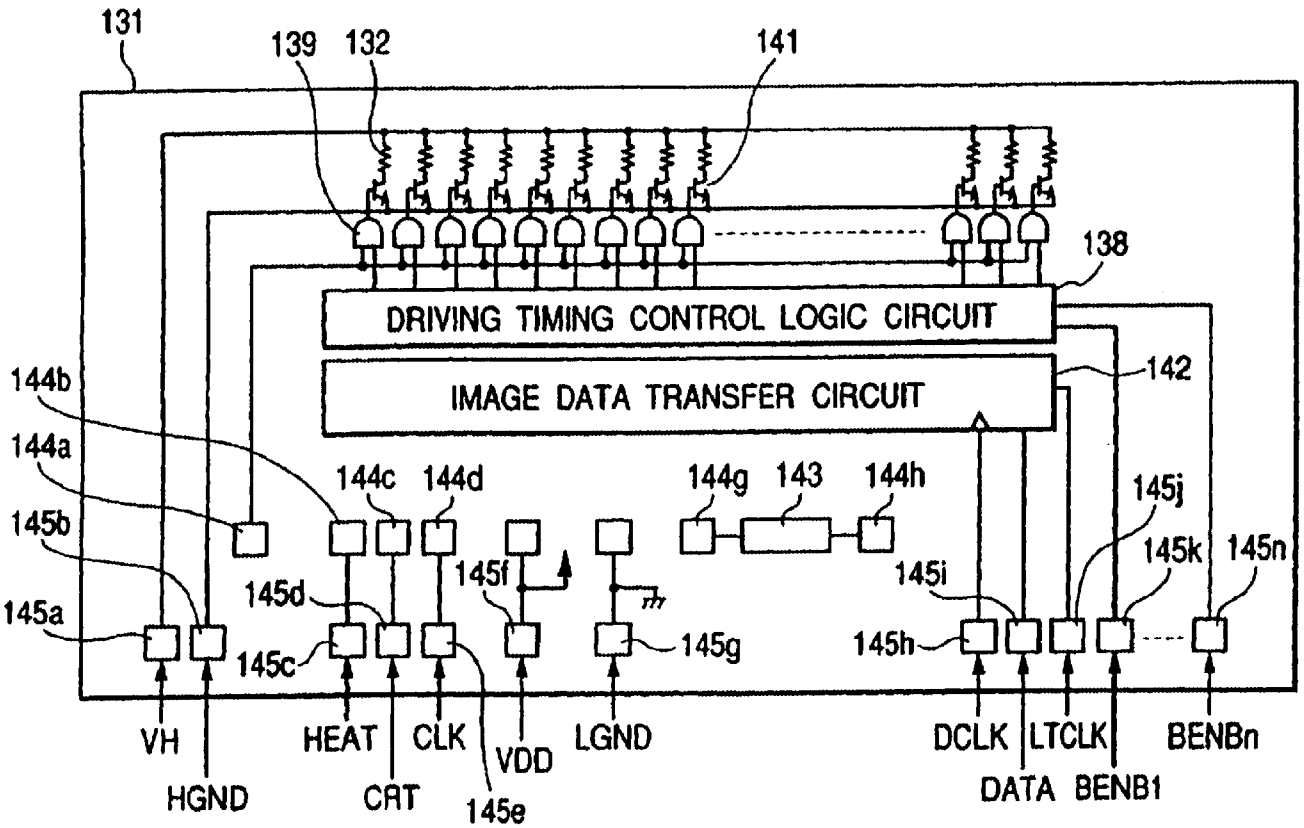
FIGS. 27A and 27B are views, each showing a circuit configuration of an exemplary element substrate or a top board provided to control energy applied to a heater according to a sensor output.
Figure 27B:
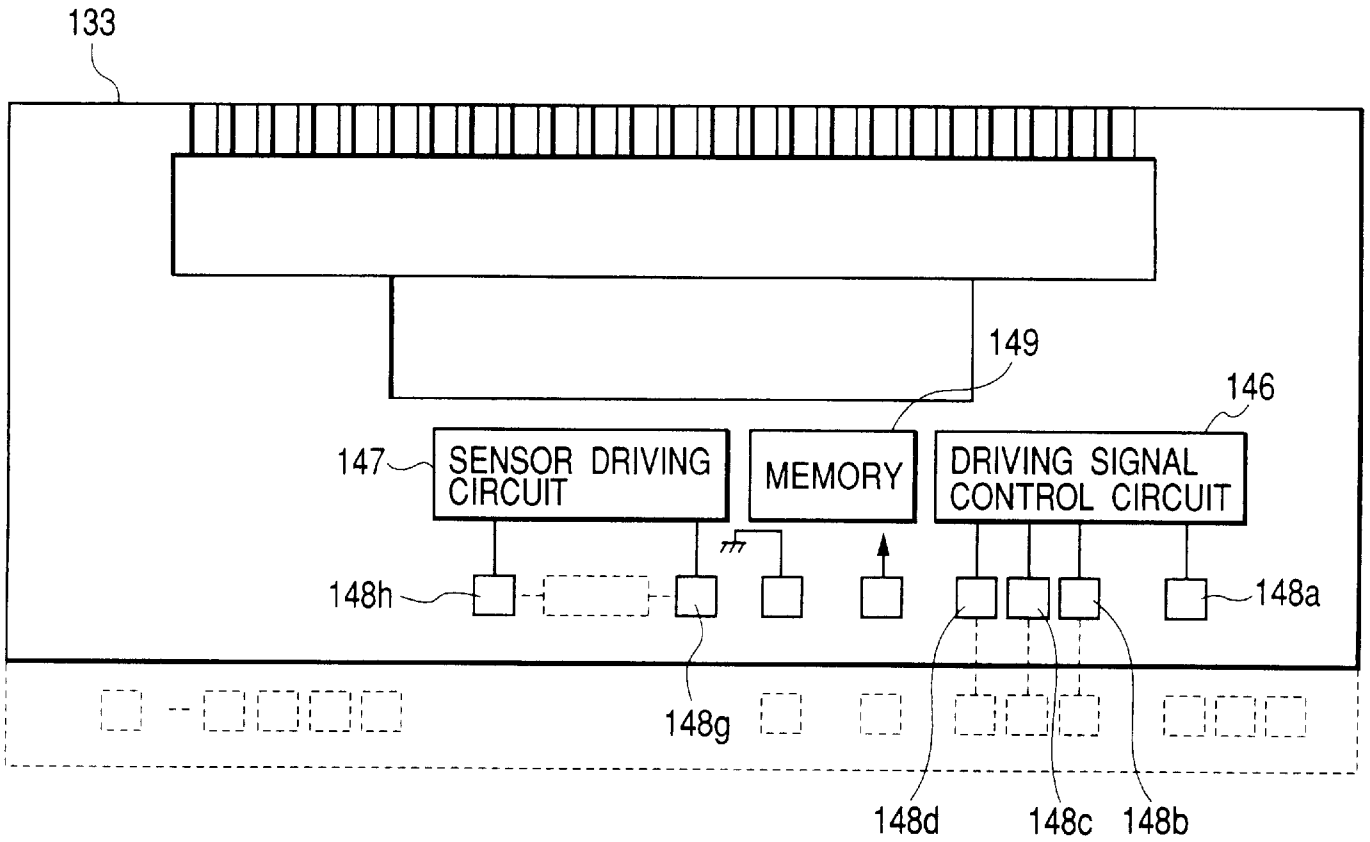

FIGS. 27A and 27B are diagrams showing circuit constructions in the element substrate and the top board in the example of controlling supply energy to each heater in response to a sensor output.

Referring to FIG. 27A, on an element substrate 131, there are formed heaters 132 arrayed in a line, power transistors 141 functioning as drivers, AND circuits 139 each for controlling the driving of each power transistor 141, a driving timing control logic circuit 138 for controlling the driving timing of each power transistor 141, an image data transfer circuit 142 comprising a shift register and a latch circuit, and a rank heater 143 for discharge heater, serving as a sensor for detecting the resistance value of the heater 2.

In order to reduce the power supply capacity of the apparatus, the driving timing control logic circuit 138 does not energize all of the heaters 132 simultaneously but dividingly drive the heaters 132 to energize them while staggering the timing. An enable signal for driving the driving timing control logic circuit 138 is inputted from enable signal input terminals 145*k* to 145*n* as external contact pads.

As external contact pads formed on the element substrate 131, in addition to the enable signal input terminals 145*k* to 145*n*, there are an input terminal 145*a* for a driving power supply to the heater 132, an earth terminal 145*b* of the power transistor 141, input terminals 145*c* to 145*e* for signals necessary for controlling the energy to drive the heaters 132, a driving power supply terminal 145*f* of the logic circuit, an earth terminal 145*g*, an input terminal 145*i* for serial data to be inputted to the shift register of the image data transfer circuit 142, an input terminal 145*h* for a serial clock signal which is synchronized with the serial data, and an input terminal 145*j* for a latch clock signal to be inputted to the latch circuit.

On the other hand, as shown in FIG. 27B, on a top board 133, there are formed a sensor driving circuit 147 for driving the rank heater 143 for discharge heater, a driving signal control circuit 146 for monitoring an output from the rank heater 143 for discharge heater to control energy to be applied to the heaters 132 in response to the result, and a memory 149 for storing a code value classified on the basis of resistance value data or resistance value detected by the rank heater 143 for discharge heater, and previously measured liquid discharge amount characteristics (liquid discharge amount in a predetermined pulse supply at a predetermined temperature) by each heater 132 as head information and outputting the information to the driving signal control circuit 146.

As connection contact pads, on the element substrate 131 and the top board 133, there are provided terminals 144*g*, 144*h*, 148*g*, and 148*h* for connecting the rank heater 143 for discharge heater to the sensor driving circuit 147, terminals 144*b* to 144*d* and 148*b* to 148*d* for connecting the input terminals 145*c* to 145*e* for signals, which are necessary to control the energy for driving the heaters 132 from the outside, to the driving signal control circuit 146, and a terminal 148*a* for supplying the output of the driving signal control circuit 146 to one input terminal of the AND circuit 139.

In the above construction, the resistance value of each heater 132 is first detected by the rank heater 143 for discharge heater and the result is stored into the memory 149. The driving signal control circuit 146 determines leading-edge data and trailing-edge data for the driving pulse to the heater 132 in accordance with the resistance value and the liquid discharge amount characteristics stored in the memory 149 and generates the determined data to the AND circuit 139 via the terminals 148*a* and 144*a*. On the other hand, image data which is serially inputted is stored in the shift register of the image data transfer circuit 142, latched in the latch circuit on the basis of the latch signal, and outputted to the AND circuit 139 through the driving timing control circuit 138. Accordingly, the pulse width of the heating pulse is determined in accordance with the leading-edge data and trailing-edge data. The energization to the heater 132 is performed on the basis of the pulse width. Consequently, substantially constant energy is applied to the heater 132.

In the above description, the rank heater 143 for discharge heater is explained as a resistance sensor. For example, it is used as a temperature sensor for detecting the temperature of the element substrate 131 or a value of the stored heat in the heater 132. The preheating pulse width can also be controlled in accordance with the detection result by the temperature sensor.

In this case, after the power supply of the liquid discharge apparatus is turned on, the driving signal control circuit 146 determines the preheating width of each heater 132 in accordance with the liquid discharge amount characteristics previously measured and the temperature data detected by the rank heater 143 for discharge heater. In the memory 149, selection data to select the preheating width corresponding to each heater 132 has been stored. Actually in preheating, the preheating signal is selected in accordance with the selection data stored in the memory 149 and the heater 132 is preheated in response to the selected signal. In this manner, the preheating pulse can be set and supplied so that the discharge amount of the liquid is set to a predetermined value in each discharge port irrespective of the temperature state. It is sufficient that the selection data to determine the preheating width is stored only once, for example, when the liquid discharge apparatus is activated.

In the example shown in FIGS. 27A and 27B, the explanation is made with respect to the case where the one rank heater 143 for discharge heater is provided. Two sensors such as resistance sensor and temperature sensor are provided and both of the heating pulse and the preheating pulse are controlled in response to the outputs of the sensors, so that the image quality can be further improved.

Further, as head information stored in the memory 149, in addition to the above-mentioned resistance value data of the heater, the kind of liquid to be discharged (when the liquid is an ink, the color of ink) can also be included. The reason is that depending on the kind of liquid, its physical properties are varied and the discharge characteristics are also varied. The storage of those head information into the memory 149 can be performed in a non-volatile manner after the assembly of the liquid discharge head or can also be performed by transferring the information from the apparatus side after the activation of the liquid discharge apparatus on which the liquid discharge head is mounted.

In the example shown in FIGS. 27A and 27B, the rank heater 143 for discharge heater is provided on the element substrate 131. When the rank heater 143 for discharge heater is the temperature heater, it can be formed on the top board 133. Also for the memory 149, when there is a space in the element substrate 131, it can be provided not on the top board 133 but on the element substrate 131.

As mentioned above, even if the driving of the heater 132 is controlled so as to obtain the preferable image quality, in the case where a bubble is generated in the common liquid chamber and it is moved together with the refill into the liquid flow passage, such an inconvenience that the liquid exists in the common liquid chamber but the liquid is not discharged occurs in some cases.

In order to prevent the above inconvenience, although the detailed description will be made later, a sensor for detecting the presence or absence of the liquid in each liquid flow passage (particularly, in the vicinity of each heater 132) can be provided. Further, when the absence of the liquid is detected by the sensor, a processing circuit for outputting the detection result to the outside can also be provided on the top board 133. When the liquid in the liquid discharge head is forcedly sucked from the discharge port on the liquid discharge apparatus side on the basis of the output from the processing circuit, the bubble in the liquid flow passage can be eliminated. As the above-mentioned sensor for detecting the presence or absence of the liquid, a sensor for detecting it on the basis of a change in resistance value through the liquid or one for detecting abnormal temperature rise in the heater in the case where no liquid exists can be used.

Figure 28:
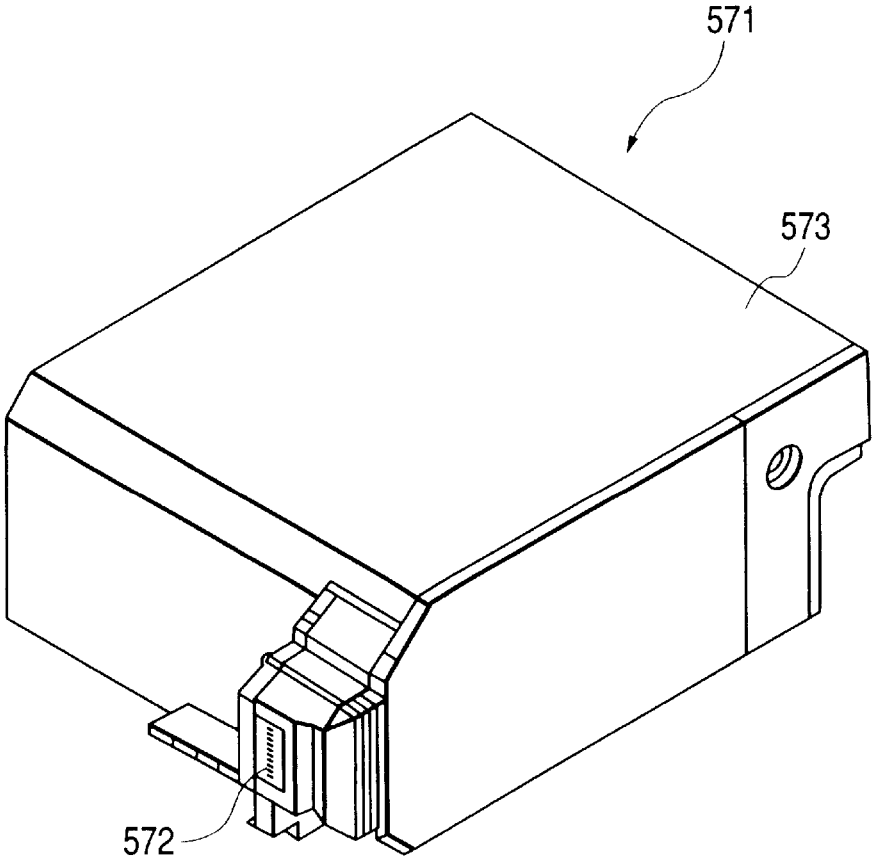
FIG. 28 is a perspective view showing a liquid discharge head cartridge having the liquid discharge head of the invention loaded thereon.

A liquid discharge head cartridge in which the above-described liquid discharge head is mounted will now be schematically explained with reference to FIG. 28. FIG. 28 is a perspective view showing the liquid discharge head cartridge in which the foregoing liquid discharge head is mounted.

A liquid discharge head cartridge 571 according to the present embodiment has a liquid discharge head 572 as mentioned above and a liquid container 573 for receiving liquid such as ink to be supplied to the liquid discharge head 572. The liquid received in the liquid container 573 is supplied to the common liquid chamber 8 (not shown, refer to FIG. 1) of the liquid discharge head 572 through a liquid supply passage (not shown).

After the liquid is consumed, the liquid container 573 can be refilled with the liquid and used. For this purpose, it is desirable to form a liquid inject port in the liquid container 573. The liquid discharge head 572 and the liquid container 573 can be formed so as to be incorporated or can be detachably formed.

The structure of the liquid discharge head to which the construction of each of the above-mentioned embodiments is applied is not limited to those shown in the drawings but can be applied to various liquid discharge heads utilizing the heat energy. For example, it can also be applied to a recording head including heating elements for generating thermal energy to discharge liquid or heating elements for generating thermal energy to color a recording sheet or to transfer or sublime ink from an ink bearing member as recording elements.

The above explanation is made with respect to the embodiments in which the capacitor, FeRAM, piezoelectric element, and movable member using the functional elements made of the ferroelectric material are separately provided. The liquid discharge head can be constituted by combining the constructions of those embodiments.

The functional elements comprising the ferroelectric material may be provided on either of the top board and the element substrate. In consideration of such a fact that the dielectric constant of the ferroelectric material is influenced depending on the temperature, it is desirable to arrange the elements on the top board side where the influence by the temperature is relatively small.

Figure 29:
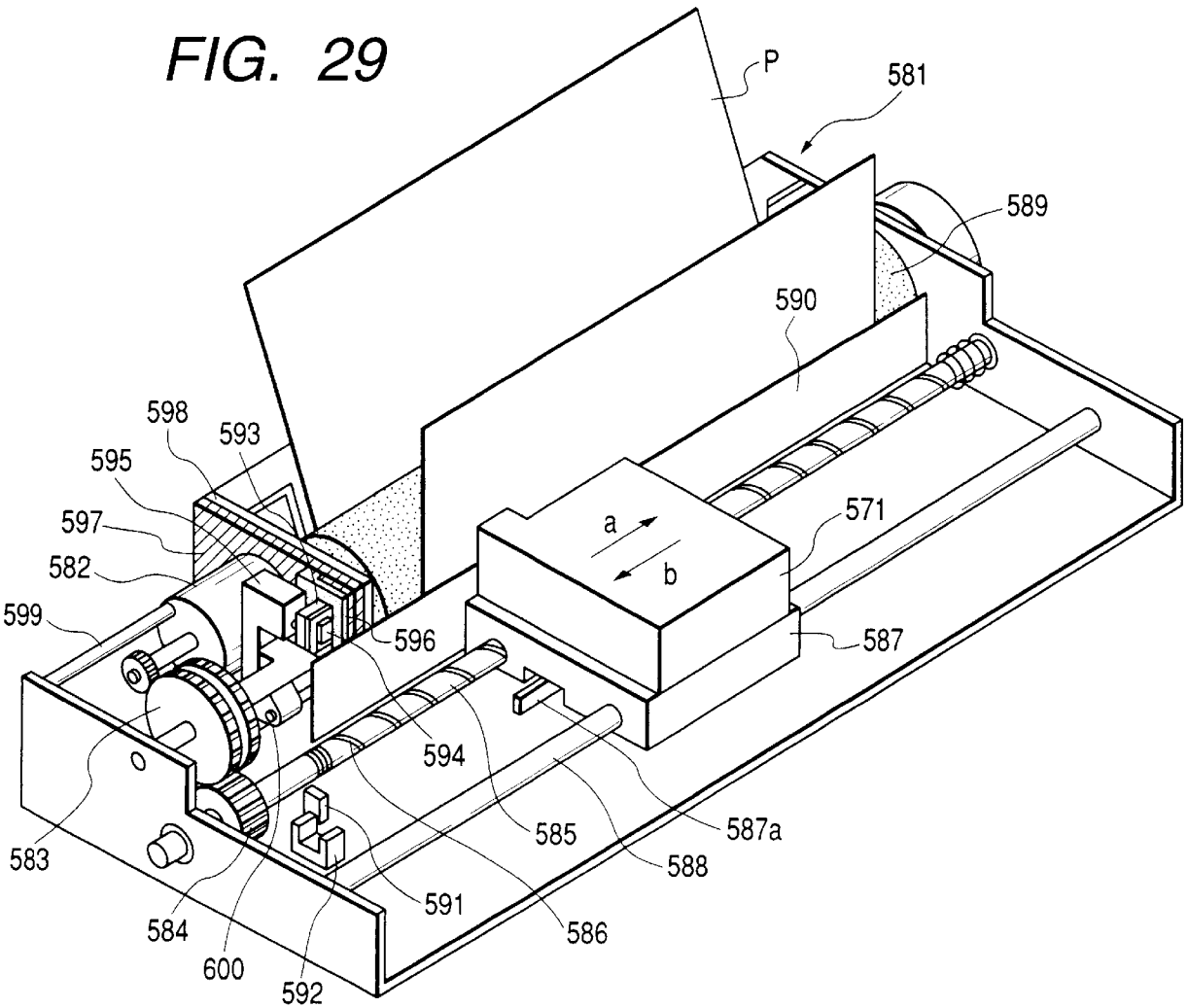
FIG. 29 is a perspective view schematically showing a constitution of a liquid discharge apparatus having the liquid discharge head of the invention loaded thereon.

The liquid discharge apparatus in which the foregoing liquid discharge head is mounted will now be described with reference to FIG. 29. FIG. 29 is a perspective view showing the schematic construction of the liquid discharge apparatus in which the above-mentioned liquid discharge head is mounted.

In a liquid discharge apparatus 581 of the present embodiment, the liquid discharge head cartridge 571 explained with reference to FIG. 28 is mounted on a carriage 587 which is engaged with a spiral groove 586 of a lead screw 585 rotating interlockingly with the forward or backward rotation of a driving motor 582 through driving force transmission gears 583 and 584. The liquid discharge head cartridge 571 is reciprocatingly moved together with the carriage 587 in the directions shown by arrows a and b along the guide 588 due to the power of the driving motor 582. A sheet presser plate 590 for pressing a recording medium P that is conveyed on a platen 589 by a recording medium feeding device (not shown) presses the recording medium P to the platen 589 over the whole moving area of the carriage 587.

Photocouplers 591 and 592 are disposed in the vicinity of one end of the lead screw 585. Those are home position detecting means for confirming the existence of a lever 587*a* of the carriage 587 in this area to switch the rotating direction of the driving motor 582. Referring to FIG. 29, reference numeral 593 denotes a supporting member for supporting a cap member 594 covering the front surface of the liquid discharge head of the liquid discharge head cartridge 571, where the discharge ports are formed. Reference numeral 595 denotes ink sucking means for sucking ink which is vacantly discharged from the liquid discharge head and collected in the inside of the cap member 594. The ink sucking means 595 performs sucking recovery for the liquid discharge head through an opening (not shown) in the cap.

Reference numeral 596 denotes a cleaning blade. Reference numeral 597 indicates a moving member for setting the cleaning blade 596 so as to be movable forward and backward (in the direction perpendicular to the moving direction of the carriage 587). A main body supporting member 598 supports the cleaning blade 596 and moving member 597. The form of the cleaning blade 596 is not limited to the above one. Another well-known cleaning blade can also be used. Reference numeral 599 denotes a lever for starting the sucking operation in the sucking recovery operation. The lever 599 moves in association with the movement of a cam 600 engaging with the carriage 587. The driving force transmitted from the driving motor 582 is moved and controlled by well-known transmitting means such as a clutch switch. In the liquid discharge apparatus 581, a recording control unit (not shown) as recording signal supply means for supplying the driving signal to allow the heaters 2 (refer to FIG. 1) provided for the liquid discharge head to discharge the liquid and for driving and controlling the above-mentioned mechanisms is provided in the apparatus main body.

In the liquid discharge apparatus 581, the liquid discharge head discharges the liquid to the recording medium P which is conveyed on the platen 589 by a recording medium conveying device (not shown) while reciprocatingly moving over the whole width of the recording medium P, and the discharged liquid is adhered to the recording medium P to perform the recording operation to the recording medium P.

As mentioned above, according to the present invention, since the current noise countermeasure can be performed in the vicinity of the heater, current noises can be sufficiently eliminated. Accordingly, the influence of the current noises to the circuit or elements formed on the head substrate can be more effectively prevented and the liquid discharge control can be more stably performed at high precision. Further additionally, since the capacitor having a large capacitance can be formed in a restricted space, large-current noises can be coped with and the miniaturization of the head can be realized.

According to the present invention, since the non-volatile memory with a large capacity, which is excellent in high processing speed, can be formed by using the ferroelectric material, the recording operation can be performed at a speed that is higher than that of the conventional head. Various sensors are disposed in the head and the process of controlling the driving conditions for the heaters for liquid discharge can also be performed at a high speed while the detection result is fed back in a real time manner. Accordingly, in addition to the high-speed recording, the liquid discharge control can be performed more stably.

According to the present invention, the piezoelectric element comprising the ferroelectric material detects the state of the liquid in the liquid flow passage in such a state where the influence by the liquid flow or influence by the heat generated by the energy generating element is small. Since the state of the liquid can be detected at high precision as mentioned above, the liquid can be stably discharged, so that the driving control of the head can be further finely performed.

According to the present invention, the movable member has the thin film comprising the ferroelectric material and the electrodes formed on both the surfaces of the thin film and is constructed so that when the voltage is applied between both the electrodes, the free end of the member is displaced to the element substrate side or side opposite to the element substrate. Accordingly, since the movable member can be actively displaced independent of the displacement due to the pressure of the bubble, the response properties of the movable member are improved, so that the improvement of the recording speed can be realized.

According to the present invention, the barrier layer as a protective film for the ferroelectric material film constituting the above functional element is made by oxidation film or nitride film including the cavitation resistance film or resistance layer which is formed to protect the protective film from chemical or physical impact accompanied with the heat generation in the resistance layer, so that the cost can be further reduced. In other words, the manufacturing process for the substrate for the liquid discharge head is activated in order to prevent the deterioration of ferroelectric characteristics, so that an increase in number of processes is prevented and the cost can be reduced.

Further, the hillock preventing film for preventing hillocks caused by heat generated in the wiring layer is sputtered or sputtered in the nitrogen or oxygen atmosphere or metal constituting the adhered layer is sputtered in the nitrogen or oxygen atmosphere, so that the barrier layer can be constituted in the same process as that for the hillock preventing film or adhered layer by using the same target and the same apparatus which are used to form the above film and layer. Consequently, the mass-production performance is excellent and the simplification of the manufacturing process can be realized.

What is claimed is:

1. A liquid discharge head substrate used for a liquid discharge head adapted to discharge liquid by applying discharge energy to the liquid comprising:

a semiconductor substrate including an energy conversion element for converting electric energy into the discharge energy; and a movable member disposed in a position opposite said energy conversion element with a gap formed between said movable member and said substrate, said movable member being supported and fixed on said substrate with a discharge port side of said movable member being set as a free end, wherein said semiconductor substrate is provided with a function element made of a ferroelectric material, and wherein said movable member is provided as said function element.

2. A liquid discharge head substrate according to claim 1, further comprising a thin film selected from Pb—$Zr_x$—$Ti_{1-x}$—$O_3$, (Pb, La)—(Zr, Ti)$O_3$, Sr—$Bi_2$—$Ta_2O_9$, $SrTiO_3$, $BaTiO_3$ and (Ba—Sr)$TiO_3$.

3. A liquid discharge head substrate according to claim 1, further comprising two electrodes and a displacement auxiliary layer formed on a surface of one of said two electrodes, said displacement auxiliary layer being made of a material which generates no distortion even in an electric field.

4. A liquid discharge head comprising:

first and second substrates for constituting a plurality of liquid flow passages respectively communicating with a plurality of discharge ports for discharging liquid by being joined to one another; and a function element made of a ferroelectric material, which is formed in at least one of said first and second substrates, wherein said function element is a piezoelectric element which detects a pressure applied to liquid in said liquid flow passages, and wherein said first substrate includes an energy conversion element formed to convert electric energy into thermal energy to generate bubbles in the liquid, and a movable member disposed opposite said energy conversion element and displaced by the bubbles, and said piezoelectric element is provided in said movable member.

5. A liquid discharge head according to claim 4, wherein said movable member is moved while an upstream side of said movable member in a liquid flowing direction is fixed, and a downstream end of said movable member is set as a free end.

6. A liquid discharge head according to claim 4, wherein said movable member includes a thin film made of a ferroelectric material and electrodes provided on both surfaces of said thin film, and a free end of said movable member is displaced in one of a direction toward a substrate side and a direction opposite said substrate side when a voltage is applied between said electrodes.

7. A liquid discharge head according to claim 6, wherein said thin film is one selected from Pb—$Zr_x$—$Ti_{1-x}$—$O_3$, (Pb, La)—(Zr, Ti)$O_3$, Sr—$Bi_2$—$Ta_2O_9$, $SrTiO_3$, $BaTiO_3$ and (Ba—Sr)$TiO_3$.

8. A liquid discharge head according to claim 6, wherein a displacement auxiliary layer is formed on a surface of one of said electrodes, said layer being made of a material which generates no distortion even in an electric field.

9. A head cartridge comprising:

a liquid discharge head as claimed in any one of claims 4–8; and a liquid container for storing the liquid to be supplied to said liquid discharge head.

10. A liquid discharge recording apparatus comprising:

a liquid discharge head as claimed in any one of claims 4–8; and driving signal supply means for supplying a signal used to discharge the liquid from said liquid discharge head, wherein recording is performed by discharging the liquid to a recording medium.

11. A driving method of a liquid discharge head comprising a discharge port for discharging liquid droplets, a liquid flow passage communicating with the discharge port to supply liquid to the discharge port, a substrate having a heater to generate bubbles in the liquid filling the liquid flow passage, and a movable member located in a position facing the heater of the substrate, a gap being provided between the movable member and the substrate, and the movable member being supported and fixed on the substrate with a discharge port side of the movable member being set as a free end, wherein the free end of the movable member is displaced in a direction opposite the substrate by a pressure generated by the generation of the bubbles and the droplets of the liquid are discharged from the discharge port by guiding the pressure to the discharge port, the movable member includes a thin film made of a ferroelectric material and electrodes provided on both surfaces of the thin film, and the free end is displaced in one of a direction toward the substrate and a direction opposite the substrate when a voltage is applied between the electrodes, said driving method comprising the step of:

performing driving of the heater and driving of the movable member independently of each other.

12. A driving method of a liquid discharge head according to claim 11, further comprising the step of:

before the heater is driven, driving the movable member to displace the free end thereof in a direction opposite the substrate.

13. A driving method of a liquid discharge head according to claim 11, further comprising the step of:

before the heater is driven to cause disappearance of the bubbles generated in the liquid, driving the movable member to displace the free end thereof toward the substrate.

* * * * *

UNITED STATES PATENT AND TRADEMARK OFFICE

CERTIFICATE OF CORRECTION

PATENT NO. : 6,688,729 B1 
DATED : February 10, 2004
INVENTOR(S) : Yoshiyuki Imanaka et al.

It is certified that error appears in the above-identified patent and that said Letters Patent is hereby corrected as shown below:

Column 3,
Line 30, “one,” should read -- one --.

Column 9,
Line 52, “$Ta_2O_9$” should read -- $Ta_2O_5$ --.

Column 14,
Line 52, “Si3N4” should read -- $Si_3N_4$ --.

Column 16,
Line 36, “showing” should read -- shows --.

Column 19,
Line 55, “2’arraying” should read -- 2’, arraying --.

Column 20,
Line 23, “an” should read -- a --.

Column 24,
Line 42, “elements” should read -- element --.

Column 25,
Line 41, “dryetching.” should read -- dry-etching. --.

Column 26,
Line 10, “dryetched” should read -- dry-etched --.

Column 31,
Line 42, “lacked,” should read -- insufficient. --; and
Line 47, “a” should be deleted.

Column 34,
Line 1, “circuit” should read -- circuits --; and
Line 2, “sensor” should read -- a sensor --, and “exert on” should read -- affect --.

Column 35,
Line 4, “Pb(Zr0.5 Ti0.5)$O_3$” should read -- Pb($Zr_{0.5}$ $Ti_{0.5}$)$O_3$ --; and
Line 47, “Hubbling” should read -- Bubbling --.

UNITED STATES PATENT AND TRADEMARK OFFICE

CERTIFICATE OF CORRECTION

PATENT NO. : 6,688,729 B1 
DATED : February 10, 2004
INVENTOR(S) : Yoshiyuki Imanaka et al.

It is certified that error appears in the above-identified patent and that said Letters Patent is hereby corrected as shown below:

Column 36,
Line 1, "$Bi_2Ta_2O_9$" should read -- $Bi_2Ta_2O_9$, $SrTiO_3$ --; and
Line 26, "the-upper" should read -- the upper --; and
Line 28, "shorten" should read -- shortened --.

Column 37,
Line 9, "shunt" should read -- shunted --.

Signed and Sealed this

Twenty-seventh Day of July, 2004

JON W. DUDAS
*Acting Director of the United States Patent and Trademark Office*